US007324775B2

(12) United States Patent
Okamoto

(10) Patent No.: US 7,324,775 B2
(45) Date of Patent: Jan. 29, 2008

(54) IMAGE FORMING APPARATUS HAVING DEVELOPING DEVICE WITH SEALING MEMBERS AND METHOD OF MANUFACTURE

(75) Inventor: Katsumi Okamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 281 days.

(21) Appl. No.: 11/073,364

(22) Filed: Mar. 4, 2005

(65) Prior Publication Data

US 2005/0226650 A1 Oct. 13, 2005

(30) Foreign Application Priority Data

| | | |
|---|---|---|
| Mar. 8, 2004 | (JP) | 2004-064805 |
| Mar. 8, 2004 | (JP) | 2004-064806 |
| Mar. 8, 2004 | (JP) | 2004-064807 |
| Mar. 11, 2004 | (JP) | 2004-069611 |
| Jan. 27, 2005 | (JP) | 2005-019969 |

(51) Int. Cl.
*G03G 15/08* (2006.01)

(52) U.S. Cl. ..... 399/103

(58) Field of Classification Search ..... 399/98, 399/102, 103, 105, 119
See application file for complete search history.

(56) References Cited

U.S. PATENT DOCUMENTS

| | | | | |
|---|---|---|---|---|
| 4,616,919 A | | 10/1986 | Adley et al. | |
| 5,389,732 A | * | 2/1995 | Sekino | 399/103 |
| 5,585,895 A | | 12/1996 | Yashiro et al. | |
| 5,697,021 A | | 12/1997 | Watanabe et al. | |
| 6,049,689 A | | 4/2000 | Ishii et al. | |
| 6,125,250 A | | 9/2000 | Kamio et al. | |
| 6,356,723 B1 | | 3/2002 | Sato et al. | |
| 6,496,669 B2 | | 12/2002 | Sato et al. | |
| 6,574,445 B2 | * | 6/2003 | Higeta et al. | 399/103 |
| 6,606,469 B2 | * | 8/2003 | Kikuchi et al. | 399/104 |
| 7,076,185 B2 | * | 7/2006 | Okamoto | 399/103 |
| 7,155,151 B2 | * | 12/2006 | Okamoto | 399/279 |
| 2002/0028086 A1 | | 3/2002 | Fumikazu er al. | |

FOREIGN PATENT DOCUMENTS

| | | |
|---|---|---|
| JP | 07-253740 | 10/1995 |
| JP | 09-185250 | 7/1997 |
| JP | 11-143326 | 5/1999 |
| JP | 2000-267437 | 9/2000 |
| JP | 2001-100525 | 4/2001 |

(Continued)

*Primary Examiner*—Robert Beatty
(74) *Attorney, Agent, or Firm*—Hogan & Hartson LLP

(57) ABSTRACT

A developing device for developing a latent image borne on an image bearing body using a developer borne on a developer bearing roller, is provided with: a housing that is for containing the developer and that has an opening; the developer bearing roller that is for bearing the developer and that is provided facing the opening; a sealing member that abuts against the developer bearing roller to prevent the developer from spilling; a supporting member that is attached to the housing and that is for supporting the developer bearing roller and the sealing member; and an urging member that is for urging the sealing member toward the developer bearing roller and that is provided between the supporting member and a surface of the sealing member on an opposite side from an abutting surface of the sealing member with which the sealing member abuts against the developer bearing roller.

25 Claims, 35 Drawing Sheets

FOREIGN PATENT DOCUMENTS

| | | | |
|---|---|---|---|
| JP | 2002-014537 | | 1/2002 |
| JP | 2002-214906 | | 7/2002 |
| JP | 2002214906 A | * | 7/2002 |
| JP | 2002-251068 | | 9/2002 |
| JP | 2003-076144 | | 3/2003 |
| JP | 2003-280371 | | 10/2003 |
| JP | 2003-295609 | | 10/2003 |

* cited by examiner

IMAGE FORMING APPARATUS HAVING DEVELOPING DEVICE WITH SEALING MEMBERS AND METHOD OF MANUFACTURE

CROSS-REFERENCE TO RELATED APPLICATION

The present application claims priority upon Japanese Patent Application No. 2004-64805 filed on Mar. 8, 2004, Japanese Patent Application No. 2004-64806 filed on Mar. 8, 2004, Japanese Patent Application No. 2004-64807 filed on Mar. 8, 2004, Japanese Patent Application No. 2004-69611 filed on Mar. 11, 2004, and Japanese Patent Application No. 2005-19969 filed on Jan. 27, 2005, which are herein incorporated by reference.

BACKGROUND OF THE INVENTION

1. Field of the Invention

The present invention relates to developing devices, image forming apparatuses, image forming systems, and methods for manufacturing developing devices.

2. Description of the Related Art (1) Image forming apparatuses such as laser beam printers are well known in the art. Such image forming apparatuses are provided with, for example, a photoconductor which is an example of an image bearing body for bearing a latent image, and a developing device for developing, with a developer, the latent image borne on the photoconductor. When the image forming apparatus receives image signals etc. from an external device such as a host computer, it positions the developing device at a developing position which is in opposition to the photoconductor, develops the latent image borne on the photoconductor with the developer in the developing device to form a developer image, and transfers the developer image onto a medium to ultimately form an image on the medium.

In order to achieve, for example, the above-described function of developing the latent image borne on the photoconductor, the developing device of the above-described type is provided with a housing that is for containing the developer and that has an opening, and a developing roller, which is an example of a developer bearing roller, that is for bearing the developer and that is provided facing the opening. The developing device develops the latent image borne on the photoconductor with the developer borne on the developing roller.

The developing device of the above-described type is also provided with a sealing member that abuts against the developing roller to prevent the developer from spilling. The sealing member and the developing roller are supported by a supporting member, and the supporting member is attached to the housing.

The developing device of the above-described type is also provided with an urging member for urging the sealing member toward the developing roller. The urging member presses the sealing member against the developing roller by urging the sealing member toward the developing roller with its urging force. (See, for example, JP 2003-280371 A.)

By the way, in order for the sealing member to appropriately achieve its function of preventing the developer from spilling, it is necessary to make the abutting pressure at which the sealing member abuts against the developing roller even. In order to do so, it is necessary to appropriately set the position of the urging member, for example, the relative position of the urging member with respect to the developing roller, the sealing member, and a member against which the urging member abuts on the opposite side from the sealing member, to a desired position.

Meanwhile, a conventional developing device having an urging member for urging the sealing member toward the developing roller is known to have an urging member provided between a sealing member and a housing. In such a case, in order to appropriately set the relative position of the urging member with respect to the developing roller, the sealing member, and the housing to a desired position, it is necessary to strictly control the positional relationship between the supporting member that supports the developing roller and the sealing member, and the housing to which the supporting member is attached.

Therefore, in such a developing device, there are problems in that it is difficult to carry out appropriate positioning of the relative position of the urging member with respect to the developing roller, the sealing member, and the housing, and thus, it is difficult to make the abutting pressure of the sealing member against the developing roller even.

(2) Another type of image forming apparatus is provided with, for example, a photoconductor which is an example of an image bearing body for bearing a latent image, and a developing device for developing, with a developer, the latent image borne on the photoconductor. When the image forming apparatus receives image signals etc. from an external device such as a host computer, it positions the developing device at a developing position which is in opposition to the photoconductor, develops the latent image borne on the photoconductor with the developer in the developing device to form a developer image, and transfers the developer image onto a medium to ultimately form an image on the medium.

In order to achieve, for example, the above-described function of developing the latent image borne on the photoconductor, the developing device of the above-described type is provided with: a housing that is for containing the developer and that has an opening; a developing roller, which is an example of a developer bearing roller, that is for bearing the developer and that is provided facing the opening; and a restriction blade that is an example of a layer-thickness restricting member that abuts against the developing roller along its axial direction to restrict a thickness of a layer of the developer. The developing device restricts the thickness of the layer of developer borne on the developing roller using the restriction blade, and develops the latent image borne on the photoconductor with the developer whose layer thickness has been restricted.

The developing device of the above-described type is also provided with a first sealing member that abuts against the developing roller along the axial direction thereof to prevent the developer from spilling, and a second sealing member that abuts against an end, in the axial direction, of the developing roller along the circumferential direction of the developing roller to prevent the developer from spilling. (See, for example, JP 2003-280371 A.)

In order for the restriction blade to appropriately achieve its function of restricting the layer thickness of the developer as described above, it is necessary to set the relative position of the restriction blade with respect to the developing roller to an appropriate position with high precision. Also, in order for the first sealing member and the second sealing member to appropriately achieve their function of preventing the developer from spilling as described above, it is necessary to set the relative position of the first sealing member and the second sealing member with respect to the developing roller to an appropriate position with high precision.

Incidentally, as conventional developing devices provided with a developing roller, a restriction blade, a first sealing member, and a second sealing member, there are known developing devices having those members attached either directly, or via a supporting member corresponding to each of those members, to the housing. However, in assembling such a developing device, it is necessary to assemble these members to the housing while adjusting these members such that the relative positions of the restriction blade, the first sealing member, and the second sealing member with respect to the developing roller are appropriately set. Such tasks are extremely burdensome.

(3) Another type of image forming apparatus is provided with, for example, a photoconductor which is an example of an image bearing body for bearing a latent image, and a developing device for developing, with a developer, the latent image borne on the photoconductor. When the image forming apparatus receives image signals etc. from an external device such as a host computer, it positions the developing device at a developing position which is in opposition to the photoconductor, develops the latent image borne on the photoconductor with the developer in the developing device to form a developer image, and transfers the developer image onto a medium to ultimately form an image on the medium.

In order to achieve, for example, the above-described function of developing the latent image borne on the photoconductor, the developing device of the above-described type is provided with a housing that is for containing the developer and that has an opening, and a developing roller, which is an example of a developer bearing roller, that is for bearing the developer and that is provided facing the opening. The developing device develops the latent image borne on the photoconductor with the developer borne on the developing roller.

The developing device of the above-described type is also provided with a sealing member for preventing the developer from spilling from the housing. The sealing member is supported in a bent state on the side of one end in the lateral direction thereof by the developing device, and abuts against the developer bearing roller on the side of the other end in the lateral direction thereof. (See, for example, JP 2003-280371 A.)

In a situation in which the sealing member is supported in a bent state on the side of one end in the lateral direction thereof by the developing device and in which the sealing member abuts against the developer bearing roller on the side of the other end in the lateral direction thereof, the abutment of the sealing member against the developer bearing roller may become inappropriate due to how the sealing member bends. Examples in which the abutment becomes inappropriate are cases where the lateral-direction width of abutment of the sealing member is too short, or where the abutting pressure of the sealing member is uneven. Such an inappropriate abutment may cause deterioration in the function of the sealing member of preventing the developer from spilling.

(4) Another type of image forming apparatus is provided with, for example, an image bearing body for bearing a latent image, and a developing device that develops the latent image borne on the image bearing body with a developer. When the image forming apparatus receives image signals etc. from an external device such as a host computer, the developing device is positioned in a developing position which is in opposition to the image bearing body, the latent image borne on the image bearing body is developed with the developer contained in the developing device to form a developer image, and the developer image is transferred onto a medium to ultimately form an image on the medium.

The developing device of the type described above has, for example, a housing that is for containing the developer and that has an opening, and a developer bearing roller that is for bearing the developer and that is provided facing the opening.

In such a developing device, an end sealing member is provided between the housing and the developer bearing roller for preventing the developer from spilling from the ends of the developer bearing roller. The end sealing member prevents the developer from spilling by applying a pressure (which is referred to also as "abutting pressure" below) against the developer bearing roller. (See, for example, JP 2003-295609 A.)

In such developing devices, it is necessary to set the abutting pressure to a suitable value. This is because the function of preventing the developer from spilling becomes insufficient if the abutting pressure is small, whereas the torque required for rotating the developer bearing roller becomes large if the abutting pressure is large.

In some cases, however, it is not possible to apply an abutting pressure of a suitable value, depending on the relationship between the width of the end sealing member and the width of a sealing space between the housing and the developer bearing roller where the end sealing member is provided. For example, the abutting pressure will become larger than a suitable value if the relationship between the width of the sealing space and the width of the end sealing member makes the compression amount of the end sealing member between the housing and the developer bearing roller become larger than a predetermined compression amount.

SUMMARY OF THE INVENTION

The present invention has been made in light of the foregoing issues. It is an object of the present invention to achieve a developing device, an image forming apparatus, and an image forming system in which the abutting pressure of the sealing member against the developer bearing roller is made even. Another object of the present invention is to achieve a developing device, an image forming apparatus, and an image forming system that can be easily assembled. Another object of the present invention is to make a sealing member abut against a developer bearing roller appropriately. Another object of the present invention is to achieve a developing device that allows the abutting pressure of an end sealing member against a developer bearing roller to be set to a suitable value, and an image forming apparatus and an image forming system provided with such a developing device.

An aspect of the present invention is a developing device for developing a latent image borne on an image bearing body using a developer borne on a developer bearing roller, comprising: a housing that is for containing the developer and that has an opening; the developer bearing roller that is for bearing the developer and that is provided facing the opening; a sealing member that abuts against the developer bearing roller to prevent the developer from spilling; a supporting member that is attached to the housing and that is for supporting the developer bearing roller and the sealing member; and an urging member that is for urging the sealing member toward the developer bearing roller and that is provided between the supporting member and a surface of the sealing member on an opposite side from an abutting surface of the sealing member with which the sealing member abuts against the developer bearing roller.

Another aspect of the present invention is a developing device for developing a latent image borne on an image bearing body using a developer borne on a developer bearing roller, the developing device comprising: a housing that is for containing the developer and that has an opening; the developer bearing roller that is for bearing the developer and that is provided facing the opening; a layer-thickness restricting member that abuts against the developer bearing roller along an axial direction thereof to restrict a thickness of a layer of the developer; a first sealing member that abuts against the developer bearing roller along the axial direction thereof to prevent the developer from spilling; a second sealing member that abuts against an end, in the axial direction, of the developer bearing roller along a circumferential direction of the developer bearing roller to prevent the developer from spilling; and an assembly member onto which the developer bearing roller, the layer-thickness restricting member, the first sealing member, and the second sealing member are assembled, wherein a unit provided with the developer bearing roller, the layer-thickness restricting member, the first sealing member, the second sealing member, and the assembly member onto which these members have been assembled, is attached to the housing.

Another aspect of the present invention is a developing device for developing a latent image borne on an image bearing body using a developer borne on a developer bearing roller, the developing device comprising: a housing that is for containing the developer and that has an opening; the developer bearing roller that is for bearing the developer and that is provided facing the opening; and a sealing member for preventing the developer from spilling from the housing, wherein the sealing member is supported on a side of one end in a lateral direction thereof by the developing device in a bent state, wherein the sealing member abuts against the developer bearing roller on a side of an other end in the lateral direction thereof, and wherein a flexural rigidity of the sealing member on the side of one end in the lateral direction thereof is larger than a flexural rigidity of the sealing member on the side of the other end in the lateral direction thereof.

Another aspect of the present invention is a developing device comprising: a housing that is for containing a developer and that has an opening; a developer bearing roller that is for bearing the developer and that is provided facing the opening; and an end sealing member that is provided between the housing and the developer bearing roller and that is for preventing the developer from spilling from an end of the developer bearing roller, wherein a section of the housing that is in opposition to the end sealing member is provided with a cut-out section.

Other features of the present invention will be made clear through the accompanying drawings and the following description.

DETAILED DESCRIPTION OF THE INVENTION

Figure 1:
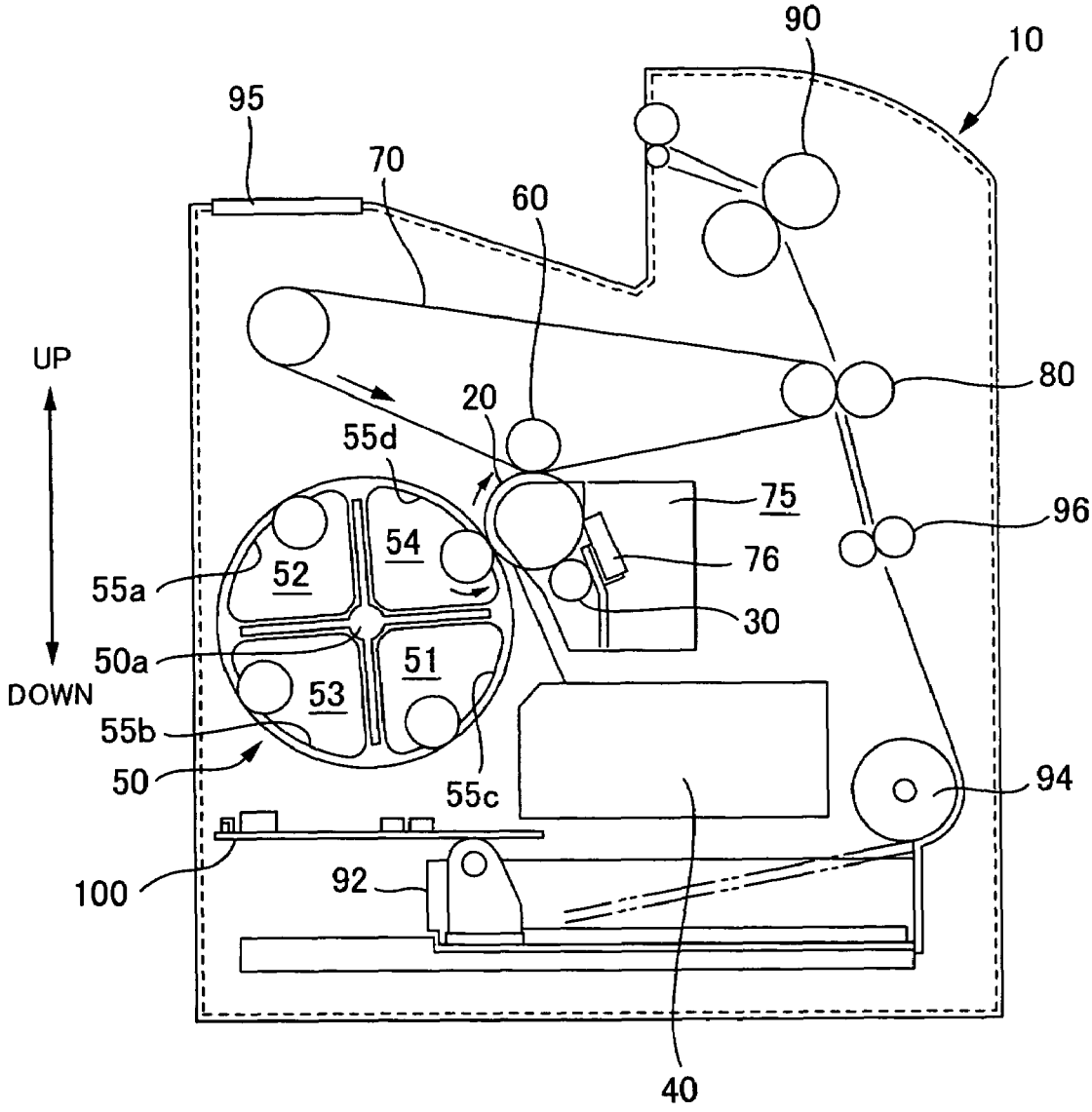
FIG. 1 is a diagram showing main structural components constructing a printer 10.

At least the following matters will become clear by the explanation in the present specification and the description of the accompanying drawings.

(1) An aspect of the present invention is a developing device for developing a latent image borne on an image bearing body using a developer borne on a developer bearing roller, comprising: a housing that is for containing the developer and that has an opening; the developer bearing roller that is for bearing the developer and that is provided facing the opening; a sealing member that abuts against the developer bearing roller to prevent the developer from spilling; a supporting member that is attached to the housing and that is for supporting the developer bearing roller and the sealing member; and an urging member that is for urging the sealing member toward the developer bearing roller and that is provided between the supporting member and a surface of the sealing member on an opposite side from an abutting surface of the sealing member with which the sealing member abuts against the developer bearing roller.

With this developing device, it becomes possible to appropriately make the abutting pressure of the sealing member against the developer bearing roller even.

Further, the sealing member may be arranged such that a longitudinal direction thereof is in an axial direction of the developer bearing roller.

In this case, it becomes possible to appropriately make the abutting pressure of the sealing member, which is arranged such that its longitudinal direction is in an axial direction of the developer bearing roller, against the developer bearing roller even.

Further, the sealing member may allow the developer remaining on the developer bearing roller to move into the housing, and also restrict the developer in the housing from moving outside from the housing.

In this case, it becomes possible to appropriately make the abutting pressure of the sealing member, which has the above two functions, against the developer bearing roller even.

Further, the supporting member may have a first supporting section arranged in the axial direction of the developer bearing roller, and a second supporting section that intersects with the axial direction and that is provided outside the first supporting section in the axial direction; and the sealing member may be supported, at an end in a lateral direction thereof, by the first supporting section, and the developer bearing roller may be supported, at an end in the axial direction thereof, by the second supporting section.

Since the sealing member and the developer bearing roller are appropriately supported according to this way of support, the developer bearing roller and the sealing member are positioned with high precision with respect to the supporting member, and therefore, the relative position of the urging member with respect to the developer bearing roller, the sealing member, and the supporting member is appropriately set. Therefore, it becomes possible to make the abutting pressure of the sealing member against the developer bearing roller more appropriately even.

Further, the urging member may be fixed to the first supporting section.

In this case, the relative position of the urging member with respect to the developer bearing roller, the sealing member, and the supporting member is set more appropriately, and therefore, it becomes possible to make the abutting pressure of the sealing member against the developer bearing roller more appropriately even.

Further, the urging member may be arranged such that a longitudinal direction thereof is in the axial direction of the developer bearing roller.

In this case, it becomes possible to make the abutting pressure of the sealing member against the developer bearing roller more appropriately even.

Further, the urging member may be elastic, and may be provided in a compressed state between the supporting member and the surface of the sealing member on the opposite side from the abutting surface.

In this case, it becomes possible to urge the sealing member toward the developer bearing roller more appropriately.

Further, the supporting member may be made of metal, and the housing may be made of resin.

Members made of resin are prone to deformation due to heat and/or deformation due to applied pressure, compared to members made of metal. Therefore, an urging member that is provided between the sealing member and the metal supporting member, and not between the sealing member and the resin housing, is less prone to the influence of being deformed through heat and/or pressure. Accordingly, it becomes possible to make the abutting pressure of the sealing member against the developer bearing roller more appropriately even.

Further, the supporting member may be attached to the housing via another sealing member which is different from the sealing member.

In this case, it is possible to appropriately prevent the developer from spilling from between the supporting member and the housing.

Further, the urging member may be arranged such that a longitudinal direction thereof is in the axial direction of the developer bearing roller; and a width, in a lateral direction of the urging member, of an end of the urging member in the longitudinal direction may be larger than a width, in the lateral direction of the urging member, of a central section of the urging member in the longitudinal direction.

In this case, both developer deterioration and developer spill are appropriately prevented.

Further, the developer bearing roller may have an opposing region that is in opposition to a latent-image bearable region on the image bearing body; and a width in the lateral direction of the urging member at any position within a region of the urging member corresponding to the opposing region may be smaller than the width, in the lateral direction of the urging member, of the end in the longitudinal direction.

In this case, deterioration in image quality due to developer deterioration can be reliably prevented.

Further, the developer bearing roller may have a developer-bearable region on which the developer can be borne; and a width in the lateral direction of the urging member at any position within a region of the urging member corresponding to the developer-bearable region may be smaller than the width, in the lateral direction of the urging member, of the end in the longitudinal direction.

In this case, developer deterioration can be reliably prevented.

It is also possible to achieve a developing device for developing a latent image borne on an image bearing body using a developer borne on a developer bearing roller, the developing device comprising: a housing that is for containing the developer and that has an opening; the developer bearing roller that is for bearing the developer and that is provided facing the opening; a sealing member that abuts against the developer bearing roller to prevent the developer from spilling; a supporting member that is attached to the housing and that is for supporting the developer bearing roller and the sealing member; and an urging member that is for urging the sealing member toward the developer bearing roller and that is provided between the supporting member and a surface of the sealing member on an opposite side from an abutting surface of the sealing member with which the sealing member abuts against the developer bearing roller; wherein the sealing member is arranged such that a longitudinal direction thereof is in an axial direction of the developer bearing roller; wherein the sealing member allows the developer remaining on the developer bearing roller to move into the housing, and also restricts the developer in the housing from moving outside from the housing; wherein the supporting member has a first supporting section arranged in the axial direction of the developer bearing roller, and a second supporting section that intersects with the axial direction and that is provided outside the first supporting section in the axial direction; wherein the sealing member is supported, at an end in a lateral direction thereof, by the first supporting section, and the developer bearing roller is supported, at an end in the axial direction thereof, by the second supporting section; wherein the urging member is fixed to the first supporting section; wherein the urging member is arranged such that a longitudinal direction thereof is in the axial direction of the developer bearing roller; wherein the urging member is elastic, and is provided in a compressed state between-the supporting member and the surface of the sealing member on the opposite side from the abutting surface; wherein the supporting member is made of metal, and the housing is made of resin; and wherein the supporting member is attached to the housing via another sealing member which is different from the sealing member.

In this way, the object of the present invention is achieved more advantageously because almost all of the effects described above can be obtained.

It is also possible to achieve an image forming apparatus comprising: an image bearing body for bearing a latent image; and a developing device for developing the latent image borne on the image bearing body using a developer borne on a developer bearing roller, the developing device including: a housing that is for containing the developer and that has an opening; the developer bearing roller that is for bearing the developer and that is provided facing the opening; a sealing member that abuts against the developer bearing roller to prevent the developer from spilling; a supporting member that is attached to the housing and that is for supporting the developer bearing roller and the sealing member; and an urging member that is for urging the sealing member toward the developer bearing roller and that is provided between the supporting member and a surface of the sealing member on an opposite side from an abutting surface of the sealing member with which the sealing member abuts against the developer bearing roller.

With this image forming apparatus, it becomes possible to appropriately make the abutting pressure of the sealing member against the developer bearing roller even.

It is also possible to achieve an image forming system comprising: a computer; and an image forming apparatus that is connectable to the computer and that is provided with: an image bearing body for bearing a latent image; and a developing device for developing the latent image borne on the image bearing body using a developer borne on a developer bearing roller, the developing device including: a housing that is for containing the developer and that has an opening; the developer bearing roller that is for bearing the developer and that is provided facing the opening; a sealing member that abuts against the developer bearing roller to prevent the developer from spilling; a supporting member that is attached to the housing and that is for supporting the developer bearing roller and the sealing member; and an urging member that is for urging the sealing member toward the developer bearing roller and that is provided between the supporting member and a surface of the sealing member on an opposite side from an abutting surface of the sealing member with which the sealing member abuts against the developer bearing roller.

With this image forming system, it becomes possible to appropriately make the abutting pressure of the sealing member against the developer bearing roller even.

(2) Another aspect of the present invention is a developing device for developing a latent image borne on an image bearing body using a developer borne on a developer bearing roller, the developing device comprising: a housing that is for containing the developer and that has an opening; the developer bearing roller that is for bearing the developer and that is provided facing the opening; a layer-thickness restricting member that abuts against the developer bearing roller along an axial direction thereof to restrict a thickness of a layer of the developer; a first sealing member that abuts against the developer bearing roller along the axial direction thereof to prevent the developer from spilling; a second sealing member that abuts against an end, in the axial direction, of the developer bearing roller along a circumferential direction of the developer bearing roller to prevent the developer from spilling; and an assembly member onto which the developer bearing roller, the layer-thickness restricting member, the first sealing member, and the second sealing member are assembled, wherein a unit provided with the developer bearing roller, the layer-thickness restricting member, the first sealing member, the second sealing member, and the assembly member onto which these members have been assembled, is attached to the housing.

In this way, it becomes possible to achieve a developing device that can be easily assembled.

Further, the unit may be attached to the housing via a third sealing member for preventing the developer from spilling from between the unit and the housing.

In this case, it becomes possible to prevent the developer from spilling from the housing more reliably.

Further, the developing device may comprise an urging member that is arranged such that a longitudinal direction thereof is in the axial direction of the developer bearing roller and that is for urging the first sealing member toward the developer bearing roller; and a unit provided with the developer bearing roller, the layer-thickness restricting member, the first sealing member, the second sealing member, the urging member, and the assembly member onto which these members have been assembled, may be attached to the housing.

In order for the urging member to appropriately achieve the function described above, it is necessary to set the relative position of the urging member with respect to the developer bearing roller and the first sealing member to an appropriate position with high precision. Therefore, it becomes even more burdensome to assemble a developing device that includes a developer bearing roller, a layer-thickness restricting member, a first sealing member, a second sealing member, and also the above-described urging member, and in which these members are attached either directly, or via a supporting member corresponding to each of those members, to a housing. Therefore, the present invention becomes even more important in developing devices provided with urging members. The object of the present invention is therefore achieved more effectively.

Further, the layer-thickness restricting member may abut against the developer bearing roller along the axial direction thereof to prevent the developer from spilling.

In a case where the layer-thickness restricting member has the above-described function in addition to the function of restricting the layer thickness, then it is necessary to set the relative position of the layer-thickness restricting member with respect to the developer bearing roller to an appropriate position with an even higher precision. Therefore, it becomes even more burdensome to assemble a developing device that includes a developer bearing roller, a layer-thickness restricting member, a first sealing member, and a second sealing member, and in which these members are attached either directly, or via a supporting member corresponding to each of those members, to a housing. Therefore, the present invention becomes even more important in cases where the layer-thickness restricting member has the function of preventing the developer from spilling. The object of the present invention is therefore achieved more effectively.

Further, the assembly member may include a first supporting section and a second supporting section that are arranged in a longitudinal direction of the assembly member, and a third supporting section that intersects with the longitudinal direction and that is provided outside the first supporting section and the second supporting section in the longitudinal direction; the developer bearing roller may be supported at the end in the axial direction thereof by the third supporting section; the first sealing member may be supported at an end in a lateral direction thereof by the first supporting section; the layer-thickness restricting member may be supported at an end in a lateral direction thereof by the second supporting section; the layer-thickness restricting member may support the second sealing member at an-end in a longitudinal direction thereof; and the urging member may be supported by the first supporting section, and may be provided between the first supporting section and a surface of the first sealing member on an opposite side from an abutting surface of the first sealing member with which the first sealing member abuts against the developer bearing roller.

In this case, it becomes possible to obtain a unit in which the developer bearing roller, the layer-thickness restricting member, the first sealing member, the second sealing member, and the urging member are reliably supported, and in which the relative positions of the layer-thickness restricting member, the first sealing member, the second sealing member, and the urging member with respect to the developer bearing roller are set to an appropriate position with an even higher precision.

Further, the developing device may have only one third sealing member for preventing the developer from spilling from between the unit and the housing.

In this case, the assembly of the developing device becomes even easier.

Further, the third sealing member may abut against the first supporting section and the housing to prevent the developer from spilling from between the first supporting section and the housing, abut against the layer-thickness restricting member and the housing to prevent the developer from spilling from between the layer-thickness restricting member and the housing, and abut against the second sealing member and the housing to prevent the developer from spilling from between the second sealing member and the housing.

In this case, the function of the third sealing member of preventing the developer from spilling is improved even further.

Further, the unit may be recycled or reused.

In this case, the unit itself can be recycled or reused as it is, in a state where the developer bearing roller, the layer-thickness restricting member, the first sealing member, and the second sealing member are assembled to the assembly member.

Further, of the unit and the housing, the third sealing member may be fixed only to the housing.

In this case, the unit can be recycled or reused efficiently.

Further, the first sealing member may allow the developer remaining on the developer bearing roller to move into the housing, and also may restrict the developer in the housing from moving outside from the housing.

In a case where the first sealing member has the above two functions, it is necessary to set the relative position of the first sealing member with respect to the developer bearing roller to an appropriate position with an even higher precision. Therefore, it becomes even more burdensome to assemble a developing device that includes a developer bearing roller, a layer-thickness restricting member, a first sealing member, and a second sealing member, and in which these members are attached either directly, or via a supporting member corresponding to each of those members, to a housing. Therefore, the present invention becomes even more important in cases where the first sealing member has the above two functions. The object of the present invention is therefore achieved more effectively.

Further, the assembly member may be made of metal.

In this case, it is possible to obtain a unit in which the relative positions of the layer-thickness restricting member, the first sealing member, the second sealing member, etc., with respect to the developer bearing roller are set to an appropriate position with an even higher precision.

It is also possible to achieve a developing device for developing a latent image borne on an image bearing body using a developer borne on a developer bearing roller, the developing device comprising: a housing that is for containing the developer and that has an opening; the developer bearing roller that is for bearing the developer and that is provided facing the opening; a layer-thickness restricting member that abuts against the developer bearing roller along an axial direction thereof to restrict a thickness of a layer of the developer; a first sealing member that abuts against the developer bearing roller along the axial direction thereof to prevent the developer from spilling; a second sealing member that abuts against an end, in the axial direction, of the developer bearing roller along a circumferential direction of the developer bearing roller to prevent the developer from spilling; and an assembly member onto which the developer bearing roller, the layer-thickness restricting member, the first sealing member, and the second sealing member are assembled; wherein a unit provided with the developer bearing roller, the layer-thickness restricting member, the first sealing member, the second sealing member, and the assembly member onto which these members have been assembled, is attached to the housing; wherein the unit is attached to the housing via a third sealing member for preventing the developer from spilling from between the unit and the housing; wherein the developing device comprises an urging member that is arranged such that a longitudinal direction thereof is in the axial direction of the developer bearing roller and that is for urging the first sealing member toward the developer bearing roller; wherein a unit provided with the developer bearing roller, the layer-thickness restricting member, the first sealing member, the second sealing member, the urging member, and the assembly member onto which these members have been assembled, is attached to the housing; wherein the layer-thickness restricting member abuts against the developer bearing roller along the axial direction thereof to prevent the developer from spilling; wherein the assembly member includes a first supporting section and a second supporting section that are arranged in a longitudinal direction of the assembly member, and a third supporting section that intersects with the longitudinal direction and that is provided outside the first supporting section and the second supporting section in the longitudinal direction; wherein the developer bearing roller is supported at the end in the axial direction thereof by the third supporting section; wherein the first sealing member is supported at an end in a lateral direction thereof by the first supporting section; wherein the layer-thickness restricting member is supported at an end in a lateral direction thereof by the second supporting section; wherein the layer-thickness restricting member supports the second sealing member at an end in a longitudinal direction thereof; wherein the urging member is supported by the first supporting section, and is provided between the first supporting section and a surface of the first sealing member on an opposite side from an abutting surface of the first sealing member with which the first sealing member abuts against the developer bearing roller; wherein the developing device has only one third sealing member for preventing the developer from spilling from between the unit and the housing; wherein the third sealing member abuts against the first supporting section and the housing to prevent the developer from spilling from between the first supporting section and the housing, abuts against the layer-thickness restricting member and the housing to prevent the developer from spilling from between the layer-thickness restricting member and the housing, and abuts against the second sealing member and the housing to prevent the developer from spilling from between the second sealing member and the housing; wherein the unit is recycled or reused; wherein, of the unit and the housing, the third sealing member is fixed only to the housing; wherein the first sealing member allows the developer remaining on the developer bearing roller to move into the housing, and also restricts the developer in the housing from moving outside from the housing; and wherein the assembly member is made of metal.

In this way, the object of the present invention is achieved more advantageously because almost all of the effects described above can be obtained.

It is also possible to achieve an image forming apparatus comprising: an image bearing body for bearing a latent image; and a developing device for developing the latent image borne on the image bearing body using a developer borne on a developer bearing roller, the developing device including: a housing that is for containing the developer and that has an opening; the developer bearing roller that is for bearing the developer and that is provided facing the opening; a layer-thickness restricting member that abuts against the developer bearing roller along an axial direction thereof to restrict a thickness of a layer of the developer; a first sealing member that abuts against the developer bearing roller along the axial direction thereof to prevent the developer from spilling; a second sealing member that abuts against an end, in the axial direction, of the developer bearing roller along a circumferential direction of the developer bearing roller to prevent the developer from spilling; and an assembly member onto which the developer bearing roller, the layer-thickness restricting member, the first sealing member, and the second sealing member are assembled, wherein a unit provided with the developer bearing roller, the layer-thickness restricting member, the first sealing member, the second sealing member, and the assembly member onto which these members have been assembled, is attached to the housing.

In this way, it is possible to achieve an image forming apparatus that can be easily assembled.

It is also possible to achieve an image forming system comprising: a computer; and an image forming apparatus that is connectable to the computer and that is provided with: an image bearing body for bearing a latent image; and a developing device for developing the latent image borne on the image bearing body using a developer borne on a developer bearing roller, the developing device including: a housing that is for containing the developer and that has an opening; the developer bearing roller that is for bearing the developer and that is provided facing the opening; a layer-thickness restricting member that abuts against the developer bearing roller along an axial direction thereof to restrict a thickness of a layer of the developer; a first sealing member that abuts against the developer bearing roller along the axial direction thereof to prevent the developer from spilling; a second sealing member that abuts against an end, in the axial direction, of the developer bearing roller along a circumferential direction of the developer bearing roller to prevent the developer from spilling; and an assembly member onto which the developer bearing roller, the layer-thickness restricting member, the first sealing member, and the second sealing member are assembled, wherein a unit provided with the developer bearing roller, the layer-thickness restricting member, the first sealing member, the second sealing member, and the assembly member onto which these members have been assembled, is attached to the housing.

In this way, it is possible to achieve an image forming system that can be easily assembled.

It is also possible to achieve a method of manufacturing a developing device for developing a latent image borne on an image bearing body using a developer borne on a developer bearing roller, the method comprising the steps of: preparing a housing that is for containing the developer and that has an opening; preparing the developer bearing roller that is for bearing the developer and that is provided facing the opening; preparing a layer-thickness restricting member that abuts against the developer bearing roller along an axial direction thereof to restrict a thickness of a layer of the developer; preparing a first sealing member that abuts against the developer bearing roller along the axial direction thereof to prevent the developer from spilling; preparing a second sealing member that abuts against an end, in the axial direction, of the developer bearing roller along a circumferential direction of the developer bearing roller to prevent the developer from spilling; assembling the developer bearing roller, the layer-thickness restricting member, the first sealing member, and the second sealing member onto an assembly member; and attaching, to the housing, a unit provided with the developer bearing roller, the layer-thickness restricting member, the first sealing member, the second sealing member, and the assembly member onto which these members have been assembled.

According to this method of manufacturing a developing device, it becomes possible to assemble a developing device easily.

(3) Another aspect of the present invention is a developing device for developing a latent image borne on an image bearing body using a developer borne on a developer bearing roller, the developing device comprising: a housing that is for containing the developer and that has an opening; the developer bearing roller that is for bearing the developer and that is provided facing the opening; and a sealing member for preventing the developer from spilling from the housing, wherein the sealing member is supported on a side of one end in a lateral direction thereof by the developing device in a bent state, wherein the sealing member abuts against the developer bearing roller on a side of an other end in the lateral direction thereof, and wherein a flexural rigidity of the sealing member on the side of one end in the lateral direction thereof is larger than a flexural rigidity of the sealing member on the side of the other end in the lateral direction thereof.

With this developing device, it becomes possible to make the sealing member abut against the developer bearing roller appropriately.

Further, the sealing member may be arranged such that a longitudinal direction thereof is in an axial direction of the developer bearing roller.

In this case, it becomes possible to make a sealing member, which is arranged such that its longitudinal direction is in an axial direction of the developer bearing roller, abut against the developer bearing roller appropriately.

Further, the sealing member may allow the developer remaining on the developer bearing roller to move into the housing, and also may restrict the developer in the housing from moving outside from the housing.

In this case, it becomes possible to make a sealing member, which has the above two functions, abut against the developer bearing roller appropriately.

Further, the lateral direction of the sealing member at a supported section of the sealing member that is supported by the developing device may be arranged in a direction from an abutting section of the sealing member where the sealing member abuts against the developer bearing roller toward a central axis of the developer bearing roller.

Further, the supported section may be positioned on an opposite side from the developer bearing roller as viewed from a virtual tangential line drawn with respect to the developer bearing roller at an abutting position on the developer bearing roller where the abutting section abuts against the developer bearing roller.

In these cases, the function of the sealing member of preventing the developer from spilling is achieved more suitably.

Further, the developing device may comprise a supporting member that is attached to the housing and that is for supporting the sealing member; and the sealing member may be supported on the side of one end in the lateral direction thereof by the supporting member.

In this case, since the sealing member is supported by a supporting member that is specialized for supporting a sealing member, the sealing member can be supported reliably, and thus, it becomes possible to make the sealing member abut against the developer bearing roller more appropriately.

Further, the developing device may comprise an urging member that is arranged such that a longitudinal direction thereof is in an axial direction of the developer bearing roller and that is for urging the sealing member toward the developer bearing roller; the supporting member may have a first supporting section whose lateral direction is arranged in the direction from the abutting section of the sealing member toward the central axis of the developer bearing roller, and a second supporting section whose lateral direction intersects with the direction from the abutting section of the sealing member toward the central axis of the developer bearing roller; the sealing member may be supported on the side of one end in the lateral direction thereof by the first supporting section; and the urging member may be provided between the sealing member and the second supporting section and is supported by the second supporting section.

In this case, it becomes possible to make the sealing member abut against the developer bearing roller more appropriately.

Further, a thickness of the sealing member on the side of one end in the lateral direction thereof may be larger than a thickness of the sealing member on the side of the other end in the lateral direction thereof.

In this case, it is possible to make the flexural rigidity of the sealing member on the side of one end in the lateral direction thereof larger than the flexural rigidity of the sealing member on the side of the other end in the lateral direction thereof in a simple way.

Further, of among the side of one end in the lateral direction of the sealing member and the side of the other end in the lateral direction thereof, the sealing member may have a rigidity-strengthening member for increasing the flexural rigidity of the sealing member provided only on the side of one end in the lateral direction thereof.

In this case, it is possible to make the flexural rigidity of the sealing member on the side of one end in the lateral direction thereof larger than the flexural rigidity of the sealing member on the side of the other end in the lateral direction thereof in a simple way.

Further, the sealing member may be made by attaching together a sheet material made of polyethylene and a PET film as the rigidity-strengthening member.

In this case, it is possible to make the flexural rigidity of the sealing member on the side of one end in the lateral direction thereof larger than the flexural rigidity of the sealing member on the side of the other end in the lateral direction thereof in a simple way.

It is also possible to achieve a developing device for developing a latent image borne on an image bearing body using a developer borne on a developer bearing roller, the developing device comprising: a housing that is for containing the developer and that has an opening; the developer bearing roller that is for bearing the developer and that is provided facing the opening; and a sealing member for preventing the developer from spilling from the housing, wherein the sealing member is supported on a side of one end in a lateral direction thereof by the developing device in a bent state, and wherein the sealing member abuts against the developer bearing roller on a side of an other end in the lateral direction thereof; wherein a flexural rigidity of the sealing member on the side of one end in the lateral direction thereof is larger than a flexural rigidity of the sealing member on the side of the other end in the lateral direction thereof; wherein the sealing member is arranged such that a longitudinal direction thereof is in an axial direction of the developer bearing roller; wherein the sealing member allows the developer remaining on the developer bearing roller to move into the housing, and also restricts the developer in the housing from moving outside from the housing; wherein the lateral direction of the sealing member at a supported section of the sealing member that is supported by the developing device is arranged in a direction from an abutting section of the sealing member where the sealing member abuts against the developer bearing roller toward a central axis of the developer bearing roller; wherein the supported section is positioned on an opposite side from the developer bearing roller as viewed from a virtual tangential line drawn with respect to the developer bearing roller at an abutting position on the developer bearing roller where the abutting section abuts against the developer bearing roller; wherein the developing device comprises a supporting member that is attached to the housing and that is for supporting the sealing member; wherein the sealing member is supported on the side of one end in the lateral direction thereof by the supporting member; wherein the developing device comprises an urging member that is arranged such that a longitudinal direction thereof is in the axial direction of the developer bearing roller and that is for urging the sealing member toward the developer bearing roller; wherein the supporting member has a first supporting section whose lateral direction is arranged in the direction from the abutting section of the sealing member toward the central axis of the developer bearing roller, and a second supporting section whose lateral direction intersects with the direction from the abutting section of the sealing member toward the central axis of the developer bearing roller; wherein the sealing member is supported on the side of one end in the lateral direction thereof by the first supporting section; wherein the urging member is provided between the sealing member and the second supporting section and is supported by the second supporting section; wherein a thickness of the sealing member on the side of one end in the lateral direction thereof is larger than a thickness of the sealing member on the side of the other end in the lateral direction thereof; wherein, of among the side of one end in the lateral direction of the sealing member and the side of the other end in the lateral direction thereof, the sealing member has a rigidity-strengthening member for increasing the flexural rigidity of the sealing member provided only on the side of one end in the lateral direction thereof; and wherein the sealing member is made by attaching together a sheet material made of polyethylene and a PET film as the rigidity-strengthening member.

In this way, the object of the present invention is achieved more advantageously because almost all of the effects described above can be obtained.

It is also possible to achieve an image forming apparatus comprising: an image bearing body for bearing a latent image; and a developing device for developing the latent image borne on the image bearing body using a developer borne on a developer bearing roller, the developing device including: a housing that is for containing the developer and that has an opening; the developer bearing roller that is for bearing the developer and that is provided facing the opening; and a sealing member for preventing the developer from spilling from the housing, wherein the sealing member is supported on a side of one end in a lateral direction thereof by the developing device in a bent state, wherein the sealing member abuts against the developer bearing roller on a side of an other end in the lateral direction thereof, and wherein a flexural rigidity of the sealing member on the side of one end in the lateral direction thereof is larger than a flexural rigidity of the sealing member on the side of the other end in the lateral direction thereof.

With this image forming apparatus, it becomes possible to make the sealing member abut against the developer bearing roller appropriately.

It is also possible to achieve an image forming system comprising: a computer; and an image forming apparatus that is connectable to the computer and that is provided with: an image bearing body for bearing a latent image; and a developing device for developing the latent image borne on the image bearing body using a developer borne on a developer bearing roller, the developing device including: a housing that is for containing the developer and that has an opening; the developer bearing roller that is for bearing the developer and that is provided facing the opening; and a sealing member for preventing the developer from spilling from the housing, wherein the sealing member is supported on a side of one end in a lateral direction thereof by the developing device in a bent state, wherein the sealing member abuts against the developer bearing roller on a side of an other end in the lateral direction thereof, and wherein a flexural rigidity of the sealing member on the side of one end in the lateral direction thereof is larger than a flexural rigidity of the sealing member on the side of the other end in the lateral direction thereof.

With this image forming system, it becomes possible to make the sealing member abut against the developer bearing roller appropriately.

(4) Another aspect of the present invention is a developing device comprising: a housing that is for containing a developer and that has an opening; a developer bearing roller that is for bearing the developer and that is provided facing the opening; and an end sealing member that is provided between the housing and the developer bearing roller and that is for preventing the developer from spilling from an end of the developer bearing roller, wherein a section of the housing that is in opposition to the end sealing member is provided with a cut-out section.

With this developing device, it becomes possible to set the abutting pressure of the end sealing member against the developer bearing roller to a suitable value because it is possible, for example, to prevent the amount of compression of the end sealing member from becoming excessively large.

Further, in this developing device, the cut-out section may be cut out in a rectangular shape.

Further, in this developing device, the cut-out section may be arranged such that a longitudinal direction thereof is in a circumferential direction of the developer bearing roller.

With this developing device, it becomes possible to set the abutting pressure of the end sealing member against the developer bearing roller to a suitable value over a large area in the circumferential direction of the developer bearing roller.

Further, in this developing device, the housing may have a contact surface that is in contact with the end sealing member and that is formed in the section which is in opposition to the end sealing member, and an intersecting surface that intersects with the contact surface and that is formed in the section which is in opposition to the end sealing member by cutting out the section; and an angle formed between the contact surface and the intersecting surface at a line of intersection between the contact surface and the intersecting surface may be smaller than 90°.

If the angle formed between the contact surface and the intersecting surface is set to be smaller than 90°, then the end sealing member is compressed more easily such that it digs into the section at the line of intersection between the contact surface and the intersecting surface, and therefore, it becomes possible to prevent the developer from spilling more reliably.

Further, the developing device may comprise a layer-thickness restricting member that abuts against the developer bearing roller along an axial direction thereof to restrict a thickness of a layer of the developer borne on the developer bearing roller, an axial-direction sealing member that abuts against the developer bearing roller along the axial direction thereof to prevent the developer from spilling, a circumferential-surface sealing member that abuts against an end, in the axial direction, of the developer bearing roller along a circumferential direction of the developer bearing roller, an assembly member onto which the developer bearing roller, the layer-thickness restricting member, the axial-direction sealing member, and the circumferential-surface sealing member are assembled, and a housing-sealing member that is for preventing the developer from spilling from between the housing and a unit provided with the developer bearing roller, the layer-thickness restricting member, the axial-direction sealing member, the circumferential-surface sealing member, and the assembly member onto which these members have been assembled; and the end sealing member may be made by placing the circumferential-surface sealing member and the housing-sealing member on top of the other.

From the standpoint of preventing the developer from spilling, it is more preferable to make the end sealing member by placing two members, namely, the circumferential-surface sealing member and the housing-sealing member, on top of the other. However, if the end sealing member is made by placing two members on top of the other, then there arises a possibility that the abutting pressure of the end sealing member against the developer bearing roller becomes larger than its suitable value because the thickness of the end sealing member becomes large. Therefore, in such a case, the effect of the present invention, that is, the effect of allowing the abutting pressure of the end sealing member against the developer bearing roller to be set to a suitable value, is achieved more advantageously.

Further, the housing-sealing member may be a rectangular member whose central portion has been cut out, and has two longitudinal-direction sealing sections and two lateral-direction sealing sections; and the end sealing member may be made by placing the circumferential-surface sealing member and the lateral-direction sealing sections on top of the other.

With this developing device, it becomes possible to set the abutting pressure of the circumferential-surface sealing member and the lateral-direction sealing sections against the developer bearing roller to a suitable value.

Further, in this developing device, the circumferential-surface sealing member may be supported on a side of one end in a longitudinal direction thereof by the layer-thickness restricting member; and the lateral-direction sealing section may be fixed to sections of the housing that are a part of a section that is in opposition to one of the lateral-direction sealing sections and that are provided on both sides of the cut-out section.

Further, in this developing device, the cut-out section may be provided over an entire length of the circumferential-surface sealing member in a lateral direction thereof; an outer end of the lateral-direction sealing section and an outer end of a large-diameter section of the developer bearing roller may be positioned more to the outside, in a longitudinal direction of the housing, than the cut-out section; and the lateral-direction sealing section may be compressed by the housing and the large-diameter section at a position outside of the cut-out section in the longitudinal direction of the housing.

With this developing device, it becomes possible to prevent the abutting pressure applied to the developer bearing roller at a position outside the cut-out section from becoming excessively large compared to the abutting pressure applied to the developer bearing roller at a position corresponding to the cut-out section.

Further, in this developing device, the developing device may comprise a developer supplying roller that abuts against the developer bearing roller and that supplies the developer contained in the housing to the developer bearing roller; the developer supplying roller may have a supplying-roller shaft section that is supported rotatably to the housing; and the cut-out section may be positioned between the supplying-roller shaft section and the large-diameter section.

In a case where the developer supplying roller and the developer bearing roller abut against one another, the sealing space tends to become narrow. In view of this, by providing a cut-out section between the supplying-roller shaft section and the large-diameter section, it becomes possible to arrange the end sealing member such that the abutting pressure of the end sealing member against the developer bearing roller is set to a suitable value, even when the sealing space is narrow.

It is also possible to achieve a developing device comprising: a housing that is for containing a developer and that has an opening; a developer bearing roller that is for bearing the developer and that is provided facing the opening; and an end sealing member that is provided between the housing and the developer bearing roller and that is for preventing the developer from spilling from an end of the developer bearing roller, wherein a section of the housing that is in opposition to the end sealing member is provided-with a cut-out section; wherein the cut-out section is cut out in a rectangular shape; wherein the cut-out section is arranged such that a longitudinal direction thereof is in a circumferential direction of the developer bearing roller; wherein the developing device comprises a layer-thickness restricting member that abuts against the developer bearing roller along an axial direction thereof to restrict a thickness of a layer of the developer borne on the developer bearing roller, an axial-direction sealing member that abuts against the developer bearing roller along the axial direction thereof to prevent the developer from spilling, a circumferential-surface sealing member that abuts against an end, in the axial direction, of the developer bearing roller along the circumferential direction of the developer bearing roller, an assembly member onto which the developer bearing roller, the layer-thickness restricting member, the axial-direction sealing member, and the circumferential-surface sealing member are assembled, and a housing-sealing member that is for preventing the developer from spilling from between the housing and a unit provided with the developer bearing roller, the layer-thickness restricting member, the axial-direction sealing member, the circumferential-surface sealing member, and the assembly member onto which these members have been assembled; wherein the end sealing member is made by placing the circumferential-surface sealing member and the housing-sealing member on top of the other; wherein the housing-sealing member is a rectangular member whose central portion has been cut out, and has two longitudinal-direction sealing sections and two lateral-direction sealing sections, and the end sealing member is made by placing the circumferential-surface sealing member and the lateral-direction sealing sections on top of the other; wherein the circumferential-surface sealing member is supported on a side of one end in a longitudinal direction thereof by the layer-thickness restricting member, and the lateral-direction sealing section is fixed to sections of the housing that are a part of a section that is in opposition to one-of the lateral-direction sealing sections and that are provided on both sides of the cut-out section; wherein the cut-out section is provided over an entire length of the circumferential-surface sealing member in a lateral direction thereof; wherein an outer end of the lateral-direction sealing section and an outer end of a large-diameter section of the developer bearing roller are positioned more to the outside, in a longitudinal direction of the housing, than the cut-out section; wherein the lateral-direction sealing section is compressed by the housing and the large-diameter section at a position outside of the cut-out section in the longitudinal direction of the housing; wherein the developing device comprises a developer supplying roller that abuts against the developer bearing roller and that supplies the developer contained in the housing to the developer bearing roller; wherein the developer supplying roller has a supplying-roller shaft section that is supported rotatably to the housing; and wherein the cut-out section is positioned between the supplying-roller shaft section and the large-diameter section.

With this developing device, the effect of allowing the abutting pressure of the end sealing member against the developer bearing roller to be set to a suitable value is achieved most advantageously.

It is also possible to achieve an image forming apparatus comprising: an image bearing body for bearing a latent image; and a developing device for developing the latent image borne on the image bearing body using a developer borne on a developer bearing roller, the developing device including: a housing that is for containing the developer and that has an opening; the developer bearing roller that is for bearing the developer and that is provided facing the opening; and an end sealing member that is provided between the housing and the developer bearing roller and that is for preventing the developer from spilling from an end of the developer bearing roller, wherein a section of the housing that is in opposition to the end sealing member is provided with a cut-out section.

With this image forming apparatus, the abutting pressure of the end sealing member against the developer bearing roller can be set to a suitable value, and therefore, it becomes possible to achieve an image forming apparatus that is superior to conventional apparatuses.

It is also possible to achieve an image forming system comprising: a computer; and an image forming apparatus that is connectable to the computer and that is provided with: an image bearing body for bearing a latent image; and a developing device for developing the latent image borne on the image bearing body using a developer borne on a developer bearing roller, the developing device including: a housing that is for containing the developer and that has an opening; the developer bearing roller that is for bearing the developer and that is provided facing the opening; and an end sealing member that is provided between the housing and the developer bearing roller and that is for preventing the developer from spilling from an end of the developer bearing roller, wherein a section of the housing that is in opposition to the end sealing member is provided with a cut-out section.

With this image forming system, the abutting pressure of the end sealing member against the developer bearing roller can be set to a suitable value, and therefore, it becomes possible to achieve an image forming system that is superior to conventional systems.

First through Third Embodiments

Overall Configuration Example of Image Forming Apparatus

Next, with reference to FIG. 1, an outline of an image forming apparatus will be described, taking a laser-beam printer 10 (hereinafter referred to also as "printer") as an example. FIG. 1 is a diagram showing main structural components constructing the printer 10. It should be noted that in FIG. 1, the vertical direction is shown by the arrow, and, for example, a paper supply tray 92 is arranged at a lower section of the printer 10, and a fusing unit 90 is arranged at an upper section of the printer 10.

As shown in FIG. 1, the printer 10 according to the present embodiment is provided with a charging unit 30, an exposing unit 40, a YMCK developing unit 50, a first transferring unit 60, an intermediate transferring body 70, and a cleaning unit 75. These components are arranged in the direction of rotation of a photoconductor 20, which serves as an example of an image bearing body. The printer 10 is further provided with a second transferring unit 80, a fusing unit 90, a displaying unit 95 constructed of a liquid-crystal panel and serving as means for making notifications to a user, and a control unit 100 for controlling these units etc. and managing the operations as a printer.

The photoconductor 20 has a cylindrical electrically-conductive base and a photoconductive layer formed on the outer peripheral surface of the electrically-conductive base, and it is rotatable about its central axis. In the present embodiment, the photoconductor 20 rotates clockwise, as shown by the arrow in FIG. 1.

The charging unit 30 is a device for electrically charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 in accordance with image signals having been input from a not-shown host computer such as a personal computer or a word processor.

The YMCK developing unit 50 is a device for developing the latent image formed on the photoconductor 20 using toner T, that is, black (K) toner contained in a black developing device 51, magenta (M) toner contained in a magenta developing device 52, cyan (C) toner contained in a cyan developing device 53, and yellow (Y) toner contained in a yellow developing device 54 (2054 in the second embodiment; 3054 in the third embodiment). The toner T is an example of developer contained in each of the developing devices.

The YMCK developing unit 50 can move the positions of the four developing devices 51, 52, 53, and 54 (2054, 3054) by rotating while the developing devices 51, 52, 53, and 54 (2054, 3054) are in an attached state. More specifically, the YMCK developing unit 50 holds the four developing devices 51, 52, 53, and 54 (2054, 3054) with four holding sections 55*a*, 55*b*, 55*c*, and 55*d*. The four developing devices 51, 52, 53, and 54 (2054, 3054) can be rotated about a rotation shaft 50*a* while maintaining their relative positions. Every time an image forming process for one page is finished, each of the developing devices selectively opposes the photoconductor 20 to successively develop the latent image formed on the photoconductor 20 using the toner T contained in each of the developing devices 51, 52, 53, and 54 (2054, 3054). It should be noted that each of the four developing devices 51, 52, 53, and 54 (2054, 3054) described above is attachable to and detachable from the respective holding sections of the YMCK developing unit 50. Further, details on the developing devices will be described further below.

The first transferring unit 60 is a device for transferring, onto the intermediate transferring body 70, a single-color toner image formed on the photoconductor 20. When the toners of all four colors are successively transferred in a superimposing manner, a full-color toner image will be formed on the intermediate transferring body 70.

The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20.

The second transferring unit 80 is a device for transferring the single-color toner image or the full-color toner image formed on the intermediate transferring body 70 onto a medium such as paper, film, and cloth.

The fusing unit 90 is a device for fusing the single-color toner image or the full-color toner image, which has been transferred onto the medium, to the medium to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner T remaining on the photoconductor 20 by scraping it off with the cleaning blade 76 after the toner image has been transferred onto the intermediate transferring body 70 by the first transferring unit 60.

Figure 2:
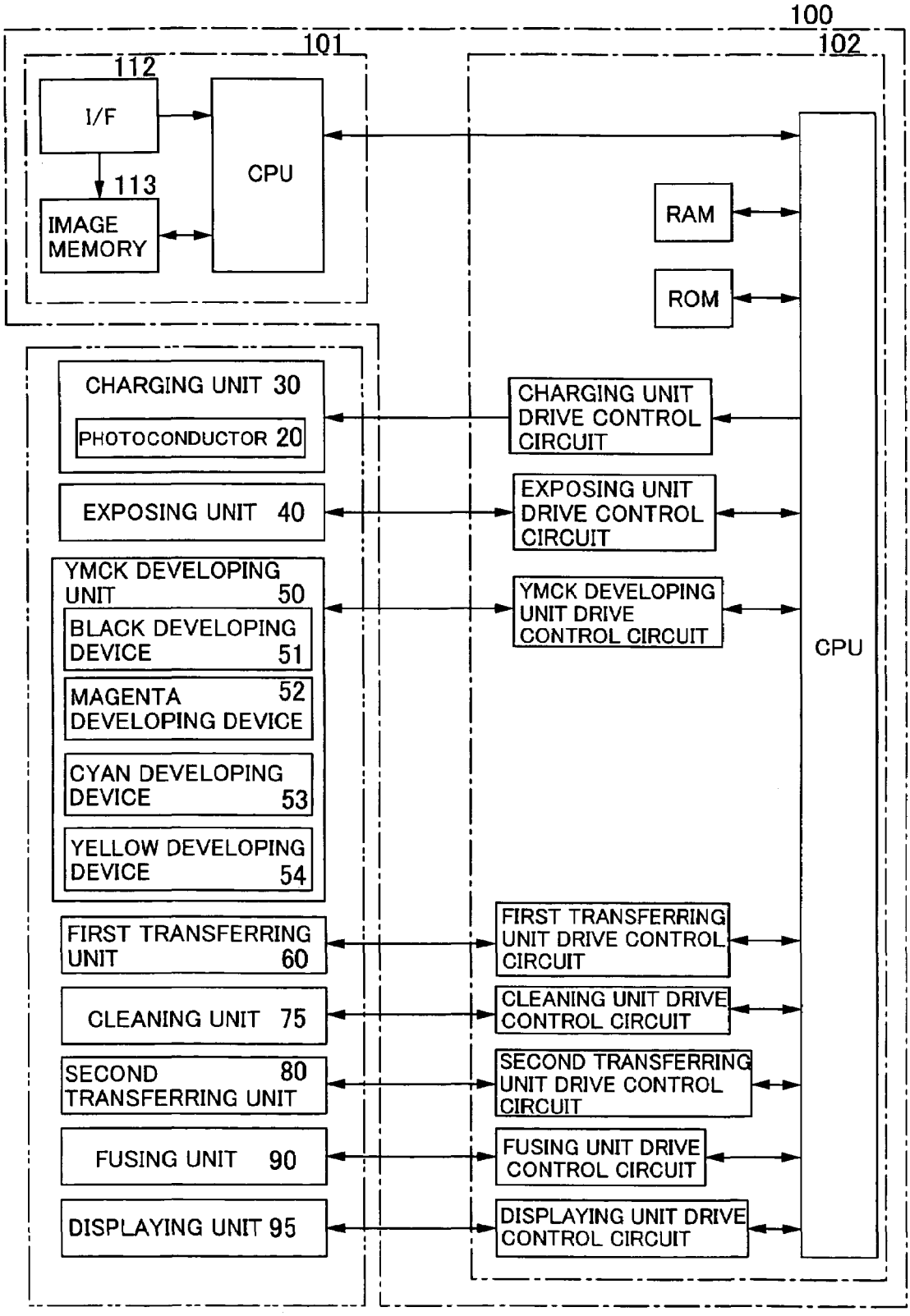
FIG. 2 is a block diagram showing a control unit of the printer 10 of FIG. 1.

The control unit 100 is provided with a main controller 101 and a unit controller 102 as shown in FIG. 2. Image signals and control signals are input to the main controller 101, and according to instructions based on the image signals and control signals, the unit controller 102 controls each of the above-mentioned units etc. to form an image.

Next, operations of the printer 10 structured as above will be described.

First, when image signals and control signals are input from the not-shown host computer to the main controller 101 of the printer 10 through an interface (I/F) 112, the photoconductor 20, a developing roller as an example of a developer bearing roller, and the intermediate transferring body 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing unit 50 positions the yellow developing device 54 (2054, 3054), which contains yellow (Y) toner, in the developing position, which is in opposition to the photoconductor 20.

With the rotation of the photoconductor 20, the latent image formed on the photoconductor 20 reaches the developing position, and is developed with the yellow toner by the yellow developing device 54 (2054, 3054). Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity to the polarity to which the toner T has been charged, is applied to the first transferring unit 60. It should be noted that, during this process, the photoconductor 20 and the intermediate transferring body 70 are placed in contact with each other, but the second transferring unit 80 is kept separated from the intermediate transferring body 70.

By subsequently performing the above-mentioned processes for the second, the third, and the fourth colors using each of the developing devices, toner images in four colors corresponding to the respective image signals are transferred onto the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium by the second transferring unit 80. It should be noted that the medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for electrical charging for forming the next latent image. The scraped-off toner T is collected in a remaining-toner collector of the cleaning unit 75.

Overview of Control Unit

Next, a configuration of the control unit 100 is described with reference to FIG. 2. The main controller 101 of the control unit 100 is connected to a host computer via the interface 112, and is provided with an image memory 113 for storing the image signals that have been input from the host computer. The unit controller 102 is electrically connected to the units in the body of the apparatus (i.e., the charging unit 30, the exposing unit 40, the YMCK developing unit 50, the first transferring unit 60, the cleaning unit 75, the second transferring unit 80, the fusing unit 90, and the displaying unit 95), and it detects the state of the units by receiving signals from sensors provided in those units, and controls them based on the signals that are input from the main controller 101.

Figure 3:
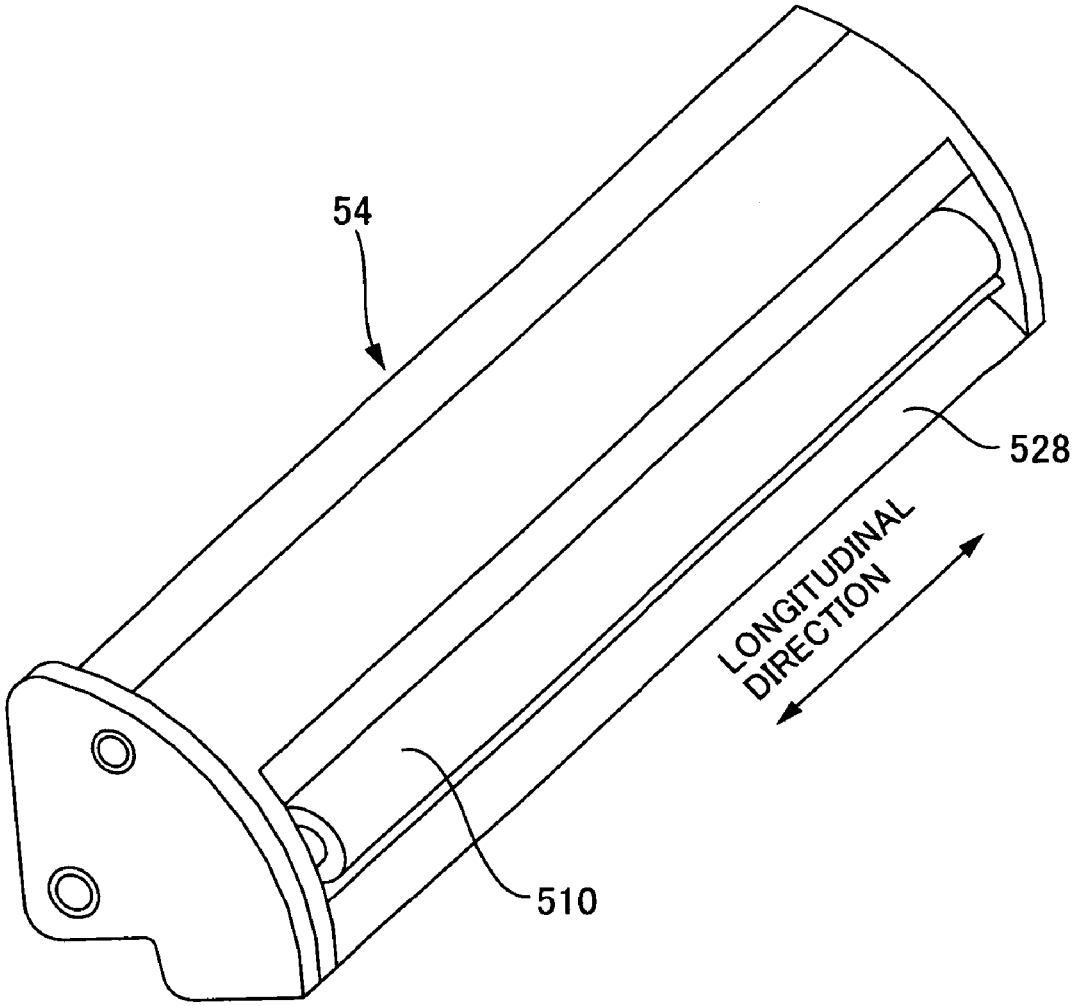
FIG. 3 is a conceptual diagram of a developing device according to a first embodiment.
Figure 4:
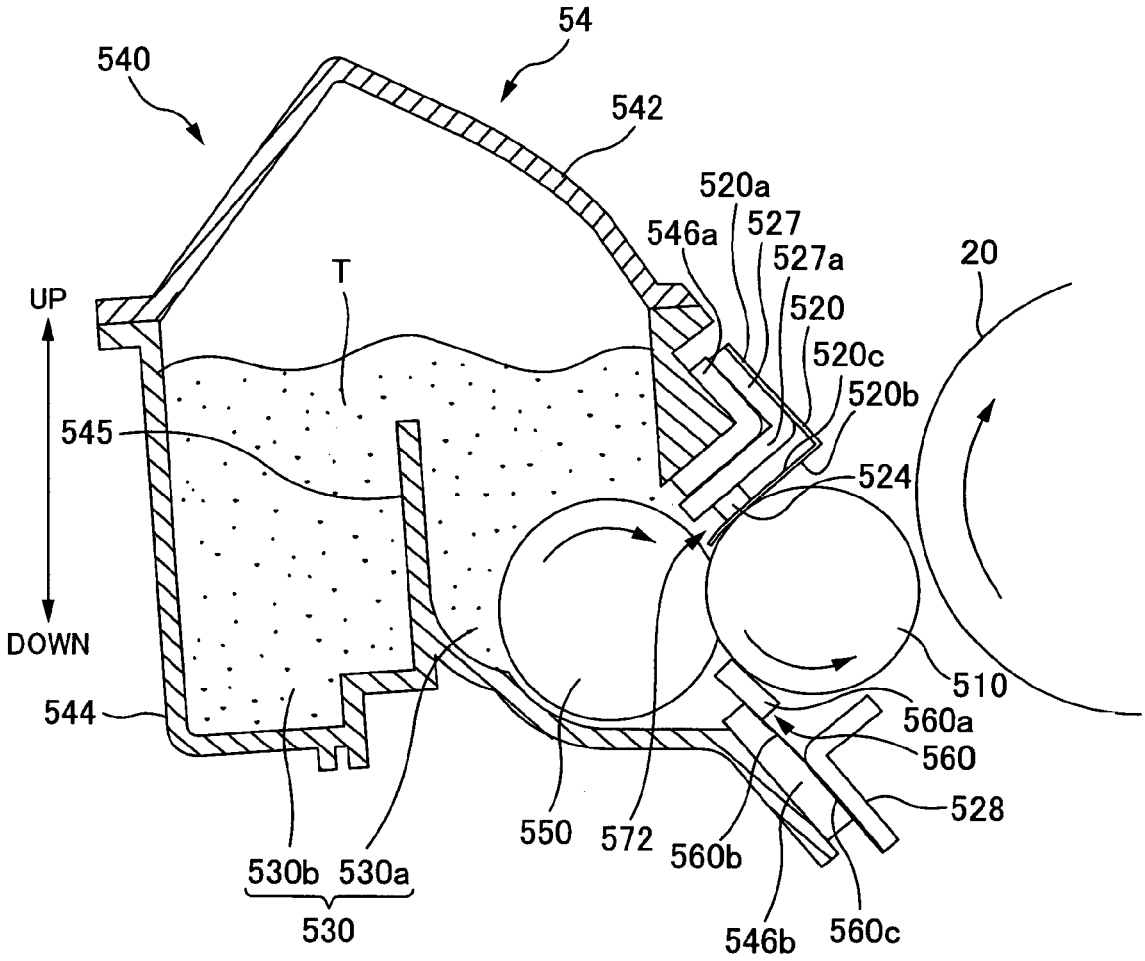
FIG. 4 is a section view showing main structural components of the developing device.

(1) Configuration Example of Developing Device According to the First Embodiment Next, with reference to FIG. 3 and FIG. 4, a first embodiment of a configuration of the developing device will be described. It should be noted that the configuration of the overall image forming apparatus and the configuration of the control unit are the same for both the present first embodiment, and the second and third embodiments described later on. FIG. 3 is a conceptual diagram of a developing device. FIG. 4 is a section view showing main structural components of the developing device. It should be noted that the section view shown in FIG. 4 is a section of the developing device bisected by a plane perpendicular to the longitudinal direction shown in FIG. 3. Further, in FIG. 4, the arrow indicates the vertical direction as in FIG. 1, and, for example, the central axis of the developing roller 510 is located below the central axis of the photoconductor 20. Further, in FIG. 4, the yellow developing device 54 is shown positioned at the developing position, which is in opposition to the photoconductor 20.

The YMCK developing unit 50 is provided with: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, description will be made only about the yellow developing device 54 below.

The yellow developing device 54 has, for example, the developing roller 510, an upper sealing member 520 serving as an example of a sealing member, a toner containing body 530, a housing 540, a toner supplying roller 550, and a restriction blade 560.

The developing roller 510 bears toner T and delivers it to the developing position opposing the photoconductor 20. The developing roller 510 is made of, for example, aluminum alloy such as aluminum alloy 5056 or aluminum alloy 6063, or iron alloy such as STKM, and where necessary, the roller 510 is plated with, for example, nickel plating or chromium plating.

The developing roller 510 has a shaft section 510*a* and a large-diameter section 510*b*. The shaft section 510*a* is supported, through bearings 576, by developing-roller supporting sections 529 of a holder 526 described further below (see FIG. 6), and in this way the developing roller 510 is supported rotatably. As shown in FIG. 4, the developing roller 510 rotates in the opposite direction (counterclockwise in FIG. 4) to the rotating direction of the photoconductor 20 (clockwise in FIG. 4). The central axis of the roller 510 is located below the central axis of the photoconductor 20.

Further, in the state where the yellow developing device 54 is in opposition to the photoconductor 20, there is a gap between the developing roller 510 and the photoconductor 20. That is, the yellow developing device 54 develops the latent image formed on the photoconductor 20 in a non-contacting state. It should be noted that an alternating field is generated between the developing roller 510 and the photoconductor 20 upon development of the latent image formed on the photoconductor 20.

The housing 540 is manufactured by welding together a plurality of integrally-molded housing sections made of resin, that is, an upper housing section 542 and a lower housing section 544. In the housing 540 is formed a toner containing body 530 for containing the toner T. The toner containing body 530 is divided into two toner containing sections, namely, the first toner containing section 530*a* and the second toner containing section 530*b*, by a partitioning wall 545 that is for partitioning the toner T and that protrudes inwards (in the up/down direction of FIG. 4) from the inner wall. The first toner containing section 530*a* and the second toner containing section 530*b* are connected at their upper sections, and in the state shown in FIG. 4, movement of the toner T is restricted by the partitioning wall 545. However, when the YMCK developing unit 50 is rotated, the toner contained in the first toner containing section 530*a* and the second toner containing section 530*b* is once gathered on the side of the section where the containing sections are connected, which is on the upper-section side when in the developing position, and when the YMCK developing unit 50 returns to the state shown in FIG. 4, the toner gets mixed and is returned to the first toner containing section 530*a* and the second toner containing section 530*b*. In other words, the toner T is appropriately stirred within the developing device by the rotation of the YMCK developing unit 50.

Therefore, in the present embodiment, no stirring member is provided in the toner containing body 530. However, it is possible to provide a stirring member for stirring the toner T contained in the toner containing body 530. Further, as shown in FIG. 4, the housing 540 (more specifically, the first toner containing section 530*a*) has an opening 572 in its lower section, and the developing roller 510 is provided facing the opening 572.

The toner supplying roller 550 is provided in the first toner containing section 530*a* described above and supplies the toner T contained in the first toner containing section 530*a* to the developing roller 510. It also strips off, from the developing roller 510, the toner T remaining on the developing roller 510 after development. The toner supplying roller 550 is made of, for example, polyurethane foam, and is made to abut against the developing roller 510 in an elastically deformed state. The toner supplying roller 550 is arranged at a lower section of the first toner containing section 530*a*. The toner T contained in the first toner containing section 530*a* is supplied to the developing roller 510 by the toner supplying roller 550 at the lower section of the first toner containing section 530*a*. The toner supplying roller 550 is rotatable about its central axis. The central axis of the toner supplying roller 550 is situated below the central axis of rotation of the developing roller 510. Further, the toner supplying roller 550 rotates in the opposite direction (clockwise in FIG. 4) to the rotating direction of the developing roller 510 (counterclockwise in FIG. 4).

The upper sealing member 520 abuts against the developing roller 510 along the axial direction thereof to allow the toner T remaining on the developing roller 510 after passing the developing position to move into the housing 540 and also to restrict the toner T in the housing 540 from moving outside therefrom. The configuration of the upper sealing member 520 and its periphery will be described in detail further below.

The restriction blade 560 abuts against the developing roller 510 along the axial direction thereof, and restricts the thickness of the layer of the toner T borne by the developing roller 510 as well as gives an electric charge to the toner T borne by the developing roller 510. The restriction blade 560 includes a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a spring-like characteristic.

The rubber section 560*a* is supported by the rubber-supporting section 560*b*. The rubber-supporting section 560*b* presses, with its urging force, the rubber section 560*a* against the developing roller 510. The rubber-supporting section 560*b* is attached to a restriction-blade supporting section 528 of the holder 526, which is described later, in a state where one end of the rubber-supporting section 560*b* is supported by the restriction-blade supporting section 528.

The end of the restricting blade 560 opposite from the end that is being supported by the restriction-blade supporting section 528, i.e., the tip end of the restriction blade 560, is not placed in contact with the developing roller 510; rather, a section at a predetermined distance away from the tip end contacts, with some breadth, the developing roller 510. That is, the restriction blade 560 does not abut against the developing roller 510 at its edge, but abuts against the roller 510 near its central portion. Further, the restriction blade 560 is arranged so that its tip end faces toward the upstream side of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550. It should be noted that the restriction blade 560 functions as to prevent the toner T from spilling from the toner containing body 530 by abutting against the developing roller 510 along its axial direction.

Further, the restriction blade 560 supports end seals 574 (see FIG. 5) at the ends 560*d* in its longitudinal direction. The end seals 574 are made of nonwoven fabric and abut against the ends, in the axial direction, of the developing roller 510 along the circumferential direction of the developing roller 510, so as to function as to prevent the toner T from spilling from between the circumferential surface of the roller and the housing 540.

In the yellow developing device 54 structured as above, the toner supplying roller 550 supplies the toner T contained in the toner containing body 530 to the developing roller 510. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the toner T on the developing roller 510, which has been electrically charged and whose layer thickness has been restricted, reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the upper sealing member 520 and is collected into the developing device by the upper sealing member 520 without being scraped off. Then, the toner T that still remains on the developing roller 510 can be stripped off by the toner supplying roller 550.

Figure 5:
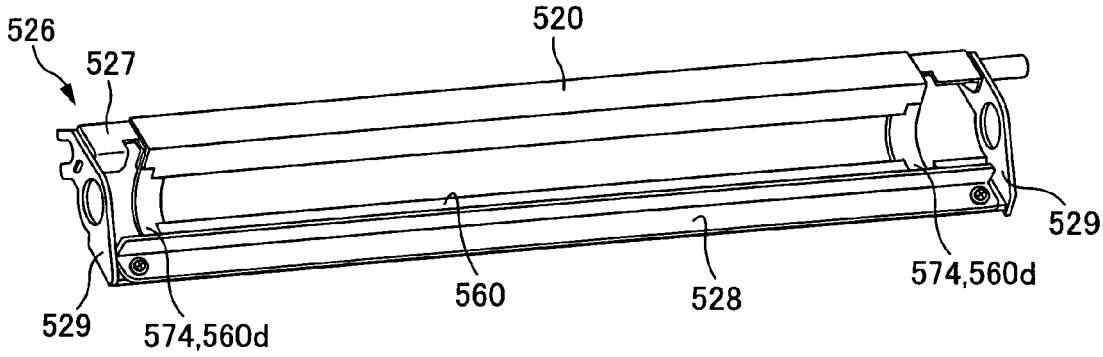
FIG. 5 is a perspective view showing how the upper sealing member 520, the restriction blade 560, and the end seals 574 are supported by the holder 526.
Figure 6:
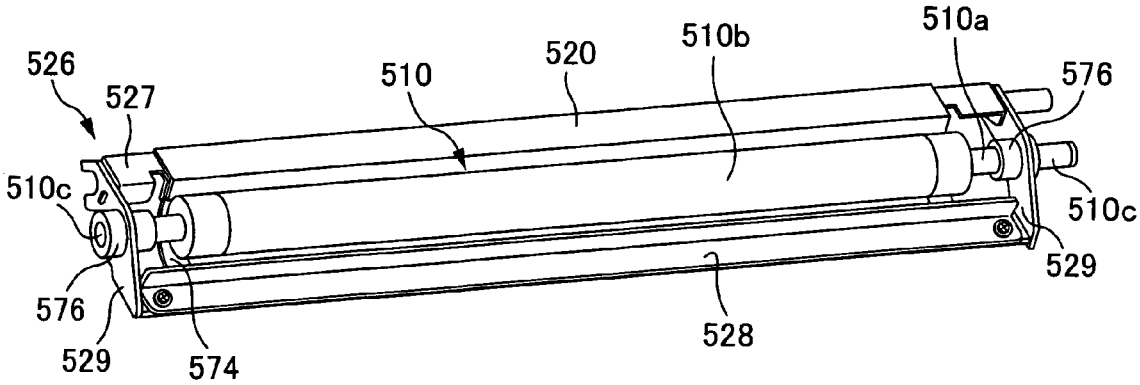
FIG. 6 is a perspective view showing how the upper sealing member 520, the restriction blade 560, the end seals 574, and the developing roller 510 are supported by the holder 526.
Figure 7:
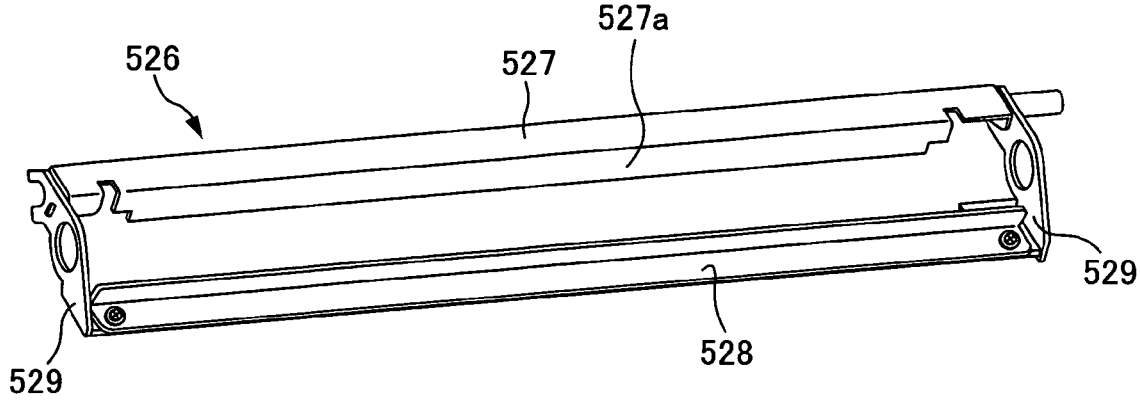
FIG. 7 is a perspective view showing the holder 526.
Figure 8:
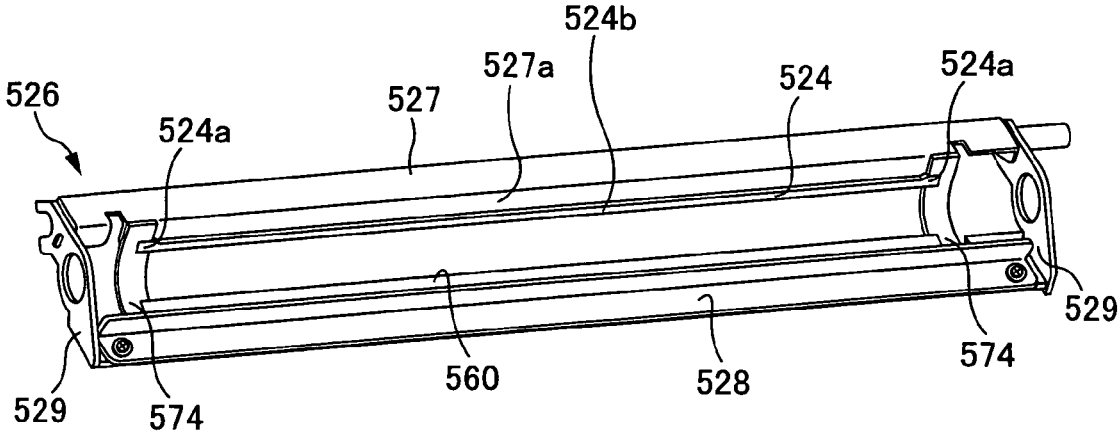
FIG. 8 is a perspective view showing an upper-seal urging member 524 fixed to the holder 526.
Figure 9:
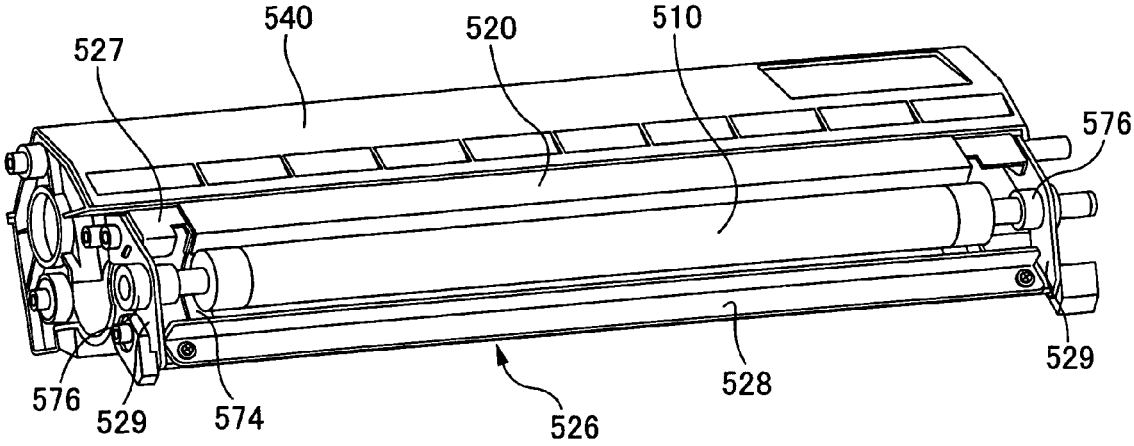
FIG. 9 is a perspective view showing how the holder 526 is attached to the housing 540 via a housing seal 546.
Figure 10:
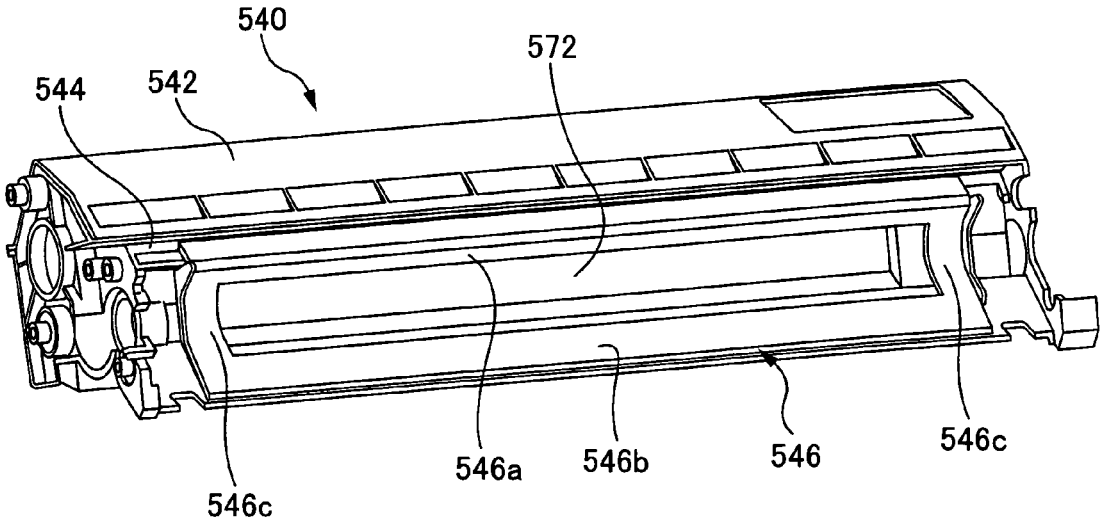
FIG. 10 is a perspective view showing how the housing seal 546 is fixed to the housing 540.
Figure 11:
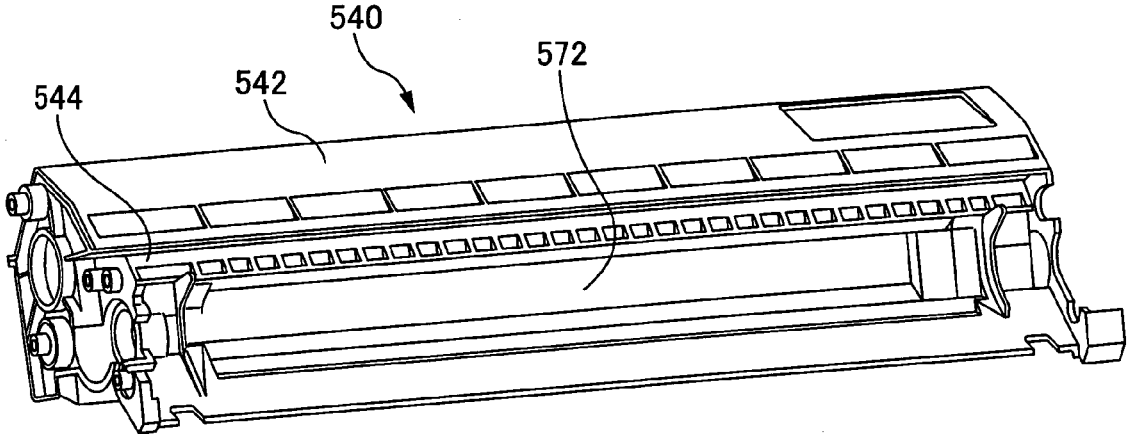
FIG. 11 is a perspective view showing a portion of the housing 540 where the housing seal 546 is to be fixed.

(1) Configuration of Upper Sealing Member and its Periphery According to the First Embodiment Next, the configuration of the upper sealing member 520, which serves as an example of a sealing member, and its periphery is described with reference to FIG. 4 through FIG. 11. FIG. 5 is a perspective view showing how the upper sealing member 520, the restriction blade 560, and the end seals 574 are supported by the holder 526. FIG. 6 is a perspective view showing how the upper sealing member 520, the restriction blade 560, the end seals 574, and the developing roller 510 are supported by the holder 526. FIG. 7 is a perspective view showing the holder 526. FIG. 8 is a diagram in which the upper sealing member 520 has been removed from the perspective view shown in FIG. 5, and is a perspective view showing an upper-seal urging member 524 fixed to the holder 526. FIG. 9 is a perspective view showing how the holder 526 is attached to the housing 540 via a housing seal 546. FIG. 10 is a diagram in which the holder 526 has been removed from the perspective view shown in FIG. 9, and is a perspective view showing how the housing seal 546 is fixed to the housing 540. FIG. 11 is a diagram in which the holder 526 and the housing seal 546 have been removed from the perspective view shown in FIG. 9, and is a perspective view showing a portion of the housing 540 where the housing seal 546 is to be fixed.

As described above, the upper sealing member 520 abuts against the developing roller 510 along the axial direction thereof to allow the toner T remaining on the developing roller 510 after passing the developing position to move into the housing 540 and also to restrict the toner T in the housing 540 from moving outside therefrom. The upper sealing member 520 is a seal made, for example, of polyethylene film. As shown in FIG. 4 and FIG. 5, the upper sealing member 520 is supported by the holder 526, which serves as an example of a supporting member, and as shown in FIG. 6, it is arranged such that its longitudinal direction is in the axial direction of the developing roller 510. The abutting position where the upper sealing member 520 abuts against the developing roller 510 is above the central axis of the developing roller 510.

The holder 526 is a supporting member made of metal for supporting the developing roller 510, the restriction blade 560, and the upper sealing member 520. As shown in FIG. 7, the holder 526 has an upper-seal supporting section 527 arranged in the longitudinal direction (i.e., the axial direction of the developing roller 510) and serving as an example of a first supporting section, a restriction-blade supporting section 528 also arranged in the longitudinal direction (i.e., the axial direction of the developing roller 510), and developing-roller supporting sections 529 provided outside the upper-seal supporting section 527 and the restriction-blade supporting section 528 in the longitudinal direction (the axial direction) and serving as an example of a second supporting section that intersects with the longitudinal direction (the axial direction). The upper sealing member 520 is supported by the upper-seal supporting section 527 at its lateral-direction end 520*a* (see FIG. 4). It should be noted that as described above, the developing roller 510 is supported by the developing-roller supporting sections 529 at its axial-direction ends 510*c*, and the restriction blade 560 is supported by the restriction-blade supporting section 528 at its lateral-direction end 560*c* (see FIG. 4).

Further, as shown in FIG. 4, in between the holder 526 and a surface of the upper sealing member 520 (which is also referred to as the opposite surface 520*c*) on the opposite side from the abutting surface 520*b* of the upper sealing member 520 with which the upper sealing member 520 abuts against the developing roller 510, an upper-seal urging member 524 made of an elastic body such as Moltoprene and serving as an example of an urging member is provided in a compressed state. The upper-seal urging member 524 presses the upper sealing member 520 against the developing roller 510 by urging the upper sealing member 520 toward the developing roller 510 with its urging force. As shown in FIG. 8, the upper-seal urging member 524 is arranged such that its longitudinal direction is in the axial direction of the developing roller 510, and is fixed to the upper-seal supporting section 527 of the holder 526. More specifically, the upper-seal supporting section 527 has a bent section 527*a* formed by bending it along its longitudinal direction, and the upper-seal urging member 524 is fixed to this bent section 527*a*. Therefore, the upper-seal urging member 524 is positioned between the opposite surface 520*c* and the bent section 527*a*.

As shown in FIG. 9 through FIG. 11, the holder 526 described above is attached to the housing 540 via a housing seal 546, which serves as an example of another sealing member different from the upper sealing member 520, in a state where the developing roller 510, the restriction blade 560, the end seals 574, the upper sealing member 520, and the upper-seal urging member 524 have been assembled to it.

The housing seal 546 functions as to prevent the toner T from spilling from between the holder 526, or the members assembled to the holder 526, and the housing 540. As shown in FIG. 10, the housing seal 546 is a rectangular elastic body made, for example, of Moltoprene with its central portion (a rectangular portion) cut out therefrom. The housing seal 546 has a first sealing section 546*a*, a second sealing section 546*b*, and a third sealing section 546*c*.

The first sealing section 546*a* abuts against the upper-seal supporting section 527 of the holder 526 and the housing 540 to function as to prevent the toner T from spilling from between the upper-seal supporting section 527 and the housing 540. The second sealing section 546*b* abuts against the rubber-supporting section 560*b* of the restriction blade 560 and the housing 540 to function as to prevent the toner T from spilling from between the rubber-supporting section 560*b* and the housing 540. The third sealing section 546*c* abuts against the end seals 574 and the housing 540 to function as to prevent the toner T from spilling from between the end seals 574 and the housing 540.

It should be noted that, of the holder 526 and the housing 540, the housing seal 546 is fixed only to the housing 540. Further, the second sealing section 546*b* not only functions as to prevent the toner T from spilling, but also functions as to stabilize the elastic force caused by flexure of the rubber-supporting section 560*b* and to make the rubber section 560*a* abut against the developing roller 510 more evenly.

As described above, in the present embodiment, the upper-seal urging member 524 is provided between the holder 526 and the surface 520*c* of the upper sealing member 520 on the opposite side from the abutting surface 520*b* with which the upper sealing member 520 abuts against the developing roller 510. In this way, it is possible to appropriately make the abutting pressure of the upper sealing member 520 against the developing roller 510 even.

More specifically, as described in the "Description of the Related Art" etc., in order for the upper sealing member 520 to appropriately achieve its function of preventing the developer from spilling, it is necessary to make the abutting pressure at which the upper sealing member 520 abuts against the developing roller 510 even. In order to do so, it is necessary to appropriately set the position of the upper-seal urging member 524, for example, the relative position of the upper-seal urging member 524 with respect to the developing roller 510, the upper sealing member 520, and a member against which the upper-seal urging member 524 abuts on the opposite side, from the upper sealing member 520 (which is the holder 526 in the foregoing embodiment, to a desired position.

Figure 12:
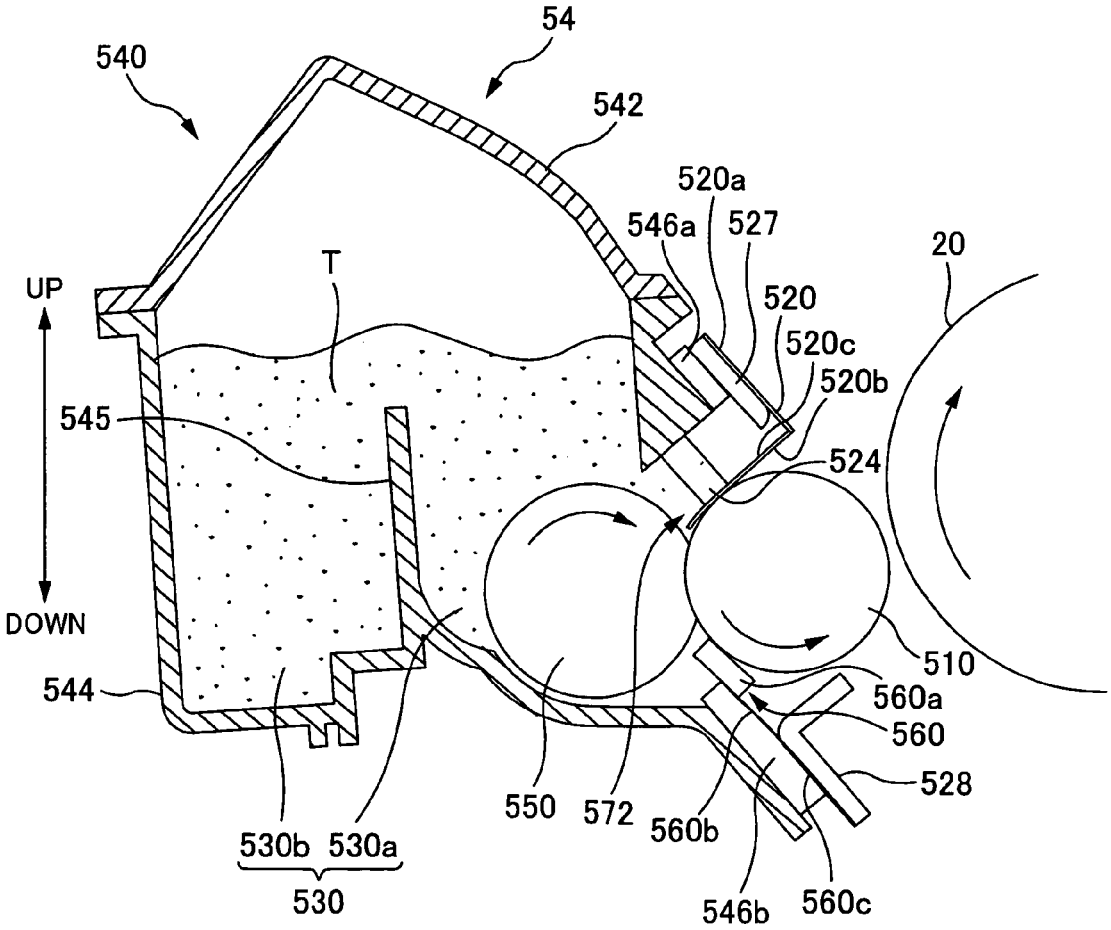
FIG. 12 is a section view showing main structural components of a conventional developing device.

Meanwhile, a conventional developing device having an upper-seal urging member 524 for urging the upper sealing member 520 toward the developing roller 510 is known to have an upper-seal urging member 524 provided between an upper sealing member 520 and a housing 540. (An example of such a developing device is shown in FIG. 12.) In this example, in order to appropriately set the relative position of the upper-seal urging member 524 with respect to the developing roller 510, the upper sealing member 520, and a member against which the upper-seal urging member 524 abuts on the opposite side from the upper sealing member 520 (which is the housing 540 in this example) to a desired position, it is necessary to strictly control the positional relationship between the holder 526 that supports the developing roller 510 and the upper sealing member 520, and the housing 540 to which the holder 526 is attached.

Therefore, in such a developing device, it is difficult to carry out appropriate positioning of the relative position of the upper-seal urging member 524 with respect to the developing roller 510, the upper sealing member 520, and the housing 540, and thus, it is difficult to make the abutting pressure of the upper sealing member 520 against the developing roller 510 even.

On the other hand, with the developing device according to the present embodiment, the upper-seal urging member 524 is provided between the holder 526 and the surface 520*c* of the upper sealing member 520 on the opposite side from the abutting surface 520*b* with which the upper sealing member 520 abuts against the developing roller 510. Therefore, it is no longer necessary to strictly control the positional relationship between the holder 526 that supports the developing roller 510 and the upper sealing member 520, and the housing 540 to which the holder 526 is attached, in order to appropriately set the relative position of the upper-seal urging member 524 with respect to the developing roller 510, the upper sealing member 520, and a member against which the upper-seal urging member 524 abuts on the opposite side from the upper sealing member 520 (which is the holder 526 in the foregoing embodiment) to a desired position.

More specifically, the developing roller 510 and the upper sealing member 520 are positioned with respect to the holder 526, and the upper-seal urging member 524 is provided between the holder 526 that supports the developing roller 510 and the upper sealing member 520 supported by the holder 526. Therefore, the relative position of the upper-seal urging member 524 with respect to the developing roller 510, the upper sealing member 520, and the holder 526 is appropriately set, without taking into consideration the positional relationship between the holder 526 and the housing 540. Accordingly, it becomes possible to appropriately make the abutting pressure of the upper sealing member 520 against the developing roller 510 even.

<(1) Regarding the Shape of the Upper-Seal Urging Member 524>

As described above, in the developing device according to the present embodiment, the abutting pressure of the upper sealing member 520 against the developing roller 510 is appropriately made even by providing the upper-seal urging member 524 between the holder 526 and the opposite surface 520*c* of the upper sealing member 520. However, if the abutting pressure is made even all the way from one end to the other in the axial direction of the developing roller 510, then the following problems may arise. In order to address such problems, the shape of the upper-seal urging member 524 is creatively designed in the present embodiment, so that the abutting pressure at the ends in the axial direction of the developing roller 510 becomes different from the abutting pressure at the central section in the axial direction.

Figure 14:
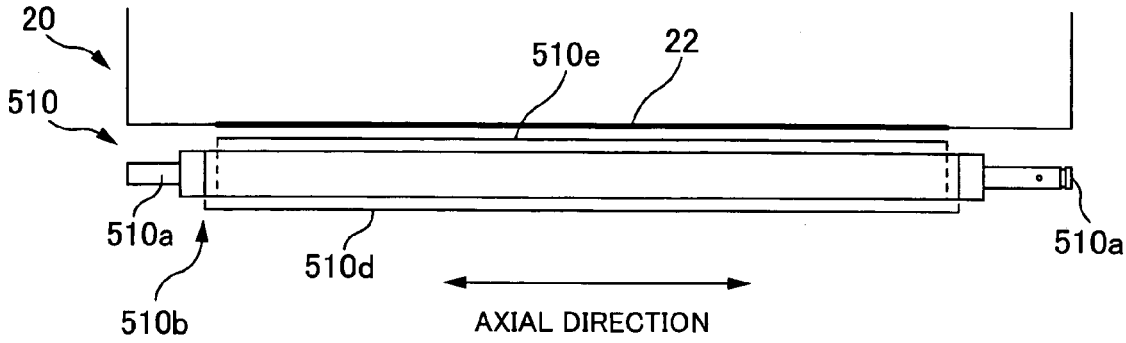
FIG. 14 is an explanatory diagram for describing a toner-bearable region 510*d* and an opposing region 510*e* on the developing roller 510.
Figure 15:
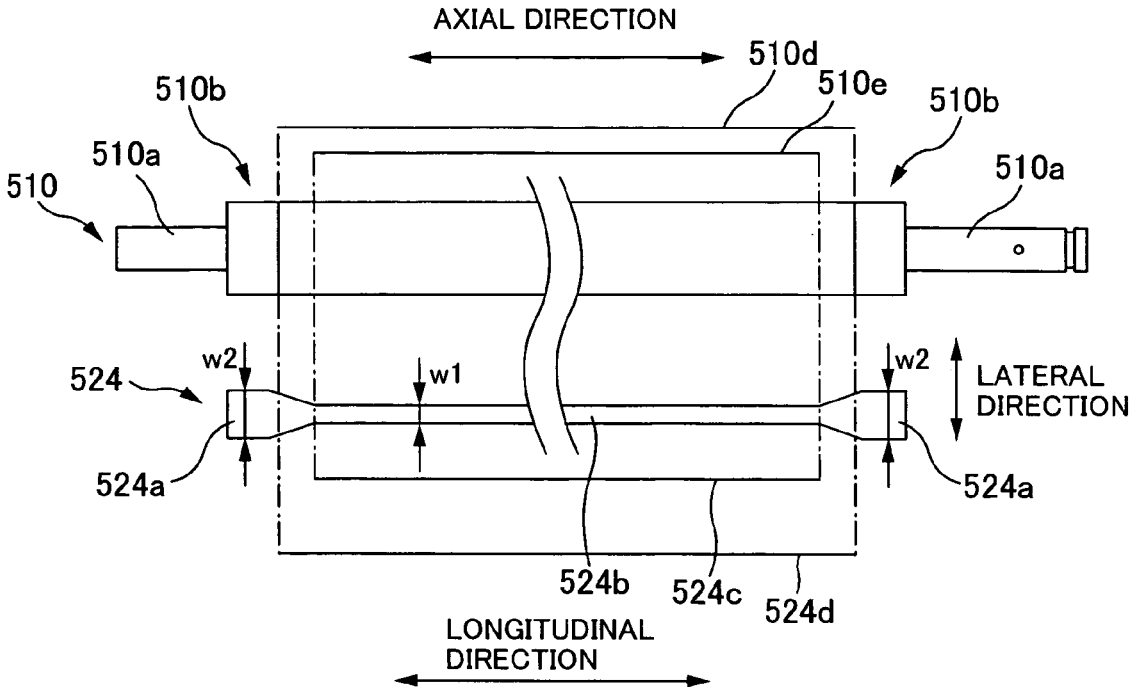
FIG. 15 is an explanatory diagram for describing the positional relationship between the upper-seal urging member 524 and the developing roller 510.

Below, the shape of the upper-seal urging member 524 is first described with reference to FIG. 8, FIG. 14, and FIG. 15, and then description will be made about the problems that arise when the abutting pressure is made even all the way from one end to the other in the axial direction of the developing roller 510 and how to solve these problems by forming the upper-seal urging member 524 into the shape described below. FIG. 14 is an explanatory diagram for describing a toner-bearable region 510*d* and an opposing region 510*e* on the developing roller 510. FIG. 15 is an explanatory diagram for describing the positional relationship between the upper-seal urging member 524 and the developing roller 510.

As described above, the upper-seal urging member 524 is provided between the holder 526 and the opposite surface 520*c* of the upper sealing member 520 such that its longitudinal direction is arranged in the axial direction of the developing roller 510, and presses the upper sealing member 520 against the developing roller 510 by urging the upper sealing member 520 toward the developing roller 510 with its urging force. Further, as shown in FIG. 8 and FIG. 15, in the developing device according to the present embodiment, the width w2, in the lateral direction of the upper-seal urging member 524, of the ends 524*a* of the upper-seal urging member 524 in the longitudinal direction is larger than the width w1, in the lateral direction of the upper-seal urging member 524, of the central section 524*b* of the upper-seal urging member 524 in the longitudinal direction.

By the way, as shown in FIG. 14, the developing roller 510 has a toner-bearable region 510*d* on its large-diameter section 510*b*, which serves as an example of a developer-bearable region and on which the toner T can be borne. Also, as described above, the developing roller 510 is in opposition to the photoconductor 20 in order to appropriately develop the latent image borne on the photoconductor 20; further, the region on the developing roller 510 (which is referred to as the opposing region 510*e*) that is in opposition to the latent-image bearable region 22 (shown with a bold line on the photoconductor 20 in FIG. 14) where the latent image can be borne on the photoconductor 20 is slightly narrower than the toner-bearable region 510*d*. As shown in FIG. 14, the opposing region 510*e* is located in the central section of the toner-bearable region 510*d*.

Now, consideration is made on the positional relationship, in the longitudinal direction of the upper-seal urging member 524 (i.e., the axial direction of the developing roller 510), between the developing roller 510 (particularly the toner-bearable region 510*d* and the opposing region 510*e* of the developing roller 510 described above) and the upper-seal urging member 524. As shown in FIG. 15, the lateral-direction width in the region of the upper-seal urging member 524 (which is indicated by the reference number 524*c* in FIG. 15) corresponding to the opposing region 510*e* is set to w1. That is, the width in the lateral direction of the upper-seal urging member 524 at any position within the region 524*c* is smaller than the width w2, in the lateral direction of the upper-seal urging member 524, of the longitudinal-direction ends 524*a*. Further, the width of the upper-seal urging member 524 in the lateral direction at any position within a region of the upper-seal urging member 524 (which is indicated by the reference number 524*d* in FIG. 15) corresponding to the toner-bearable region 510*d* is smaller than the width w2, in the lateral direction of the upper-seal urging member 524, of the longitudinal-direction ends 524*a*.

Next, description will be made on the problems that arise when the abutting pressure of the upper sealing member 520 against the developing roller 510 is made even all the way from one end to the other in the axial direction of the developing roller 510.

In order for the upper sealing member 520 to appropriately achieve its function of preventing the toner from spilling, it is necessary to make the abutting pressure of the upper sealing member 520 against the developing roller 510 high. However, if the abutting pressure is too high, then deterioration of the toner will accelerate, and problems such as deterioration in image quality and adherence of the toner onto the upper sealing member 520 may arise. Therefore, the abutting pressure should not be too high nor too low, and it must be set to a value that is suitable in consideration of appropriately preventing both toner spill and toner deterioration (this value is referred to hereinafter as "suitable value"). However, the following problems may arise if the value of the abutting pressure is set to the suitable value all the way from one end to the other in the axial direction of the developing roller 510.

If the developing device is dropped during, for example, transportation of the developing device, then toner spill is prone to occur because a large shock is applied to the developing device. Particularly, if the developing device is dropped in such a manner that its longitudinal direction (the axial direction of the developing roller 510) is along the vertical direction, then it becomes insufficient to set the value of the abutting pressure at the axial-direction ends to the-suitable value (the value is too low) because pressure is concentrated on the ends in the axial direction of the developing roller 510 (the ends in the longitudinal direction of the developing device), and thus, toner spills from the axial-direction ends.

In order to address this problem, in the developing device according to the present embodiment, the width w2, in the lateral direction of the upper-seal urging member 524, of the longitudinal-direction ends 524*a* of the upper-seal urging member 524 is made larger than the width w1, in the lateral direction of the upper-seal urging member 524, of the longitudinal-direction central section 524*b* of the upper-seal urging member 524.

More specifically, by making the width w2 larger than the width w1, the urging force by which the longitudinal-direction ends 524*a* of the upper-seal urging member 524 urges the longitudinal-direction ends of the upper sealing member 520 toward the axial-direction ends of the developing roller 510 becomes larger than an urging force by which the longitudinal-direction central section 524*b* of the upper-seal urging member 524 urges the longitudinal-direction central section of the upper sealing member 520 toward the axial-direction central section of the developing roller 510. In this way, it is possible to set the value of the abutting pressure to the above-described suitable value in the central section of the developing roller in the axial direction, as well as set the value of the abutting pressure to a value larger than the suitable value at the ends of the developing roller 510 in the axial direction, where development is not carried out. Accordingly, with the developing device according to the present embodiment, both toner deterioration and toner spill are appropriately prevented.

Further, in the developing device according to the present embodiment, the width of the upper-seal urging member 524 in the lateral direction at any position within the region 524*c* of the upper-seal urging member 524 corresponding to the opposing region 510*e* is smaller than the width w2, in the lateral direction of the upper-seal urging member 524, of the longitudinal-direction ends 524*a*. In this way, it is possible to reliably prevent deterioration in image quality due to toner deterioration.

Furthermore, in the developing device according to the present embodiment, the width of the upper-seal urging member 524 in the lateral direction at any position within the region 524*d* of the upper-seal urging member 524 corresponding to the toner-bearable region 510*d* is smaller than the width w2, in the lateral direction of the upper-seal urging member 524, of the longitudinal-direction ends 524*a*. In this way, it is possible to reliably prevent toner deterioration.

(1) Other Considerations Regarding First Embodiment

In the foregoing embodiment, an upper sealing member 520 arranged such that its longitudinal direction is in an axial direction of the developing roller 510 was described as an example of a sealing member. This, however, is not a limitation. The present invention is applicable to any type of sealing member that is supported by a holder 526 and that abuts against the developing roller 510 to prevent the toner T from spilling.

Further, in the foregoing embodiment, an upper sealing member 520 that has the functions of allowing the toner T remaining on the developing roller 510 to move into the housing 540, and restricting the toner T in the housing 540 from moving outside from the housing 540, was described as an example of a sealing member. This, however, is not a limitation, and the sealing member does not necessarily have to be provided with the above two functions.

Further, in the foregoing embodiment, the holder 526 had an upper-seal supporting section 527 arranged in the axial direction of the developing roller 510, and a developing-roller supporting section 529 that intersects with the axial direction and that is provided outside the upper-seal supporting section 527 in the axial direction; and the upper sealing member 520 was supported, at an end 520*a* in a lateral direction thereof, by the upper-seal supporting section 527, and the developing roller 510 was supported, at an end 510*c* in the axial direction thereof, by the developing-roller supporting section 529. However, the way according to which the upper sealing member 520 and the developing roller 510 are supported is not limited to the above.

However, since the upper sealing member 520 and the developing roller 510 are appropriately supported according to the above-described way of support, the developing roller 510 and the upper sealing member 520 are positioned with high precision with respect to the holder 526, and therefore, the relative position of the upper-seal urging member 524 with respect to the developing roller 510, the upper sealing member 520, and the holder 526 is appropriately set. Therefore, it becomes possible to make the abutting pressure of the upper sealing member 520 against the developing roller 510 more appropriately even. The foregoing embodiment is therefore more preferable from this standpoint.

Further, in the foregoing embodiment, the upper-seal urging member 524 was fixed to the upper-seal supporting section 527 of the holder 526. This, however, is not a limitation, and for example, it may be fixed to the upper sealing member 520.

However, by fixing the upper-seal urging member 524 to the upper-seal supporting section 527 of the holder 526, the relative position of the upper-seal urging member 524 with respect to the developing roller 510, the upper sealing member 520, and the holder 526 is set more appropriately. Therefore, it becomes possible to make the abutting pressure of the upper sealing member 520 against the developing roller 510 more appropriately even. The foregoing embodiment is therefore more preferable from this standpoint.

Figure 13:
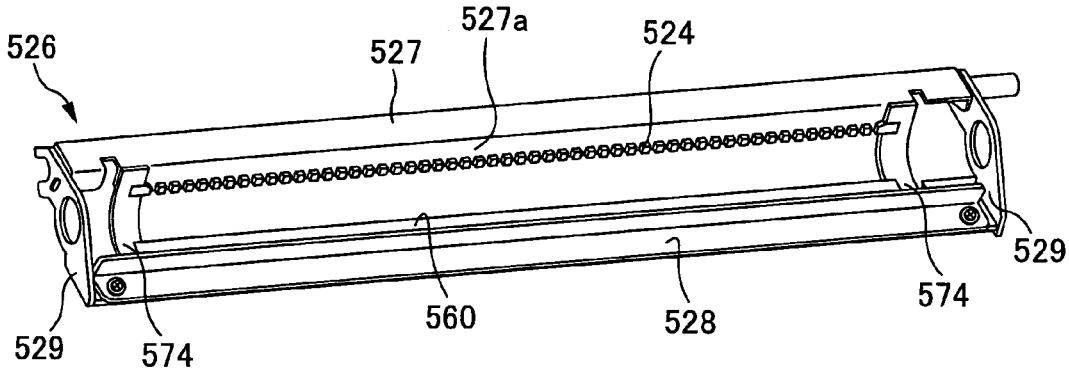
FIG. 13 is a perspective view showing upper-seal urging members 524 fixed to the holder 526.

Further, in the foregoing embodiment, the upper-seal urging member 524 was arranged such that its longitudinal direction is in the axial direction of the developing roller 510. This, however, is not a limitation. For example, as shown in FIG. 13, it is possible to provide a plurality of upper-seal urging members 524 whose longitudinal direction is not arranged in the axial direction of the developing roller 510.

The foregoing embodiment, however, is more preferable from the standpoint that it becomes possible to make the abutting pressure of the upper sealing member 520 against the developing roller 510 more appropriately even. It should be noted that FIG. 13 is a perspective view showing upper-seal urging members 524 fixed to the holder 526.

Further, in the foregoing embodiment, the upper-seal urging member 524 was elastic, and was provided in a compressed state between the holder 526 and the opposite surface 520*c* of the upper sealing member 520. This, however, is not a limitation, and for example, the upper-seal urging member 524 does not have to be elastic, and may be provided between the holder 526 and the opposite surface 520*c* of the upper sealing member 520 in a non-compressed state.

The foregoing embodiment, however, is more preferable from the standpoint that it becomes possible to urge the upper sealing member 520 toward the developing roller 510 more appropriately.

Further, in the foregoing embodiment, the holder 526 was made of metal, and the housing 540 was made of resin. This, however, is not a limitation, and for example, the holder 526 may be made of resin, and the housing 540 may be made of metal.

However, members made of resin are prone to deformation due to heat and/or deformation due to applied pressure, compared to members made of metal. Therefore, an upper-seal urging member 524 that is provided between the upper sealing member 520 and the metal holder 526, and not between the upper sealing member 520 and the resin housing 540, is less prone to the influence of being deformed through heat and/or pressure. Accordingly, it becomes possible to make the abutting pressure of the upper sealing member 520 against the developing roller 510 more appropriately even. The foregoing embodiment is therefore more preferable from this standpoint.

Further, in the foregoing embodiment, the holder 526 was attached to the housing 540 via a housing seal 546. This, however, is not a limitation, and for example, it may be attached to the housing 540 without the housing seal 546.

The foregoing embodiment, however, is more preferable from the standpoint that it is possible to appropriately prevent the toner T from spilling from between the holder 526 and the housing 540.

Figure 16:
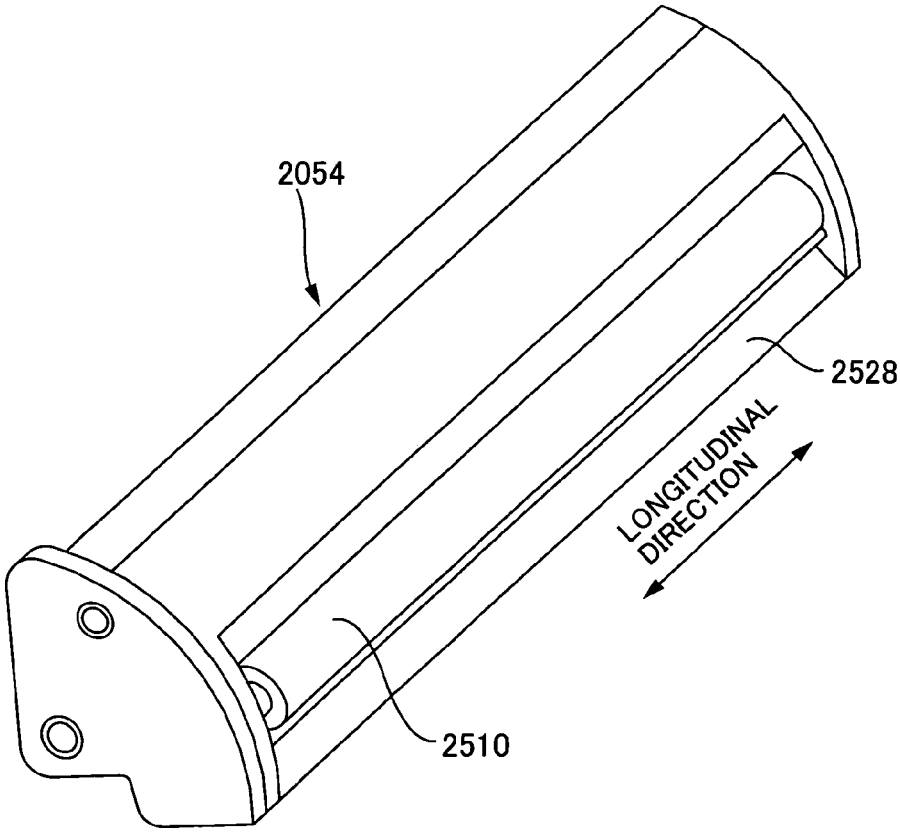
FIG. 16 is a conceptual diagram of a developing device according to a second embodiment.
Figure 17:
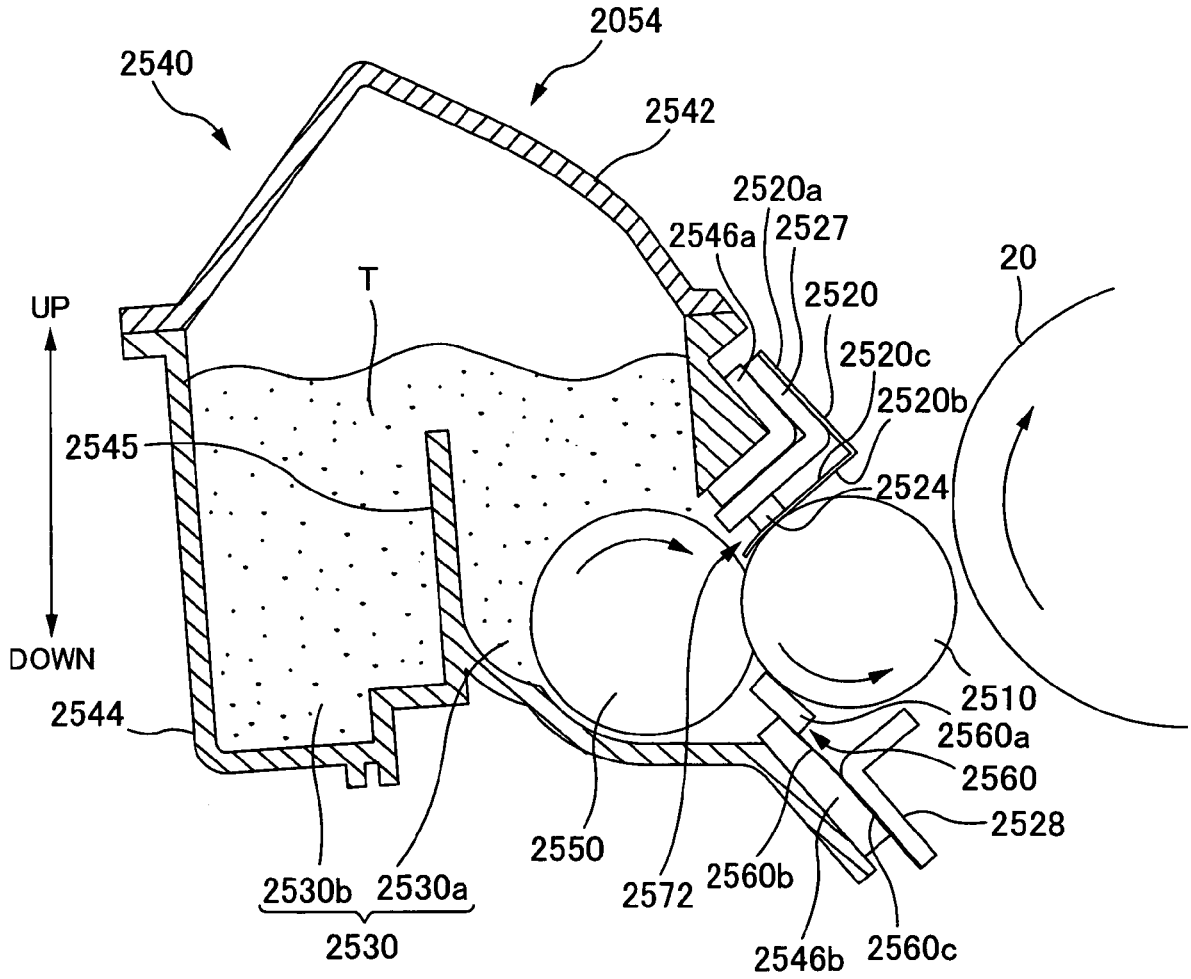
FIG. 17 is a section view showing main structural components of the developing device.

(2) Configuration Example of Developing Device According to the Second Embodiment Next, with reference to FIG. 16 and FIG. 17, a second embodiment of a configuration of the developing device will be described. It should be noted that the configuration of the overall image forming apparatus and the configuration of the control unit are the same for both the present second embodiment, the first embodiment described previously, and the third embodiment described later on. FIG. 16 is a conceptual diagram of a developing device. FIG. 17 is a section view showing main structural components of the developing device. It should be noted that the section view shown in FIG. 17 is a section of the developing device bisected by a plane perpendicular to the longitudinal direction shown in FIG. 16. Further, in FIG. 17, the arrow indicates the vertical direction as in FIG. 1, and, for example, the central axis of the developing roller 2510 is located below the central axis of the photoconductor 20. Further, in FIG. 17, the yellow developing device 2054 is shown positioned at the developing position, which is in opposition to the photoconductor 20.

The YMCK developing unit 50 is provided with: the black developing device 51 containing black (K) toner; the magenta developing device 52 containing magenta (M) toner; the cyan developing device 53 containing cyan (C) toner; and the yellow developing device 2054 containing yellow (Y) toner. Since the configuration of each of the developing devices is the same, description will be made only about the yellow developing device 2054 below.

The yellow developing device 2054 has, for example, the developing roller 2510, an upper sealing member 2520 serving as an example of a first sealing member, a toner containing body 2530, a housing 2540, a toner supplying roller 2550, and a restriction blade 2560 serving as an example of a layer-thickness restricting member.

The developing roller 2510 bears toner T and delivers it to the developing position opposing the photoconductor 20. The developing roller 2510 is made of, for example, aluminum alloy such as aluminum alloy 5056 or aluminum alloy 6063, or iron alloy such as STKM, and where necessary, the roller 2510 is plated with, for example, nickel plating or chromium plating.

The developing roller 2510 has a shaft section 2510*a* and a large-diameter section 2510*b*. The shaft section 2510*a* is supported, through bearings 2576, by developing-roller supporting sections 2529 of a holder 2526 described further below (see FIG. 20), and in this way the developing roller 2510 is supported rotatably. As shown in FIG. 17, the developing roller 2510 rotates in the opposite direction (counterclockwise in FIG. 17) to the rotating direction of the photoconductor 20 (clockwise in FIG. 17). The central axis of the roller 2510 is located below the central axis of the photoconductor 20.

Further, in the state where the yellow developing device 2054 is in opposition to the photoconductor 20, there is a gap between the developing roller 2510 and the photoconductor 20. That is, the yellow developing device 2054 develops the latent image formed on the photoconductor 20 in a non-contacting state. It should be noted that an alternating field is generated between the developing roller 2510 and the photoconductor 20 upon development of the latent image formed on the photoconductor 20.

The housing 2540 is manufactured by welding together a plurality of integrally-molded housing sections made of resin, that is, an upper housing section 2542 and a lower housing section 2544. In the housing 2540 is formed a toner containing body 2530 for containing the toner T. The toner containing body 2530 is divided into two toner containing sections, namely, the first toner containing section 2530*a* and the second toner containing section 2530*b*, by a partitioning wall 2545 that is for partitioning the toner T and that protrudes inwards (in the up/down direction of FIG. 17) from the inner wall. The first toner containing section 2530*a* and the second toner containing section 2530*b* are connected at their upper sections, and in the state shown in FIG. 17, movement of the toner T is restricted by the partitioning wall 2545. However, when the YMCK developing unit 50 is rotated, the toner contained in the first toner containing section 2530*a* and the second toner containing section 2530*b* is once gathered on the side of the section where the containing sections are connected, which is on the upper-section side when in the developing position, and when the YMCK developing unit 50 returns to the state shown in FIG. 17, the toner gets mixed and is returned to the first toner containing section 2530*a* and the second toner containing section 2530*b*. In other words, the toner T is appropriately stirred within the developing device by the rotation of the YMCK developing unit 50.

Therefore, in the present embodiment, no stirring member is provided in the toner containing body 2530. However, it is possible to provide a stirring member for stirring the toner T contained in the toner containing body 2530. Further, as shown in FIG. 17, the housing 2540 (more specifically, the first toner containing section 2530*a*) has an opening 2572 in its lower section, and the developing roller 2510 is provided facing the opening 2572.

The toner supplying roller 2550 is provided in the first toner containing section 2530*a* described above and supplies the toner T contained in the first toner containing section 2530*a* to the developing roller 2510. It also strips off, from the developing roller 2510, the toner T remaining on the developing roller 2510 after development. The toner supplying roller 2550 is made of, for example, polyurethane foam, and is made to abut against the developing roller 2510 in an elastically deformed state. The toner supplying roller 2550 is arranged at a lower section of the first toner containing section 2530*a*. The toner T contained in the first toner containing section 2530*a* is supplied to the developing roller 2510 by the toner supplying roller 2550 at the lower section of the first toner containing section 2530*a*. The toner supplying roller 2550 is rotatable about its central axis. The central axis of the toner supplying roller 2550 is situated below the central axis of rotation of the developing roller 2510. Further, the toner supplying roller 2550 rotates in the opposite direction (clockwise in FIG. 17) to the rotating direction of the developing roller 2510 (counterclockwise in FIG. 17).

The upper sealing member 2520 abuts against the developing roller 2510 along the axial direction thereof to allow the toner T remaining on the developing roller 2510 after passing the developing position to move into the housing 2540 and also to restrict the toner T in the housing 2540 from moving outside therefrom. The upper sealing member 2520 is a seal made, for example, of polyethylene film. The upper sealing member 2520 is supported by an upper-seal supporting section 2527 of a holder 2526, which is described further below, and it is arranged such that its longitudinal direction is in the axial direction of the developing roller 2510 (see FIG. 20). The abutting position where the upper sealing member 2520 abuts against the developing roller 2510 is above the central axis of the developing roller 2510.

Further, in between the upper-seal supporting section 2527 and a surface of the upper sealing member 2520 (which is also referred to as the opposite surface 2520*c*) on the opposite side from the abutting surface 2520*b* of the upper sealing member 2520 with which the upper sealing member 2520 abuts against the developing roller 2510, an upper-seal urging member 2524 made of an elastic body such as Moltoprene and serving as an example of an urging member is provided in a compressed state. The upper-seal urging member 2524 presses the upper sealing member 2520 against the developing roller 2510 by urging the upper sealing member 2520 toward the developing roller 2510 with its urging force.

The restriction blade 2560 abuts against the developing roller 2510 along the axial direction thereof, and restricts the thickness of the layer of the toner T borne by the developing roller 2510 as well as gives an electric charge to the toner T borne by the developing roller 2510. The restriction blade 2560 includes a rubber section 2560*a* and a rubber-supporting section 2560*b*. The rubber section 2560*a* is made of, for example, silicone rubber or urethane rubber. The rubber-supporting section 2560*b* is a thin plate that is made of, for example, phosphor bronze or stainless steel, and that has a spring-like characteristic.

The rubber section 2560*a* is supported by the rubber-supporting section 2560*b*. The rubber-supporting section 2560*b* presses, with its urging force, the rubber section 2560*a* against the developing roller 2510. The rubber-supporting section 2560*b* is attached to a restriction-blade supporting section 2528 of the holder 2526, which is described later, in a state where one end of the rubber-supporting section 2560*b* is supported by the restriction-blade supporting section 2528.

The end of the restricting blade 2560 opposite from the end that is being supported by the restriction-blade supporting section 2528, i.e., the tip end of the restriction blade 2560, is not placed in contact with the developing roller 2510; rather, a section at a predetermined distance away from the tip end contacts, with some breadth, the developing roller 2510. That is, the restriction blade 2560 does not abut against the developing roller 2510 at its edge, but abuts against the roller 2510 near its central portion. Further, the restriction blade 2560 is arranged so that its tip end faces toward the upstream side of the rotating direction of the developing roller 2510, and thus, makes a so-called counter-abutment with respect to the roller 2510. It should be noted that the abutting position at which the restriction blade 2560 abuts against the developing roller 2510 is below the central axis of the developing roller 2510 and is also below the central axis of the toner supplying roller 2550. It should be noted that the restriction blade 2560 functions as to prevent the toner T from spilling from the toner containing body 2530 by abutting against the developing roller 2510 along its axial direction.

Further, end seals 2574 (see FIG. 19), which serve as an example of a second sealing member, are provided on the outside, in the longitudinal direction, of the rubber section 2560*a* of the restriction blade 2560. The end seals 2574 are made of nonwoven fabric and abut against the ends, in the axial direction, of the developing roller 2510 along the circumferential direction of the developing roller 2510, so as to function as to prevent the toner T from spilling from between the circumferential surface of the roller and the housing 2540.

In the yellow developing device 2054 structured as above, the toner supplying roller 2550 supplies the toner T contained in the toner containing body 2530 to the developing roller 2510. With the rotation of the developing roller 2510, the toner T, which has been supplied to the developing roller 2510, reaches the abutting position of the restriction blade 2560; then, as the toner T passes the abutting position, the toner is electrically charged and its layer thickness is restricted. With further rotation of the developing roller 2510, the toner T on the developing roller 2510, which has been electrically charged and whose layer thickness has been restricted, reaches the developing position opposing the photoconductor 20; then, under the alternating field, the toner T is used at the developing position for developing the latent image formed on the photoconductor 20. With further rotation of the developing roller 2510, the toner T on the developing roller 2510, which has passed the developing position, passes the upper sealing member 2520 and is collected into the developing device by the upper sealing member 2520 without being scraped off. Then, the toner T that still remains on the developing roller 2510 can be stripped off by the toner supplying roller 2550.

Figure 18:
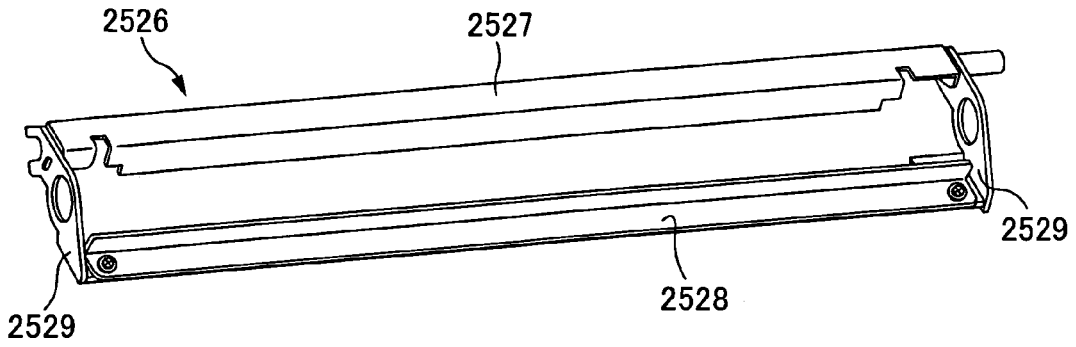
FIG. 18 is a perspective view of the holder 2526.
Figure 19:
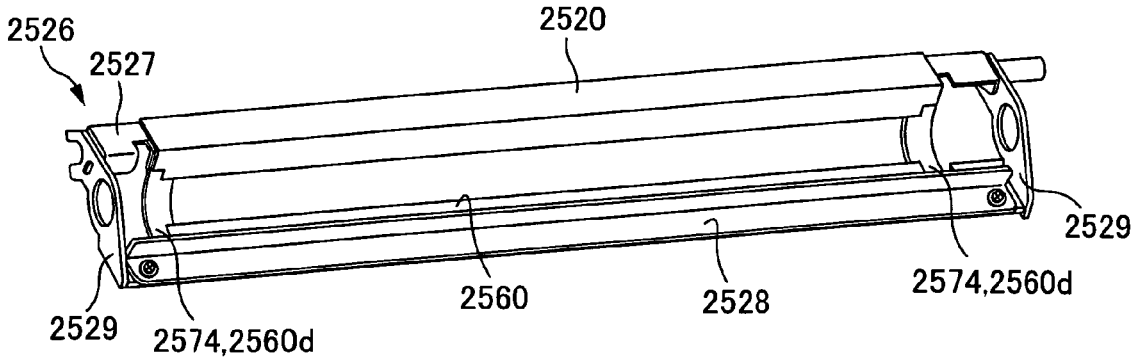
FIG. 19 is a perspective view showing how the upper sealing member 2520, the restriction blade 2560, the end seals 2574, and the upper-seal urging member 2524 are assembled to the holder 2526.
Figure 20:
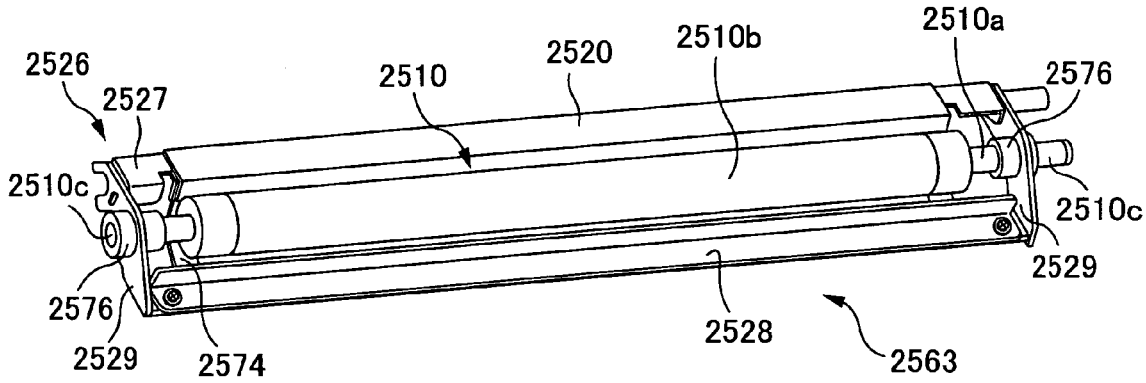
FIG. 20 is a perspective view showing a unit 2563.
Figure 21:
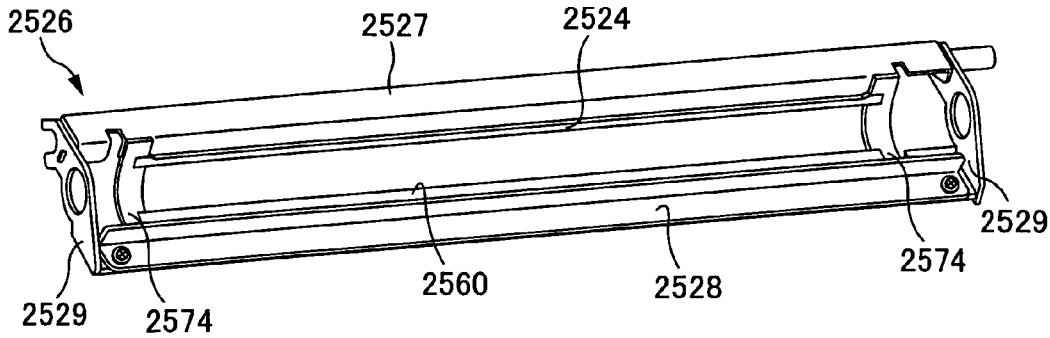
FIG. 21 is a perspective view showing the upper-seal urging member 2524 supported by the holder 2526.
Figure 22:
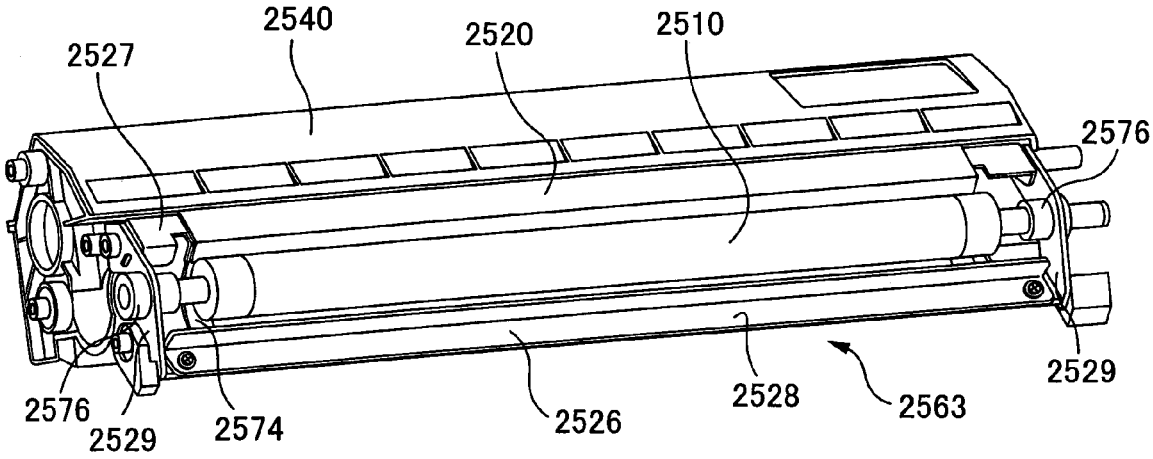
FIG. 22 is a perspective view showing how the unit 2563 is attached to the housing 2540 via a housing seal 2546.
Figure 23:
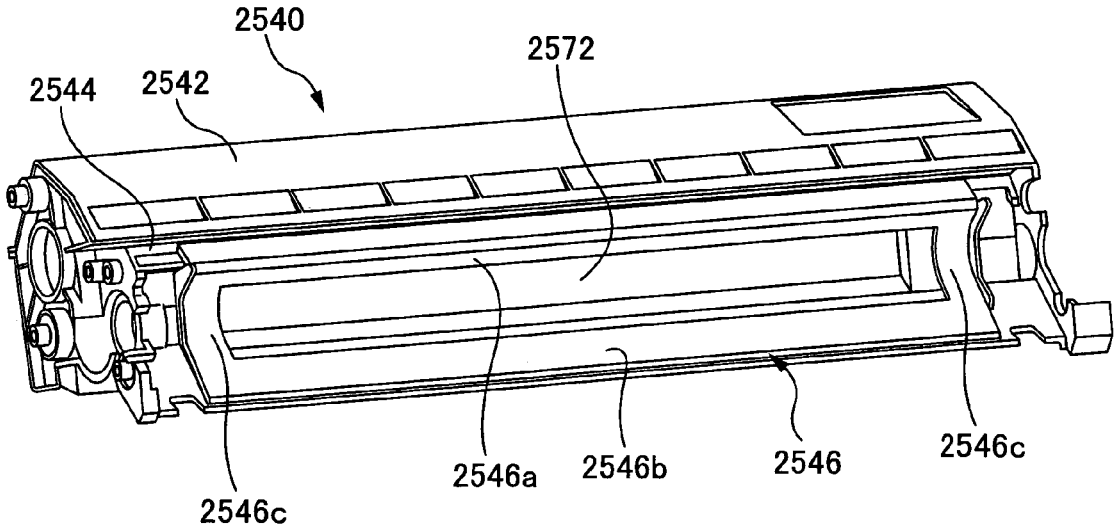
FIG. 23 is a perspective view showing how the housing seal 2546 is fixed to the housing 2540.
Figure 24:
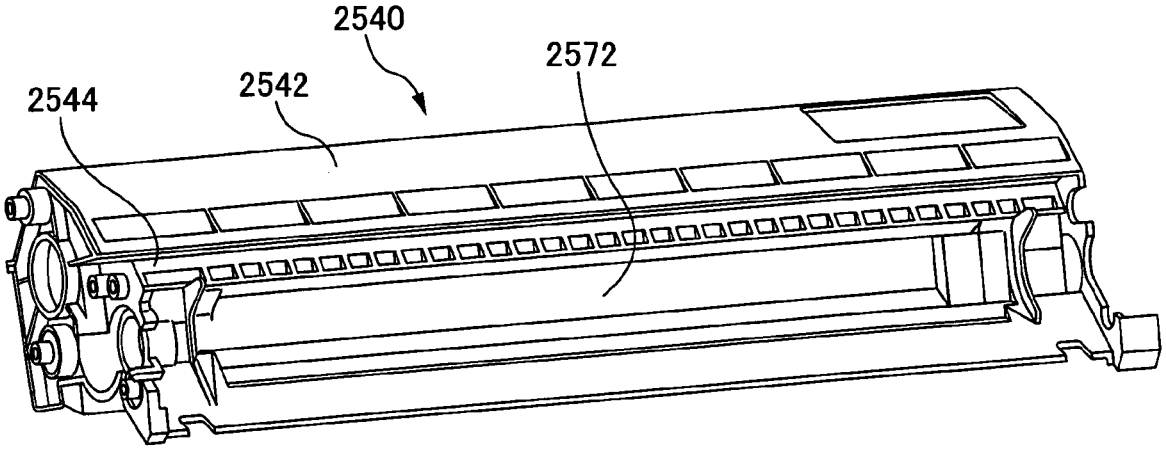
FIG. 24 is a perspective view showing a portion of the housing 2540 where the housing seal 2546 is to be fixed.

(2) Configuration of the Holder and its Periphery According to the Second Embodiment Next, the configuration of the holder 2526, which serves as an example of an assembly member, and its periphery is described with reference to FIG. 17 through FIG. 24. FIG. 18 is a perspective view of the holder 2526. FIG. 19 is a perspective view showing how the upper sealing member 2520, the restriction blade 2560, the end seals 2574, and the upper-seal urging member 2524 are assembled to the holder 2526. FIG. 20 is a perspective view showing a unit 2563. FIG. 21 is a diagram in which the upper sealing member 2520 has been removed from the perspective view shown in FIG. 19, and is a perspective view showing the upper-seal urging member 2524 supported by the holder 2526. FIG. 22 is a perspective view showing how the unit 2563 is attached to the housing 2540 via a housing seal 2546. FIG. 23 is a diagram in which the unit 2563 has been removed from the perspective view shown in FIG. 22, and is a perspective view showing how the housing seal 2546 is fixed to the housing 2540. FIG. 24 is a diagram in which the unit 2563 and the housing seal 2546 have been removed from the perspective view shown in FIG. 22, and is a perspective view showing a portion of the housing 2540 where the housing seal 2546 is to be fixed.

The holder 2526 is an assembly member made of metal onto which the developing roller 2510, the restriction blade 2560, the upper sealing member 2520, the end seals 2574, and the upper-seal urging member 2524 are assembled. As shown in FIG. 18, the holder 2526 has an upper-seal supporting section 2527 arranged in the longitudinal direction (i.e., the axial direction of the developing roller 2510) and serving as an example of a first supporting section, a restriction-blade supporting section 2528 also arranged in the longitudinal direction (i.e., the axial direction of the developing roller 2510) and serving as an example of a second supporting section, and developing-roller supporting sections 2529 provided outside the upper-seal supporting section 2527 and the restriction-blade supporting section 2528 in the longitudinal direction (the axial direction) and serving as an example of a third supporting section that intersects with the longitudinal direction (the axial direction).

As shown in FIG. 19 and FIG. 20, the upper sealing member 2520 is supported by the upper-seal supporting section 2527 at its lateral-direction end 2520*a* (see FIG. 17). Further, the developing roller 2510 is supported by the developing-roller supporting sections 2529 at its axial-direction ends 2510*c*, and the restriction blade 2560 is supported by the restriction-blade supporting section 2528 at its lateral-direction end 2560*c* (see FIG. 17). Furthermore, as shown in FIG. 19, the restriction blade 2560 supports the end seals 2574 at its longitudinal-direction ends 2560*d*, and as shown in FIG. 21, the upper-seal urging member 2524 is supported by the upper-seal supporting section 2527 and is arranged such that its longitudinal direction is in the axial direction of the developing roller 2510.

In this way, a unit 2563 is formed by assembling the developing roller 2510, the restriction blade 2560, the end seals 2574, the upper sealing member 2520, and the upper-seal urging member 2524 onto the holder 2526.

As shown in FIG. 22 through FIG. 24, the unit 2563, which is provided with the developing roller 2510, the restriction blade 2560, the upper sealing member 2520, the end seals 2574, the upper-seal urging member 2524, and the holder 2526 onto which these members have been assembled, is attached to the housing 2540 via a housing seal 2546, which serves as an example of a third sealing member.

Only one housing seal 2546 is provided for each developing device, and it functions as to prevent the toner T from spilling from between the unit 2563 and the housing 2540. As shown in FIG. 23, the housing seal 2546 is a rectangular elastic body made, for example, of Moltoprene with its central portion (a rectangular portion) cut out therefrom. The housing seal 2546 has a first sealing section 2546*a*, a second sealing section 2546*b*, and a third sealing section 2546*c*.

The first sealing section 2546*a* abuts against the upper-seal supporting section 2527 of the holder 2526 and the housing 2540 to function as to prevent the toner T from spilling from between the upper-seal supporting section 2527 and the housing 2540. The second sealing section 2546*b* abuts against the rubber-supporting section 2560*b* of the restriction blade 2560 and the housing 2540 to function as to prevent the toner T from spilling from between the rubber-supporting section 2560*b* and the housing 2540. The third sealing section 2546*c* abuts against the end seals 2574 and the housing 2540 to function as to prevent the toner T from spilling from between the end seals 2574 and the housing 2540.

It should be noted that, of the unit 2563 and the housing 2540, the housing seal 2546 is fixed only to the housing 2540. Further, the second sealing section 2546*b* not only functions as to prevent the toner T from spilling, but also functions as to stabilize the elastic force caused by flexure of the rubber-supporting section 2560*b* and to make the rubber section 2560*a* abut against the developing roller 2510 more evenly.

As described above, in the present embodiment, the unit 2563, which is provided with the developing roller 2510, the restriction blade 2560, the upper sealing member 2520, the end seals 2574, and the holder 2526 onto which these members have been assembled, is attached to the housing 2540. In this way, it is possible to achieve a developing device that can be easily assembled.

More specifically, as described in the "Description of the Related Art" etc., in order for the restriction blade 2560 to appropriately achieve its function of restricting the layer thickness of the developer as described above, it is necessary to set the relative position of the restriction blade 2560 with respect to the developing roller 2510 to an appropriate position with high precision. Also, in order for the upper sealing member 2520 and the end seals 2574 to appropriately achieve their function of preventing the toner from spilling as described above, it is necessary to set the relative position of the upper sealing member 2520 and the end seals 2574 with respect to the developing roller 2510 to an appropriate position with high precision.

Conventional developing devices provided with a developing roller, a restriction blade, an upper sealing member, and end seals are known to have these members attached either directly, or via a supporting member corresponding to each of these members, to the housing. However, in assembling such a developing device, it is necessary to assemble each of these members to the housing while adjusting these members such that the relative positions of the restriction blade, the upper sealing member, and the end seals with respect to the developing roller are appropriately set. Such tasks are extremely burdensome.

Figure 25:
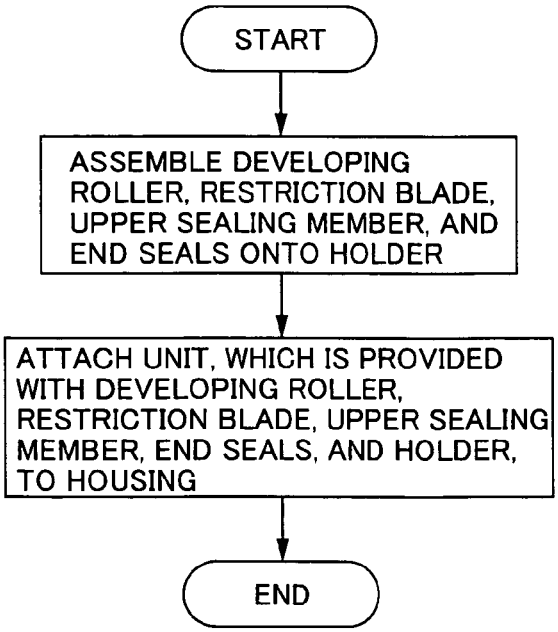
FIG. 25 is a flowchart showing steps of a method of manufacturing a developing device.

On the other hand, in the developing device according to the present embodiment, a unit 2563, which is provided with the developing roller 2510, the restriction blade 2560, the upper sealing member 2520, the end seals 2574, and the holder 2526 onto which these members have been assembled, is attached to the housing 2540. With this configuration, it becomes possible to adopt the following procedure when assembling a developing device: the step of first assembling the developing roller 2510, the restriction blade 2560, the upper sealing member 2520, and the end seals 2574 onto a holder 2526, which is a member onto which these members are to be assembled, to thus assemble a unit 2563 in which the relative positions of the restriction blade 2560, the upper sealing member 2520, and the end seals 2574 with respect to the developing roller 2510 are set to their appropriate positions with high precision; and the step of attaching this unit 2563 to the housing 2540. (A flowchart including these steps is shown in FIG. 25.)

Accordingly, with the present embodiment, it becomes possible to achieve a developing device that can be easily assembled.

It should be noted that the following advantages can also be achieved when the unit 2563 is recycled or reused.

That is, with the developing device according to the foregoing embodiment, the unit 2563 itself can be recycled or reused as it is, in a state where the developing roller 2510, the restriction blade 2560, the upper sealing member 2520, and the end seals 2574 are assembled to the holder 2526. (This is not possible with conventional developing devices described above.)

(2) Other Considerations Regarding Second Embodiment

In the foregoing embodiment, the unit 2563 was attached to the housing 2540 via a housing seal 2546 for preventing the toner T from spilling from between the unit 2563 and the housing 2540. This, however, is not a limitation.

For example, the unit 2563 may be attached to the housing without intervention of the housing seal 2546.

The foregoing embodiment, however, is more preferable from the standpoint that it becomes possible to prevent the toner T from spilling from the housing 2540 more reliably.

Further, in the foregoing embodiment, the developing device included an upper-seal urging member 2524 that is arranged such that a longitudinal direction thereof is in the axial direction of the developing roller 2510 and that is for urging the upper sealing member 2520 toward the developing roller 2510; and a unit 2563 provided with the developing roller 2510, the restriction blade 2560, the upper sealing member 2520, the end seals 2574, the upper-seal urging member 2524, and the holder 2526 onto which these members have been assembled, was attached to the housing 2540. This, however, is not a limitation.

For example, the developing device does not have to be provided with an upper-seal urging member 2524.

However, in order for the upper-seal urging member 2524 to appropriately achieve the function described above, it is necessary to set the relative position of the upper-seal urging member 2524 with respect to the developing roller 2510 and the upper sealing member 2520 to an appropriate position with high precision. Therefore, it becomes even more burdensome to assemble a developing device that includes a developing roller, a restriction blade, an upper sealing member, end seals, and also the above-described upper-seal urging member, and in which these members are attached either directly, or via a supporting member corresponding to each of those members, to a housing.

Therefore, the present invention becomes even more important in developing devices provided with upper-seal urging members 2524. The foregoing embodiment is therefore more effective from the standpoint that the object of the present invention is achieved more effectively.

Further, in the foregoing embodiment, the restriction blade 2560 abutted against the developing roller 2510 along the axial direction thereof to prevent the toner T from spilling. This, however, is not a limitation.

For example, the restriction blade 2560 does not have to be provided with such a function.

However, in a case where the restriction blade 2560 has the above-described function in addition to the function of restricting the layer thickness, it is necessary to set the relative position of the restriction blade 2560 with respect to the developing roller 2510 to an appropriate position with an even higher precision. Therefore, it becomes even more burdensome to assemble a developing device that includes a developing roller, a restriction blade, an upper sealing member, and end seals, and in which these members are attached either directly, or via a supporting member corresponding to each of those members, to a housing.

Therefore, the present invention becomes even more important in cases where the restriction blade 2560 has the function of preventing the toner from spilling. The foregoing embodiment is therefore more effective from the standpoint that the object of the present invention is achieved more effectively.

Further, in the foregoing embodiment, the holder 2526 included an upper-seal supporting section 2527 and a restriction-blade supporting section 2528 that are arranged in a longitudinal direction of the holder 2526, and a developing-roller supporting section 2529 that intersects with the longitudinal direction and that is provided outside the upper-seal supporting section 2527 and the restriction-blade supporting section 2528 in the longitudinal direction; the developing roller 2510 was supported at the ends in the axial direction thereof by the developing-roller supporting sections 2529; the upper sealing member 2520 was supported at an end 2520*a* in a lateral direction thereof by the upper-seal supporting section 2527; the restriction blade 2560 was supported at an end 2560*c* in a lateral direction thereof by the restriction-blade supporting section 2528; the restriction blade 2560 supported the end seals 2574 at ends 2560*d* in a longitudinal direction thereof; and the upper-seal urging member 2524 was supported by the upper-seal supporting section 2527, and was provided between the upper-seal supporting section 2527 and an opposite surface 2520*c* of the upper sealing member 2520. However, the way according to which the developing roller 2510, the upper sealing member 2520, the restriction blade 2560, the end seals 2574, and the upper-seal urging member 2524 are supported is not limited to the above.

For example, the restriction blade 2560 may be supported by the developing-roller supporting section 2529, and the upper-seal urging member 2524 may be supported by the upper sealing member 2520.

However, according to the above-described way of supporting the members, it becomes possible to obtain a unit 2563 in which the developing roller 2510, the upper sealing member 2520, the restriction blade 2560, the end seals 2574, and the upper-seal urging member 2524 are reliably supported, and in which the relative positions of the restriction blade 2560, the upper sealing member 2520, the end seals 2574, and the upper-seal urging member 2524 with respect to the developing roller 2510 are set to an appropriate position with an even higher precision. The foregoing embodiment is therefore more preferable from this standpoint.

Further, in the foregoing embodiment, the developing device had only one housing seal 2546 for preventing the toner T from spilling from between the unit 2563 and the housing 2540, and the housing seal 2546 had a first sealing section 2546*a* that abuts against the upper-seal supporting section 2527 and the housing 2540 to prevent the toner T from spilling from between the upper-seal supporting section 2527 and the housing 2540, a second sealing section 2546*b* that abuts against the restriction blade 2560 and the housing 2540 to prevent the toner T from spilling from between the restriction blade 2560 and the housing 2540, and a third sealing section 2546*c* that abuts against the end seals 2574 and the housing 2540 to prevent the toner T from spilling from between the end seals 2574 and the housing 2540. This, however, is not a limitation.

For example, the developing device may have a plurality of housing seals 2546, namely, a first housing seal that abuts against the upper-seal supporting section 2527 and the housing 2540 to prevent the toner T from spilling from between the upper-seal supporting section 2527 and the housing 2540, a second housing seal that abuts against the restriction blade 2560 and the housing 2540 to prevent the toner T from spilling from between the restriction blade 2560 and the housing 2540, and a third housing seal that abuts against the end seals 2574 and the housing 2540 to prevent the toner T from spilling from between the end seals 2574 and the housing 2540.

However, the foregoing embodiment is more preferable from the standpoint that the assembly of the developing device becomes even easier because the developing device has only one housing seal 2546. Further, the foregoing embodiment is more preferable from the standpoint that the function of the housing seal 2546 of preventing the toner from spilling is improved even further because no gap exists between the first sealing section 2546*a*, the second sealing section 2546*b*, and the third sealing section 2546*c*.

Further, in the foregoing embodiment, of the unit 2563 and the housing 2540, the housing seal 2546 was fixed only to the housing 2540. This, however, is not a limitation.

For example, the housing seal 2546 may be fixed only to the unit 2563.

The foregoing embodiment, however, is more preferable from the standpoint that the unit 2563 can be recycled or reused efficiently because it is possible to prevent the housing seal 2546 from adhering to the unit 2563 when removing the unit 2563 off from the housing 2540 in order to, recycle or reuse the unit 2563.

Further, in the foregoing embodiment, an upper sealing member 2520 that has the functions of allowing the toner T remaining on the developing roller 2510 to move into the housing 2540, and also restricting the toner T in the housing 2540 from moving outside from the housing 2540, was described as an example of a first sealing member. This, however, is not a limitation, and the first sealing member does not necessarily have to be provided with the above two functions.

However, in a case where the first sealing member has the above two functions, it is necessary to set the relative position of the first sealing member with respect to the developing roller 2510 to an appropriate position with an even higher precision. Therefore, it becomes even more burdensome to assemble a developing device that includes a developing roller, a restriction blade, a first sealing member, and end seals, and in which these members are attached either directly, or via a supporting member corresponding to each of those members, to a housing.

Therefore, the present invention becomes even more important in cases where the first sealing member has the above two functions. The foregoing embodiment is therefore more effective from the standpoint that the object of the present invention is achieved more advantageously.

Further, in the foregoing embodiment, the holder 2526 was made of metal. This, however, is not a limitation, and for example, it may be made of resin.

However, if the holder 2526 is made of metal, it is less prone to deformation due to heat or applied pressure. The foregoing embodiment is therefore more preferable from the standpoint that it is possible to obtain a unit 2563 in which the relative positions of the restriction blade 2560, the upper sealing member 2520, the end seals 2574, etc., with respect to the developing roller 2510 are set to an appropriate position with an even higher precision.

Figure 26:
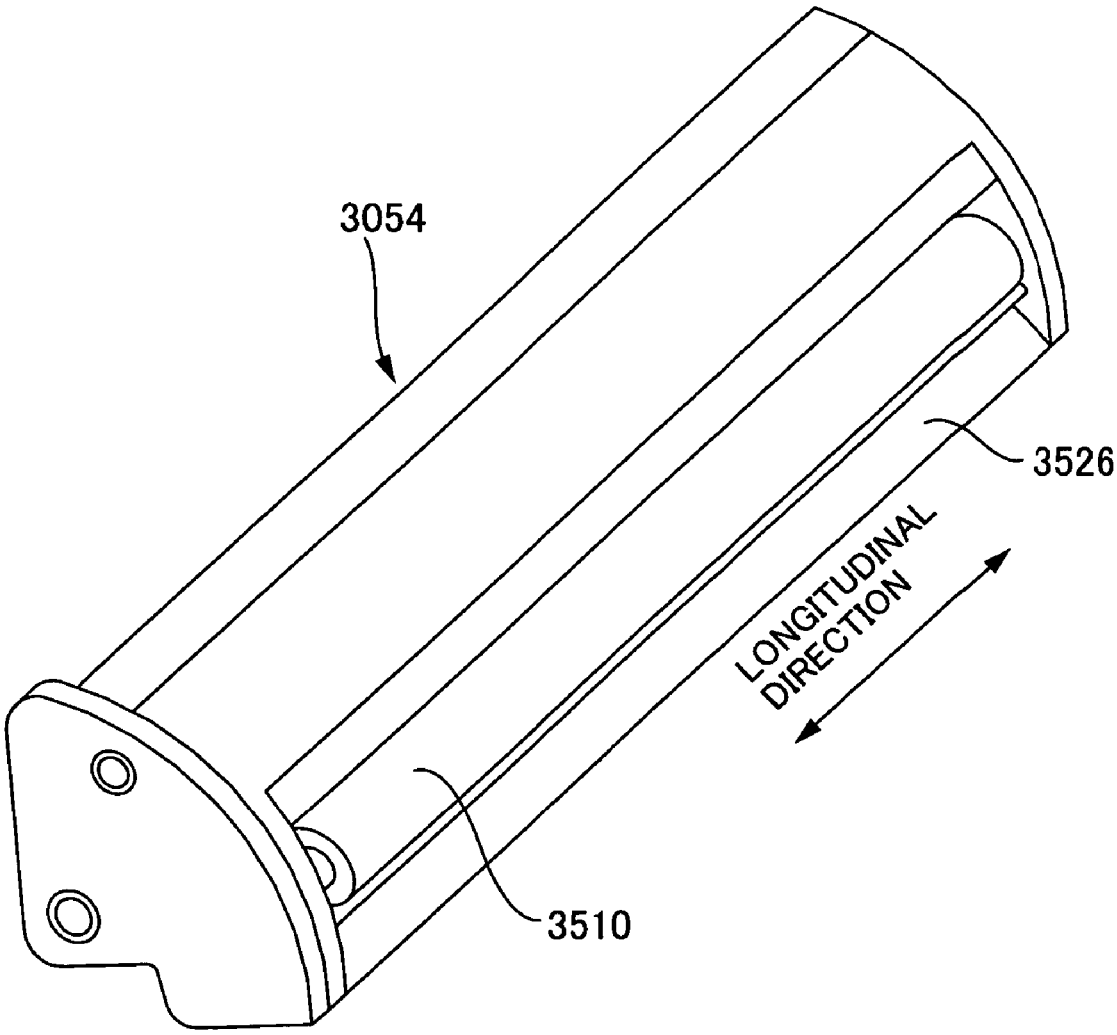
FIG. 26 is a conceptual diagram of a developing device according to a third embodiment.
Figure 27:
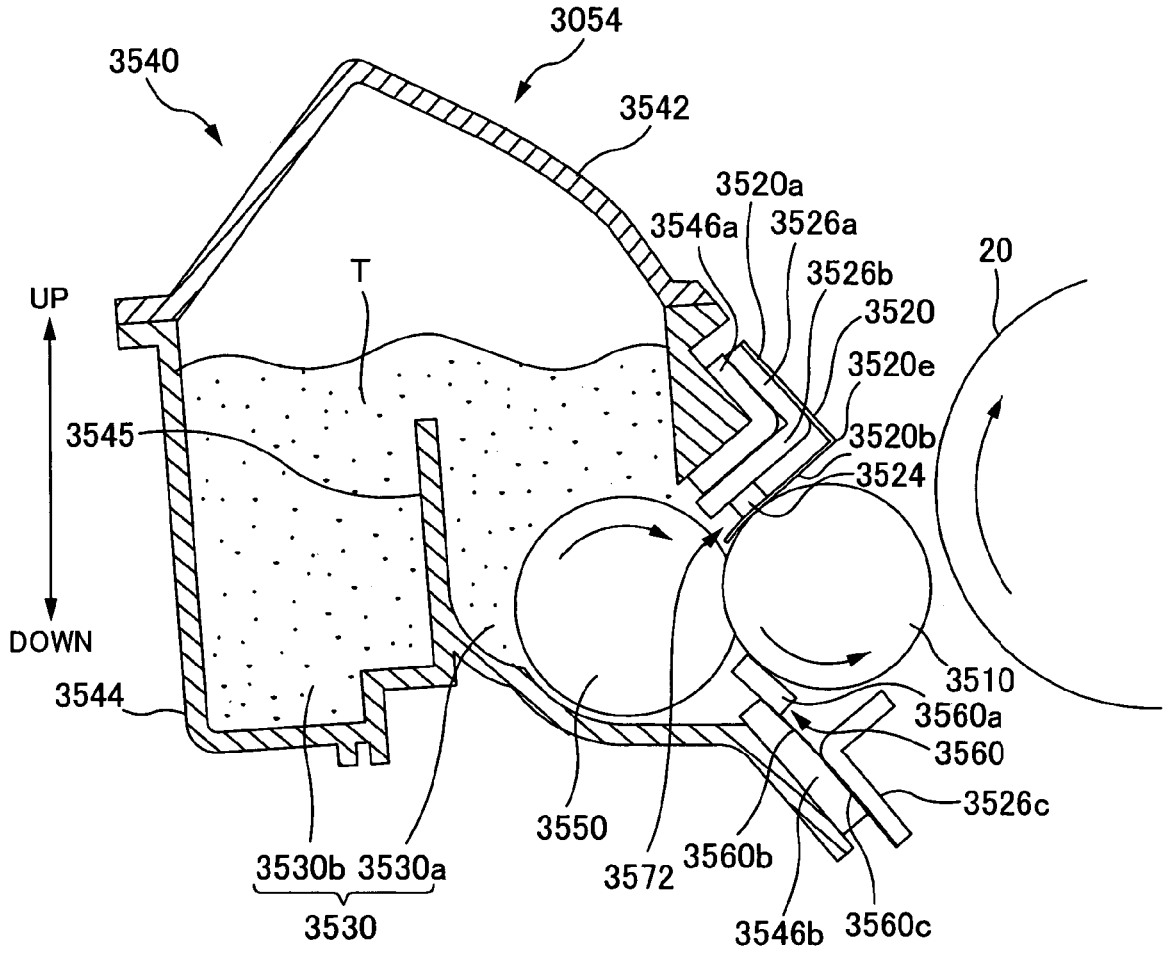
FIG. 27 is a section view showing main structural components of the developing device.

(3) Configuration Example of Developing Device According to the Third Embodiment Next, with reference to FIG. 26 and FIG. 27, a third embodiment of a configuration of the developing device will be described. It should be noted that the configuration of the overall image forming apparatus and the configuration of the control unit are the same for both the present third embodiment, and the first and second embodiments described previously. FIG. 26 is a conceptual diagram of a developing device. FIG. 27 is a section view showing main structural components of the developing device. It should be noted that the section view shown in FIG. 27 is a section of the developing device bisected by a plane perpendicular to the longitudinal direction shown in FIG. 26. Further, in FIG. 27, the arrow indicates the vertical direction as in FIG. 1, and, for example, the central axis of the developing roller 3510 is located below the central axis of the photoconductor 20. Further, in FIG. 27, the yellow developing device 3054 is shown positioned at the developing position, which is in opposition to the photoconductor 20.

The YMCK developing unit 50 is provided with: the black developing device 51 containing black (K) toner; the magenta developing device 52 containing magenta (M) toner; the cyan developing device 53 containing cyan (C) toner; and the yellow developing device 3054 containing yellow (Y) toner. Since the configuration of each of the developing devices is the same, description will be made only about the yellow developing device 3054 below.

The yellow developing device 3054 has, for example, the developing roller 3510, an upper sealing member 3520 serving as an example of a sealing member, a toner containing body 3530, a housing 3540, a toner supplying roller 3550, and a restriction blade 3560.

The developing roller 3510 bears toner T and delivers it to the developing position opposing the photoconductor 20. The developing roller 3510 is made of, for example, aluminum alloy such as aluminum alloy 5056 or aluminum alloy 6063, or iron alloy such as STKM, and where necessary, the roller 3510 is plated with, for example, nickel plating or chromium plating.

The developing roller 3510 has a shaft section 3510*a* and a large-diameter section 3510*b*. The shaft section 3510*a* is supported, through bearings 3576, by developing-roller supporting sections 3526*d* of a holder 3526 described further below (see FIG. 30), and in this way the developing roller 3510 is supported rotatably. As shown in FIG. 27, the developing roller 3510 rotates in the opposite direction (counterclockwise in FIG. 27) to the rotating direction of the photoconductor 20 (clockwise in FIG. 27). The central axis of the roller 3510 is located below the central axis of the photoconductor 20.

Further, in the state where the yellow developing device 3054 is in opposition to the photoconductor 20, there is a gap between the developing roller 3510 and the photoconductor 20. That is, the yellow developing device 3054 develops the latent image formed on the photoconductor 20 in a non-contacting state. It should be noted that an alternating field is generated between the developing roller 3510 and the photoconductor 20 upon development of the latent image formed on the photoconductor 20.

The housing 3540 is manufactured by welding together a plurality of integrally-molded housing sections made of resin, that is, an upper housing section 3542 and a lower housing section 3544. In the housing 3540 is formed a toner containing body 3530 for containing the toner T. The toner containing body 3530 is divided into two toner containing sections, namely, the first toner containing section 3530*a* and the second toner containing section 3530*b*, by a partitioning wall 3545 that is for partitioning the toner T and that protrudes inwards (in the up/down direction of FIG. 27) from the inner wall. The first toner containing section 3530*a* and the second toner containing section 3530*b* are connected at their upper sections, and in the state shown in FIG. 27, movement of the toner T is restricted by the partitioning wall 3545. However, when the YMCK developing unit 50 is rotated, the toner contained in the first toner containing section 3530*a* and the second toner containing section 3530*b* is once gathered on the side of the section where the containing sections are connected, which is on the upper-section side when in the developing position, and when the YMCK developing unit 50 returns to the state shown in FIG. 27, the toner gets mixed and is returned to the first toner containing section 3530*a* and the second toner containing section 3530*b*. In other words, the toner T is appropriately stirred within the developing device by the rotation of the YMCK developing unit 50.

Therefore, in the present embodiment, no stirring member is provided in the toner containing body 3530. However, it is possible to provide a stirring member for stirring the toner T contained in the toner containing body 3530. Further, as shown in FIG. 27, the housing 3540 (more specifically, the first toner containing section 3530*a*) has an opening 3572 in its lower section, and the developing roller 3510 is provided facing the opening 3572.

The toner supplying roller 3550 is provided in the first toner containing section 3530*a* described above and supplies the toner T contained in the first toner containing section 3530*a* to the developing roller 3510. It also strips off, from the developing roller 3510, the toner T remaining on the developing roller 3510 after development. The toner supplying roller 3550 is made of, for example, polyurethane foam, and is made to abut against the developing roller 3510 in an elastically deformed state. The toner supplying roller 3550 is arranged at a lower section of the first toner containing section 3530*a*. The toner T contained in the first toner containing section 3530*a* is supplied to the developing roller 3510 by the toner supplying roller 3550 at the lower section of the first toner containing section 3530*a*. The toner supplying roller 3550 is rotatable about its central axis. The central axis of the toner supplying roller 3550 is situated below the central axis of rotation of the developing roller 3510. Further, the toner supplying roller 3550 rotates in the opposite direction (clockwise in FIG. 27) to the rotating direction of the developing roller 3510 (counterclockwise in FIG. 27).

The upper sealing member 3520 allows the toner T remaining on the developing roller 3510 after passing the developing position to move into the housing 3540 and also restricts the toner T in the housing 3540 from moving outside therefrom. The configuration of the upper sealing member 3520 and its periphery will be described in detail further below.

The restriction blade 3560 abuts against the developing roller 3510 along the axial direction thereof, and restricts the thickness of the layer of the toner T borne by the developing roller 3510 as well as gives an electric charge to the toner T borne by the developing roller 3510. The restriction blade 3560 includes a rubber section 3560*a* and a rubber-supporting section 3560*b*. The rubber section 3560*a* is made of, for example, silicone rubber or urethane rubber. The rubber-supporting section 3560*b* is a thin plate that is made of, for example, phosphor bronze or stainless steel, and that has a spring-like characteristic.

The rubber section 3560*a* is supported by the rubber-supporting section 3560*b*. The rubber-supporting section 3560*b* presses, with its urging force, the rubber section 3560*a* against the developing roller 3510. The rubber-supporting section 3560*b* is attached to a restriction-blade supporting section 3526*c* of the holder 3526, which is described later, in a state where one end of the rubber-supporting section 3560*b* is supported by the restriction-blade supporting section 3526*c*.

The end of the restricting blade 3560 opposite from the end that is being supported by the restriction-blade supporting section 3526*c*, i.e., the tip end of the restriction blade 3560, is not placed in contact with the developing roller 3510; rather, a section at a predetermined distance away from the tip end contacts, with some breadth, the developing roller 3510. That is, the restriction blade 3560 does not abut against the developing roller 3510 at its edge, but abuts against the roller 3510 near its central portion. Further, the restriction blade 3560 is arranged so that its tip end faces toward the upstream side of the rotating direction of the developing roller 3510, and thus, makes a so-called counter-abutment with respect to the roller 3510. It should be noted that the abutting position at which the restriction blade 3560 abuts against the developing roller 3510 is below the central axis of the developing roller 3510 and is also below the central axis of the toner supplying roller 3550. It should be noted that the restriction blade 3560 functions as to prevent the toner T from spilling from the toner containing body 3530 by abutting against the developing roller 3510 along its axial direction.

Further, the restriction blade 3560 supports end seals 3574 (see FIG. 29) at the ends 3560*d* in its longitudinal direction. The end seals 3574 are made of nonwoven fabric and abut against the ends, in the axial direction, of the developing roller 3510 along the circumferential direction of the developing roller 3510, so as to function as to prevent the toner T from spilling from between the circumferential surface of the roller and the housing 3540.

In the yellow developing device 3054 structured as above, the toner supplying roller 3550 supplies the toner T contained in the toner containing body 3530 to the developing roller 3510. With the rotation of the developing roller 3510, the toner T, which has been supplied to the developing roller 3510, reaches the abutting position of the restriction blade 3560; then, as the toner T passes the abutting position, the toner is electrically charged and its layer thickness is restricted. With further rotation of the developing roller 3510, the toner T on the developing roller 3510, which has been electrically charged and whose layer thickness has been restricted, reaches the developing position opposing the photoconductor 20; then, under the alternating field, the toner T is used at the developing position for developing the latent image formed on the photoconductor 20. With further rotation of the developing roller 3510, the toner T on the developing roller 3510, which has passed the developing position, passes the upper sealing member 3520 and is collected into the developing device by the upper sealing member 3520 without being scraped off. Then, the toner T that still remains on the developing roller 3510 can be stripped off by the toner supplying roller 3550.

Figure 28:
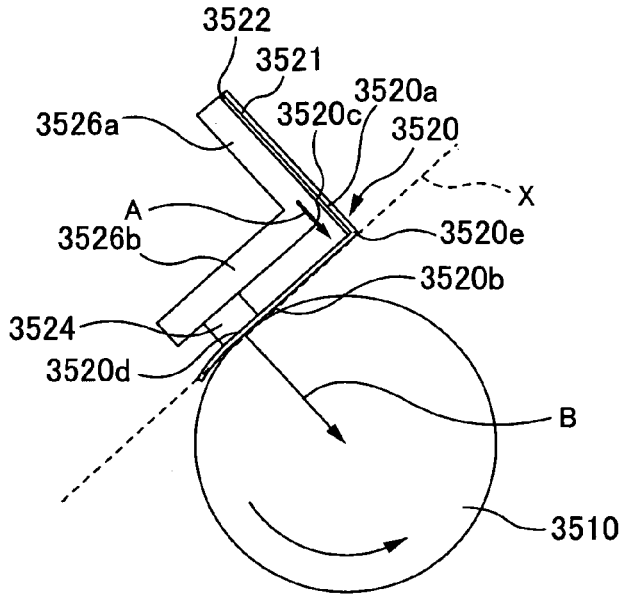
FIG. 28 is a section view showing in enlargement the periphery of the upper sealing member 3520 of FIG. 27.
Figure 29:
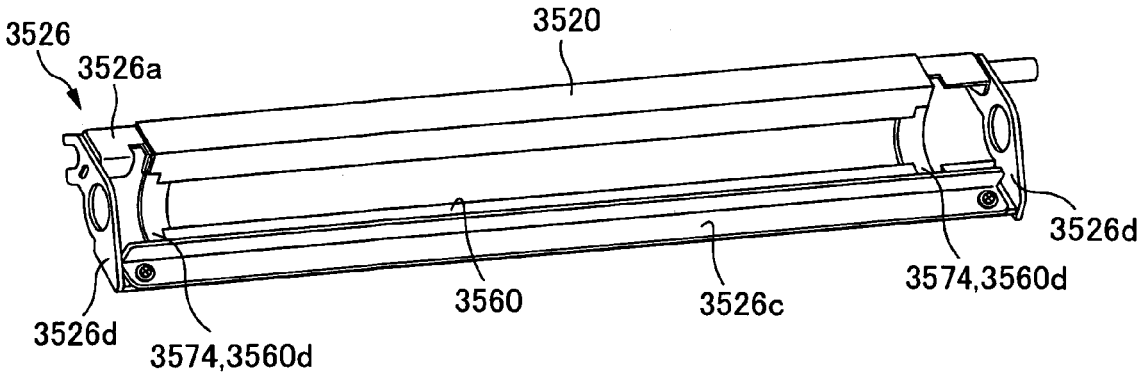
FIG. 29 is a perspective view showing how the upper sealing member 3520, the restriction blade 3560, and the end seals 3574 are supported by the holder 3526.
Figure 30:
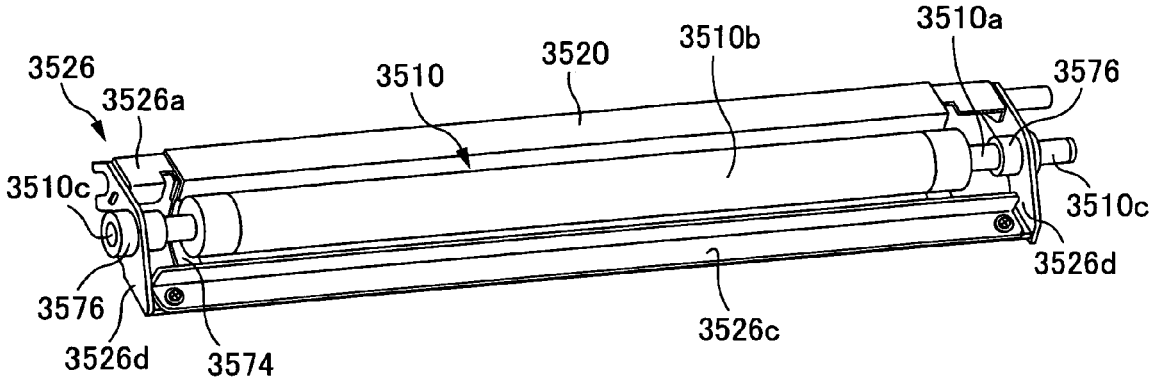
FIG. 30 is a perspective view showing how the upper sealing member 3520, the restriction blade 3560, the end seals 3574, and the developing roller 3510 are supported by the holder 3526.
Figure 31:
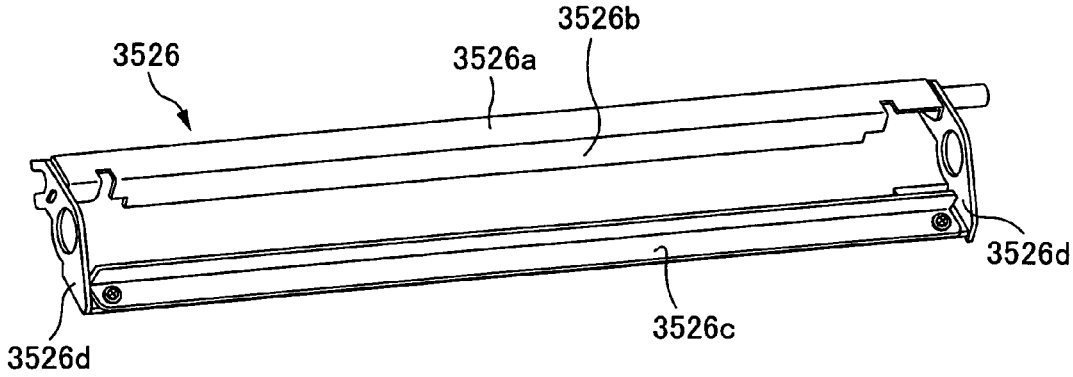
FIG. 31 is a perspective view showing the holder 3526.
Figure 32:
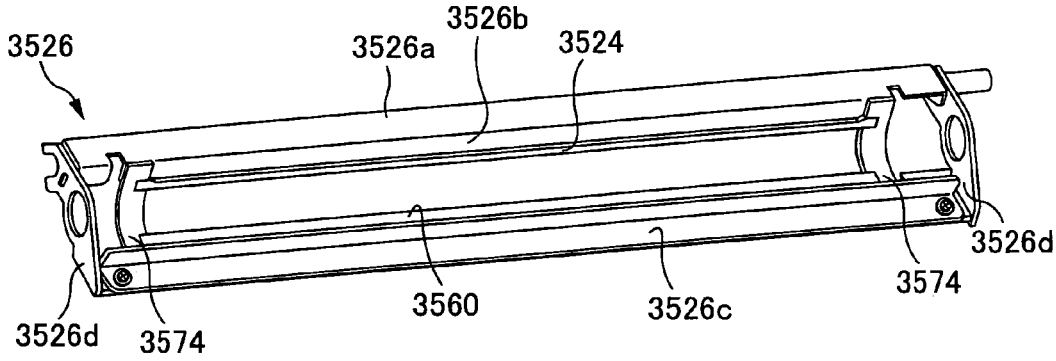
FIG. 32 is a perspective view showing an upper-seal urging member 3524 fixed to the holder 3526.
Figure 33:
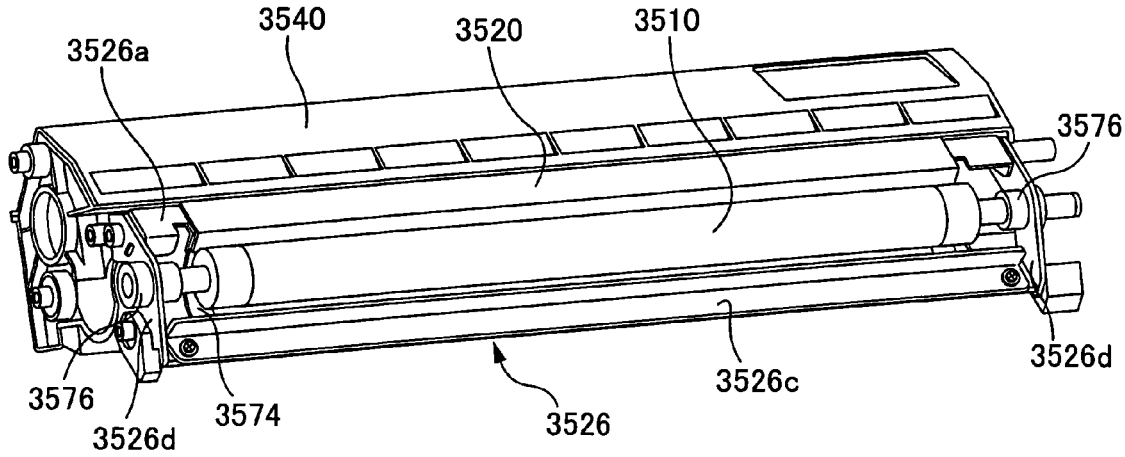
FIG. 33 is a perspective view showing how the holder 3526 is attached to the housing 3540 via a housing seal 3546.
Figure 34:
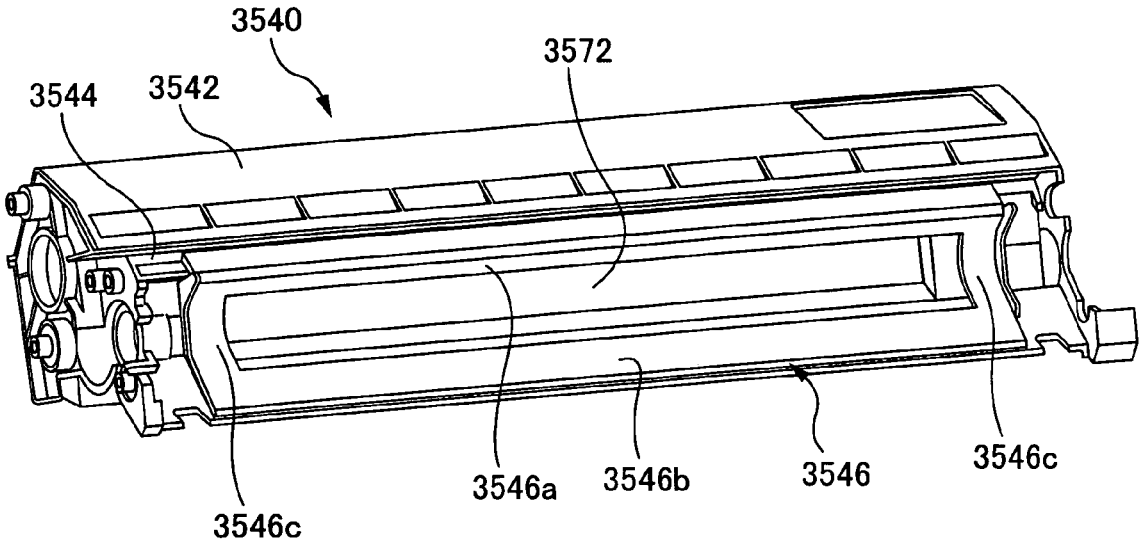
FIG. 34 is a perspective view showing how the housing seal 3546 is fixed to the housing 3540.
Figure 35:
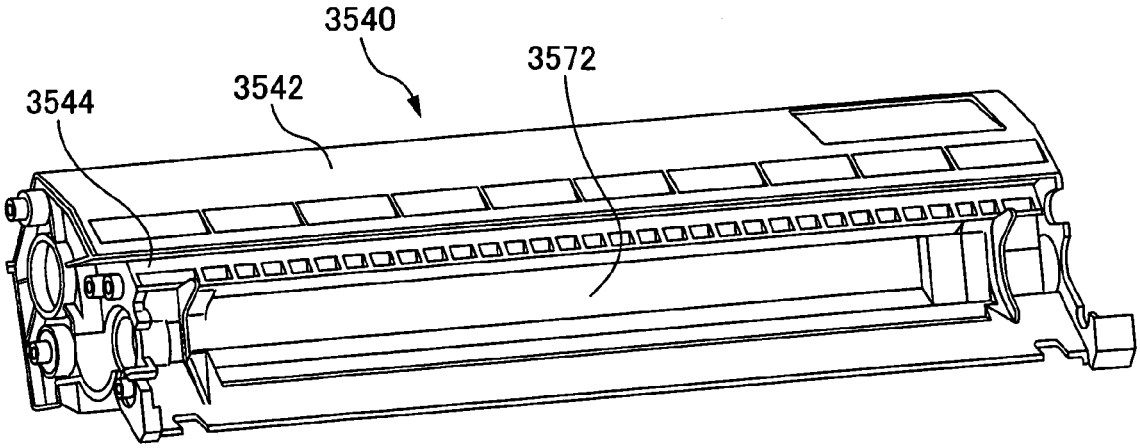
FIG. 35 is a perspective view showing a portion of the housing 3540 where the housing seal 3546 is to be fixed.

(3) Configuration of Upper Sealing Member and its Periphery According to the Third Embodiment Next, the configuration of the upper sealing member 3520, which serves as an example of a sealing member, and its periphery is described with reference to FIG. 27 through FIG. 35. FIG. 28 is a section view showing in enlargement the periphery of the upper sealing member 3520 of FIG. 27. FIG. 29 is a perspective view showing how the upper sealing member 3520, the restriction blade 3560, and the end seals 3574 are supported by the holder 3526. FIG. 30 is a perspective view showing how the upper sealing member 3520, the restriction blade 3560, the end seals 3574, and the developing roller 3510 are supported by the holder 3526. FIG. 31 is a perspective view showing the holder 3526. FIG. 32 is a diagram in which the upper sealing member 3520 has been removed from the perspective view shown in FIG. 29, and is a perspective view showing an upper-seal urging member 3524 fixed to the holder 3526. FIG. 33 is a perspective view showing how the holder 3526 is attached to the housing 3540 via a housing seal 3546. FIG. 34 is a diagram in which the holder 3526 has been removed from the perspective view shown in FIG. 33, and is a perspective view showing how the housing seal 3546 is fixed to the housing 3540. FIG. 35 is a diagram in which the holder 3526 and the housing seal 3546 have been removed from the perspective view shown in FIG. 33, and is a perspective view showing a portion of the housing 3540 where the housing seal 3546 is to be fixed.

As described above, the upper sealing member 3520 allows the toner T remaining on the developing roller 3510 after passing the developing position to move into the housing 3540 and also restricts the toner T in the housing 3540 from moving outside therefrom.

As shown in FIG. 27 through FIG. 29, the upper sealing member 3520 is supported, in a bent state on the side of one end 3520*a* in the lateral direction thereof, by the holder 3526 which serves as an example of the supporting member, and the upper sealing member 3520 abuts against the developing roller 3510 on the side of the other end 3520*b* in its lateral direction.

As shown in FIG. 28, the supported section 3520*c* of the upper sealing member 3520 that is supported by the holder 3526 is above the abutting section 3520*d* of the upper sealing member 3520 with which it abuts against the developing roller 3510. Further, when viewed from a virtual tangential line X drawn with respect to the developing roller 3510 at an abutting position on the developing roller 3510 where the abutting section 3520*d* abuts against the developing roller 3510, the supported section 3520*c* is positioned on the opposite side from the developing roller 3510. Furthermore, the upper sealing member 3520 is supported by the holder 3526 such that the lateral direction of the upper sealing member 3520 at the supported section 3520*c* (this direction is indicated by the arrow A in FIG. 28) is arranged in the direction from the abutting section 3520*d* toward the central axis of the developing roller 3510 (this direction is indicated by the arrow B in FIG. 28).

The upper sealing member 3520 is made by attaching together, with a double-faced tape, a sheet material 3521 made of polyethylene and a PET film 3522 which serves as a rigidity-strengthening member for increasing the flexural rigidity of the upper sealing member 3520. As shown in FIG. 28, of the side of the lateral-direction end 3520*a* and the side of the other lateral-direction end 3520*b*, the upper sealing member 3520 has the PET film 3522 only on the side of the lateral-direction end 3520*a*, and the thickness of the upper sealing member 3520 on the side of the lateral-direction end 3520*a* is made larger than the thickness of the upper sealing member 3520 on the side of the other lateral-direction end 3520*b*.

According to such a configuration of the upper sealing member 3520, the flexural rigidity of the upper sealing member 3520 on the side of the lateral-direction end 3520*a* is larger than the flexural rigidity of the upper sealing member 3520 on the side of the other lateral-direction end 3520*b*. Therefore, the amount of bending of the upper sealing member 3520 on the side of the lateral-direction end 3520*a* is small, and the upper sealing member 3520 will bend sharply at the boundary 3520*e* between the section of the upper sealing member 3520 provided with the PET film 3522 and the section without the PET film 3522. As a result, the lateral direction of the upper sealing member 3520 on the side of the other lateral-direction end 3520*b* is arranged in the direction of the virtual tangential line X described above.

It should be noted that as shown in FIG. 29, the upper sealing member 3520 is arranged such that its longitudinal direction is in the axial direction of the developing roller 3510. Further, the abutting position where the upper sealing member 3520 abuts against the developing roller 3510 is above the central axis of the developing roller 3510.

The holder 3526 is a supporting member made of metal for supporting the upper sealing member 3520. The holder 3526 also has the function of supporting the developing roller 3510, the restriction blade 3560, and the upper-seal urging member 3524 described later on.

As shown in FIG. 31, the holder 3526 has an upper-seal supporting section 3526*a* serving as an example of a first supporting section, an urging-member supporting section 3526*b* serving as an example of a second supporting section, a restriction-blade supporting section 3526*c*, and developing-roller supporting sections 3526*d* provided outside the upper-seal supporting section 3526*a*, urging-member supporting section 3526*b*, and the restriction-blade supporting section 3526*c* in the longitudinal direction (the axial direction) and intersecting with the longitudinal direction (the axial direction). The supporting sections 3526*a*, 3526*b*, and 3526*c* are arranged in the longitudinal direction (i.e., the axial direction of the developing roller 3510). The upper sealing member 3520 is supported by the upper-seal supporting section 3526*a* at its lateral-direction end 3520*a*. It should be noted that as described above, the developing roller 3510 is supported by the developing-roller supporting sections 3526*d* at its axial-direction ends 3510*c*, and the restriction blade 3560 is supported by the restriction-blade supporting section 3526*c* at its lateral-direction end 3560*c*.

Further, as shown in FIG. 27, in between the upper sealing member 3520 and the urging-member supporting section 3526*b*, an upper-seal urging member 3524 made of an elastic body such as Moltoprene and serving as an example of an urging member is provided in a compressed state. The upper-seal urging member 3524 presses the upper sealing member 3520 against the developing roller 3510 by urging the upper sealing member 3520 toward the developing roller 3510 with its urging force. Further, the upper-seal urging member 3524 is supported by the urging-member supporting section 3526*b*. More specifically, the lateral direction of the upper-seal supporting section 3526*a* is arranged in the direction B, whereas the lateral direction of the urging-member supporting section 3526*b* intersects with the direction B, and the upper-seal urging member 3524 is fixed to this urging-member supporting section 3526*b*. It should be noted that as shown in FIG. 32, the upper-seal urging member 3524 is arranged such that its longitudinal direction is in the axial direction of the developing roller 3510.

As shown in FIG. 33 through FIG. 35, the holder 3526 described above is attached to the housing 3540 via a housing seal 3546 in a state where the developing roller 3510, the restriction blade 3560, the end seals 3574, the upper sealing member 3520, and the upper-seal urging member 3524 have been assembled to it.

The housing seal 3546 functions as to prevent the toner T from spilling from between the holder 3526, or the members assembled to the holder 3526, and the housing 3540. As shown in FIG. 34, the housing seal 3546 is a rectangular elastic body made, for example, of Moltoprene with its central portion (a rectangular portion) cut out therefrom. The housing seal 3546 has a first sealing section 3546*a*, a second sealing section 3546*b*, and a third sealing section 3546*c*.

The first sealing section 3546*a* abuts against the upper-seal supporting section 3526*a* of the holder 3526 and the housing 3540 to function as to prevent the toner T from spilling from between the upper-seal supporting section 3526*a* and the housing 3540. The second sealing section 3546*b* abuts against the rubber-supporting section 3560*b* of the restriction blade 3560 and the housing 3540 to function as to prevent the toner T from spilling from between the rubber-supporting section 3560*b* and the housing 3540. The third sealing section 3546*c* abuts against the end seals 3574 and the housing 3540 to function as to prevent the toner T from spilling from between the end seals 3574 and the housing 3540.

It should be noted that, of the holder 3526 and the housing 3540, the housing seal 3546 is fixed only to the housing 3540. Further, the second sealing section 3546*b* not only functions as to prevent the toner T from spilling, but also functions as to stabilize the elastic force caused by flexure of the rubber-supporting section 3560*b* and to make the rubber section 3560*a* abut against the developing roller 3510 more evenly.

As described above, in the present embodiment, the flexural rigidity of the upper sealing member 3520 on the side of one end 3520*a* in the lateral direction thereof is larger than the flexural rigidity of the upper sealing member 3520 on the side of the other end 3520*b* in the lateral direction thereof. In this way, it is possible to make the upper sealing member 3520 abut against the developing roller 3510 appropriately.

More specifically, as described in the "Description of the Related Art" etc., in a situation in which the upper sealing member 3520 is supported in a bent state on the side of one end 3520*a* in the lateral direction thereof by the developing device and in which the upper sealing member 3520 abuts against the developing roller 3510 on the side of the other end 3520*b* in the lateral direction thereof, the abutment of the upper sealing member 3520 against the developing roller 3510 may become inappropriate due to how the upper sealing member 3520 bends.

Figure 36:
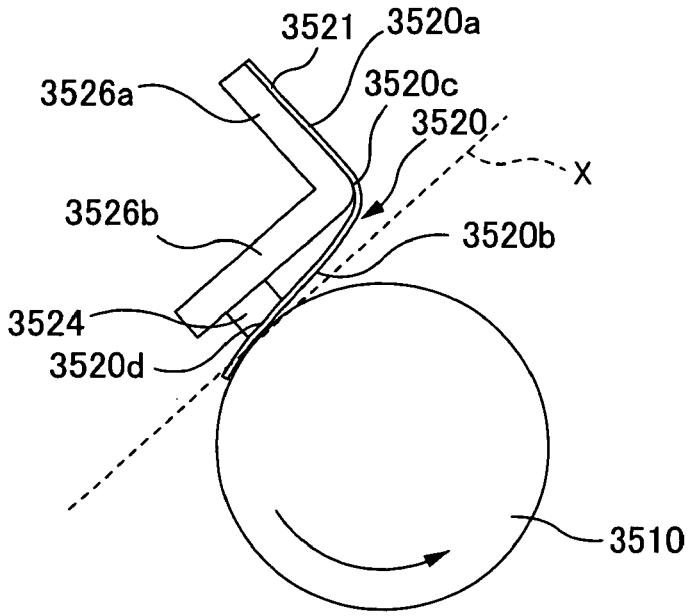
FIG. 36 is a section view showing in enlargement the periphery of an upper sealing member 3520 of a developing device according to a comparative example.

An inappropriate example (which is also referred to as the comparative example) is described with reference to FIG. 36. FIG. 36 is a diagram corresponding to FIG. 28, and is a section view showing in enlargement the periphery of the upper sealing member 3520.

In this comparative example, an upper sealing member 3520 made only of a polyethylene sheet material 3521, instead of an upper sealing member 3520 made by attaching together a polyethylene sheet material 3521 and a PET film 3522, is provided on the developing device. When an upper sealing member 3520 of such a structure is used, there is no difference between the flexural rigidity of the upper sealing member 3520 on the side of one end 3520*a* in the lateral direction thereof and the flexural rigidity of the upper sealing member 3520 on the side of the other end 3520*b* in the lateral direction thereof. Therefore, as shown in FIG. 36, the upper sealing member 3520 starts to bend at a point beyond the supported section 3520*c*, and thus, there is no section where the upper sealing member 3520 bends sharply, as in the upper sealing member 3520 of the present embodiment. Therefore, the lateral direction of the upper sealing member 3520 on the side of the other end 3520*b* in the lateral direction thereof is not arranged in the direction of the virtual tangential line X, and thus, the abutment of the upper sealing member 3520 against the developing roller 3510 becomes inappropriate (that is, the lateral-direction width of abutment of the upper sealing member 3520 may be too short, or the abutting pressure of the upper sealing member 3520 may be uneven).

On the other hand, in the developing device according to the present embodiment, the flexural rigidity of the upper sealing member 3520 on the side of one end 3520*a* in the lateral direction thereof is larger than the flexural rigidity of the upper sealing member 3520 on the side of the other end 3520*b* in the lateral direction thereof. Therefore, the bending amount of the upper sealing member 3520 on the side of one end 3520*a* in the lateral direction thereof is small, and the upper sealing member 3520 bends sharply at the boundary 3520*e* of the upper sealing member 3520 between the section where the flexural rigidity is large and the section where it is small. As a result, the lateral direction of the upper sealing member 3520 on the side of the other end 3520*b* in the lateral direction thereof is arranged in the direction of the above-described virtual tangential line X, and thus, the abutment of the upper sealing member 3520 against the developing roller 3510 becomes appropriate. Accordingly, the upper sealing member 3520 can appropriately achieve its function of preventing the toner from spilling.

(3) Other Considerations Regarding Third Embodiment

In the foregoing embodiment, an upper sealing member 3520 arranged such that its longitudinal direction is in an axial direction of the developing roller 3510 was described as an example of a sealing member. This, however, is not a limitation. The present invention is applicable to any type of sealing member that prevents the toner from spilling from the housing, that is supported on a side of one end in its lateral direction by the developing device in a bent state, and that abuts against a developing roller on a side of the other end in its lateral direction.

Further, in the foregoing embodiment, an upper sealing member 3520 that has the functions of allowing the toner T remaining on the developing roller 3510 to move into the housing 3540, and restricting the toner T in the housing 3540 from moving outside from the housing 3540, was described as an example of a sealing member. This, however, is not a limitation, and the sealing member does not necessarily have to be provided with the above two functions.

Figure 37:
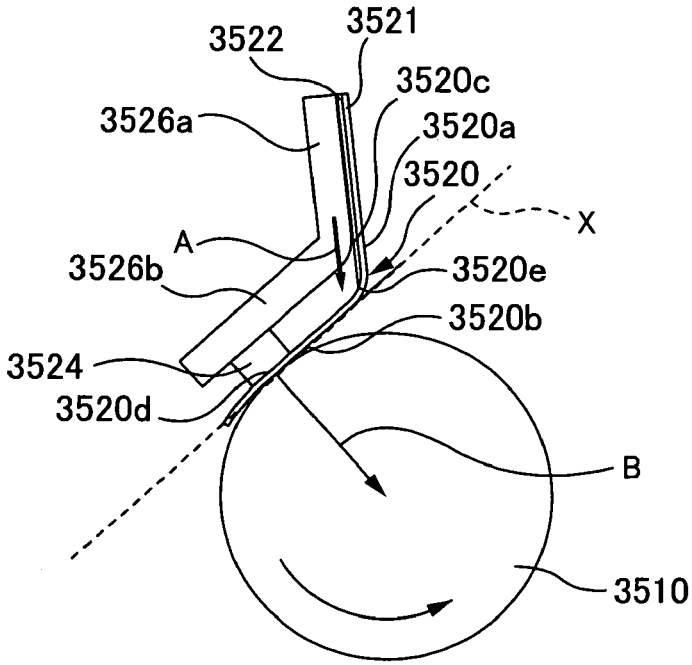
FIG. 37 is a section view showing in enlargement the periphery of an upper sealing member 3520 of a developing device according to another embodiment.

Further, in the foregoing embodiment, the lateral direction of the upper sealing member 3520 at a supported section 3520*c* of the upper sealing member 3520 that is supported by the developing device was arranged in a direction from an abutting section 3520*d* of the upper sealing member 3520 where the upper sealing member 3520 abuts against the developing roller 3510 toward a central axis of the developing roller 3510. This, however, is not a limitation. For example, as shown in FIG. 37, the lateral direction of the upper sealing member 3520 at the supported section 3520*c* thereof does not have to be arranged in the direction from the abutting section 3520*d* of the upper sealing member 3520 toward the central axis of the developing roller 3510.

Figure 38:
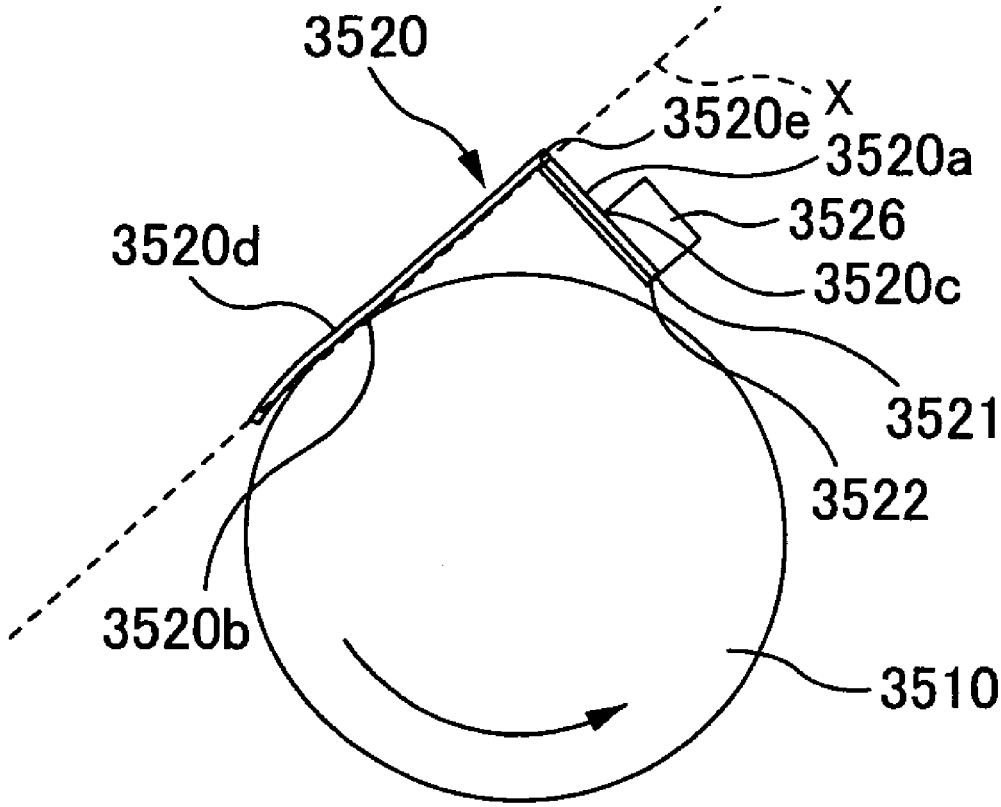
FIG. 38 is a section view showing in enlargement the periphery of an upper sealing member 3520 of a developing device according to another embodiment.

Further, in the foregoing embodiment, the supported section 3520*c* was positioned on an opposite side from the developing roller 3510 as viewed from a virtual tangential line X drawn with respect to the developing roller 3510 at an abutting position on the developing roller 3510 where the abutting section 3520*d* abuts against the developing roller 3510. This, however, is not a limitation. For example, as shown in FIG. 38, the supported section 3520*c* may be positioned on the same side as the developing roller 3510 with respect to the virtual tangential line X.

The foregoing embodiment, however, is more preferable from the standpoint that the function of the upper sealing member 3520 of preventing the toner from spilling is achieved more suitably.

Further, in the foregoing embodiment, the developing device included a holder 3526 that is attached to the housing 3540 and that is for supporting the upper sealing member 3520; and the upper sealing member 3520 was supported on the side of one end 3520*a* in the lateral direction thereof by the holder 3526. This, however, is not a limitation. For example, the upper sealing member 3520 may be directly supported by the housing 3540.

The foregoing embodiment, however, is more preferable from the standpoint that, since the upper sealing member

3520 is supported by a holder 3526, which serves as a supporting member that is specialized for supporting an upper sealing member 3520, the upper sealing member 3520 can be supported reliably, and thus, it becomes possible to make the upper sealing member 3520 abut against the developing roller 3510 more appropriately.

Further, in the foregoing embodiment, the developing device included an upper-seal urging member 3524 that is arranged such that a longitudinal direction thereof is in an axial direction of the developing roller 3510 and that is for urging the upper sealing member 3520 toward the developing roller 3510; the holder 3526 had an upper-seal supporting section 3526*a* whose lateral direction is arranged in the direction from the abutting section 3520*d* of the upper sealing member 3520 toward the central axis of the developing roller 3510, and a urging-member supporting section 3526*b* whose lateral direction intersects with the direction from the abutting section 3520*d* of the upper sealing member 3520 toward the central axis of the developing roller 3510; the upper sealing member 3520 was supported on the side of one end 3520*a* in the lateral direction thereof by the upper-seal supporting section 3526*a;* and the upper-seal urging member 3524 was provided between the upper sealing member 3520 and the urging-member supporting section 3526*b* and was supported by the urging-member supporting section 3526*b*. This, however, is not a limitation. For example, the upper-seal urging member 3524 does not have to be provided.

The foregoing embodiment, however, is more preferable from the standpoint that it becomes possible to make the upper sealing member 3520 abut against the developing roller 3510 more appropriately.

Further, in the foregoing embodiment, a thickness of the upper sealing member 3520 on the side of one end 3520*a* in the lateral direction thereof was larger than a thickness of the upper sealing member 3520 on the side of the other end 3520*b* in the lateral direction thereof. This, however, is not a limitation. For example, the thickness of both ends may be the same, and the flexural rigidity thereof may be made to differ by using different materials for the upper sealing member 3520 on the side of one end 3520*a* in the lateral direction thereof and for the upper sealing member 3520 on the side of the other lateral-direction end 3520*b*.

The foregoing embodiment, however, is more preferable from the standpoint that it is possible to make the flexural rigidity of the upper sealing member 3520 on the, side of one end 3520*a* in the lateral direction thereof larger than the flexural rigidity of the upper sealing member 3520 on the side of the other end 3520*b* in the lateral direction thereof in a simple way.

Further, in the foregoing embodiment, of among the side of one end 3520*a* in the lateral direction of the upper sealing member 3520 and the side of the other end 3520*b* in the lateral direction thereof, the upper sealing member 3520 had a rigidity-strengthening member for increasing the flexural rigidity of the upper sealing member 3520 provided only on the side of one end 3520*a* in the lateral direction thereof. This, however, is not a limitation. For example, the upper sealing member 3520 may be made of a single member such as a polyethylene sheet, and the flexural rigidity may be made to differ by differing the thickness of the lateral-direction end 3520*a* and the thickness of the other lateral-direction end 3520*b*.

The foregoing embodiment, however, is more preferable from the standpoint that it is possible to make the flexural rigidity of the upper sealing member 3520 on the side of one end 3520*a* in the lateral direction thereof larger than the flexural rigidity of the upper sealing member 3520 on the side of the other end 3520*b* in the lateral direction thereof in a simple way.

Further, in the foregoing embodiment, the upper sealing member 3520 was made by attaching together a sheet material 3521 made of polyethylene and a PET film 3522 as the rigidity-strengthening member. This, however, is not a limitation.

The foregoing embodiment, however, is more preferable from the standpoint that it is possible to make the flexural rigidity of the upper sealing member 3520 on the side of one end 3520*a* in the lateral direction thereof larger than the flexural rigidity of the upper sealing member 3520 on the side of the other end 3520*b* in the lateral direction thereof in a simple way.

Fourth Embodiment

Figure 39:
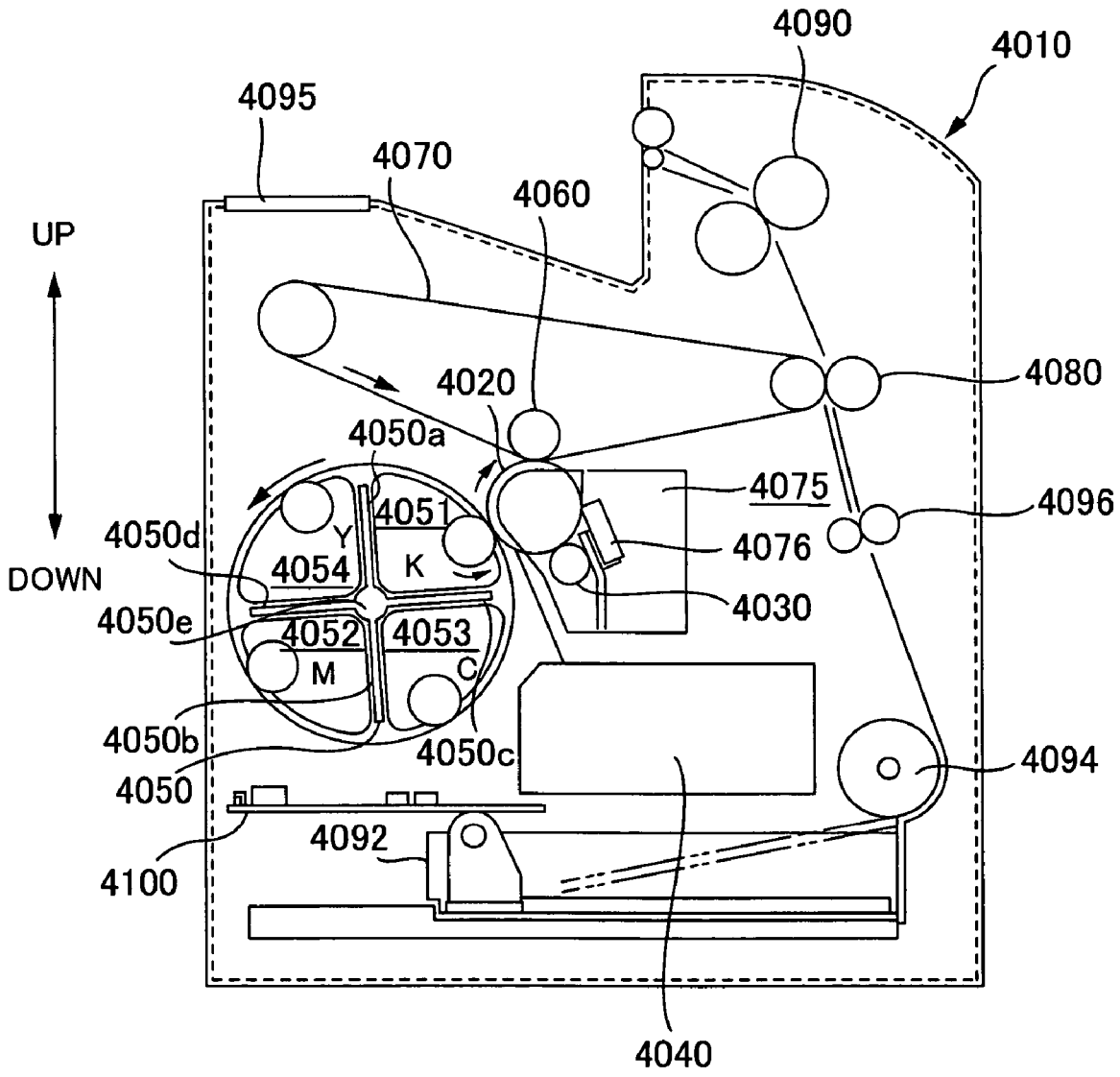
FIG. 39 is a diagram showing main structural components constructing a printer 4010 according to a fourth embodiment.

(4) Overview of Image Forming Apparatus (Laser Beam Printer) According to Fourth Embodiment Next, using FIG. 39, an overall configuration of a laser beam printer 4010 (referred to also as "printer 4010" below), which is an example of an image forming apparatus, and operations thereof are described. FIG. 39 is a diagram showing main structural components constructing the printer 4010. It should be noted that in FIG. 39, the vertical direction is shown by the arrow, and, for example, a paper supply tray 4092 is arranged at a lower section of the printer 4010, and a fusing unit 4090 is arranged at an upper section of the printer 4010.

<Overall Configuration of Printer 4010>

As shown in FIG. 39, the printer 4010 according to the present embodiment includes a charging unit 4030, an exposing unit 4040, a rotating body 4050, a first transferring unit 4060, an intermediate transferring body 4070, and a cleaning unit 4075. These units are arranged in the direction of rotation of a photoconductor 4020, which serves as an example of an image bearing body for bearing a latent image. The printer 4010 further includes a second transferring unit 4080, a fusing unit 4090, a displaying unit 4095 constructed of a liquid-crystal panel and serving as means for making notifications to the user etc., and a control unit 4100 for controlling these units etc. and managing the operations as a printer.

The photoconductor 4020 has a cylindrical conductive base and a photoconductive layer formed on the outer peripheral surface of the conductive base, and it is rotatable about its central axis. In the present embodiment, the photoconductor 4020 rotates clockwise, as shown by the arrow in FIG. 39.

The charging unit 4030 is a device for charging the photoconductor 4020. The exposing unit 4040 is a device for forming a latent image on the charged photoconductor 4020 by radiating a laser beam thereon. The exposing unit 4040 has, for example, a semiconductor laser, a polygon mirror, and an F-θ lens, and radiates a modulated laser beam onto the charged photoconductor 4020 in accordance with image signals having been input from a not-shown host computer such as a personal computer or a word processor.

The rotating body 4050 is a device for developing the latent image formed on the photoconductor 4020 using black (K) toner contained in a black developing unit 4051, magenta (M) toner contained in a magenta developing unit 4052, cyan (C) toner contained in a cyan developing unit 4053, and yellow (Y) toner contained in a yellow developing unit 4054.

In the present embodiment, the rotating body 4050 rotates to allow the positions of the four developing units 4051, 4052, 4053, and 4054, which serve as an example of developing devices, to be moved. More specifically, the rotating body 4050 holds the four developing units 4051, 4052, 4053, and 4054 with four attach/detach sections 4050*a*, 4050*b*, 4050*c*, and 4050*d*, respectively, and the four developing-units 4051, 4052, 4053, and 4054 can be rotated about a rotating shaft 4050*e* while maintaining their relative positions. A different one of the developing units is made to selectively oppose the photoconductor 4020 each time the photoconductor 4020 makes one revolution, thereby successively developing the latent image formed on the photoconductor 4020 using the toner T, which is an example of a developer, contained in each of the developing units 4051, 4052, 4053, and 4054. It should be noted that details on the developing units are described further below.

The first transferring unit 4060 is a device for transferring, onto the intermediate transferring body 4070, a single-color toner image formed on the photoconductor 4020. When toner images of four colors are successively transferred in a superposed manner, a full-color toner image is formed on the intermediate transferring body 4070. The intermediate transferring body 4070 is an endless belt that is driven to rotate at substantially the same circumferential speed as the photoconductor 4020. The second transferring unit 4080 is a device for transferring the single-color toner image, or the full-color toner image, formed on the intermediate transferring body 4070 onto a recording medium such as paper, film, and cloth.

The fusing unit 4090 is a device for fusing the single-color toner image or the full-color toner image, which has been transferred to the recording medium, onto the recording medium such as paper to make it into a permanent image. The cleaning unit 4075 is a device that is provided between the first transferring unit 4060 and the charging unit 4030, that has a rubber cleaning blade 4076 made to abut against the surface of the photoconductor 4020, and that is for removing the toner remaining on the photoconductor 4020 by scraping it off with the cleaning blade 4076 after the toner image has been transferred onto the intermediate transferring body 4070 by the first transferring unit 4060.

Figure 40:
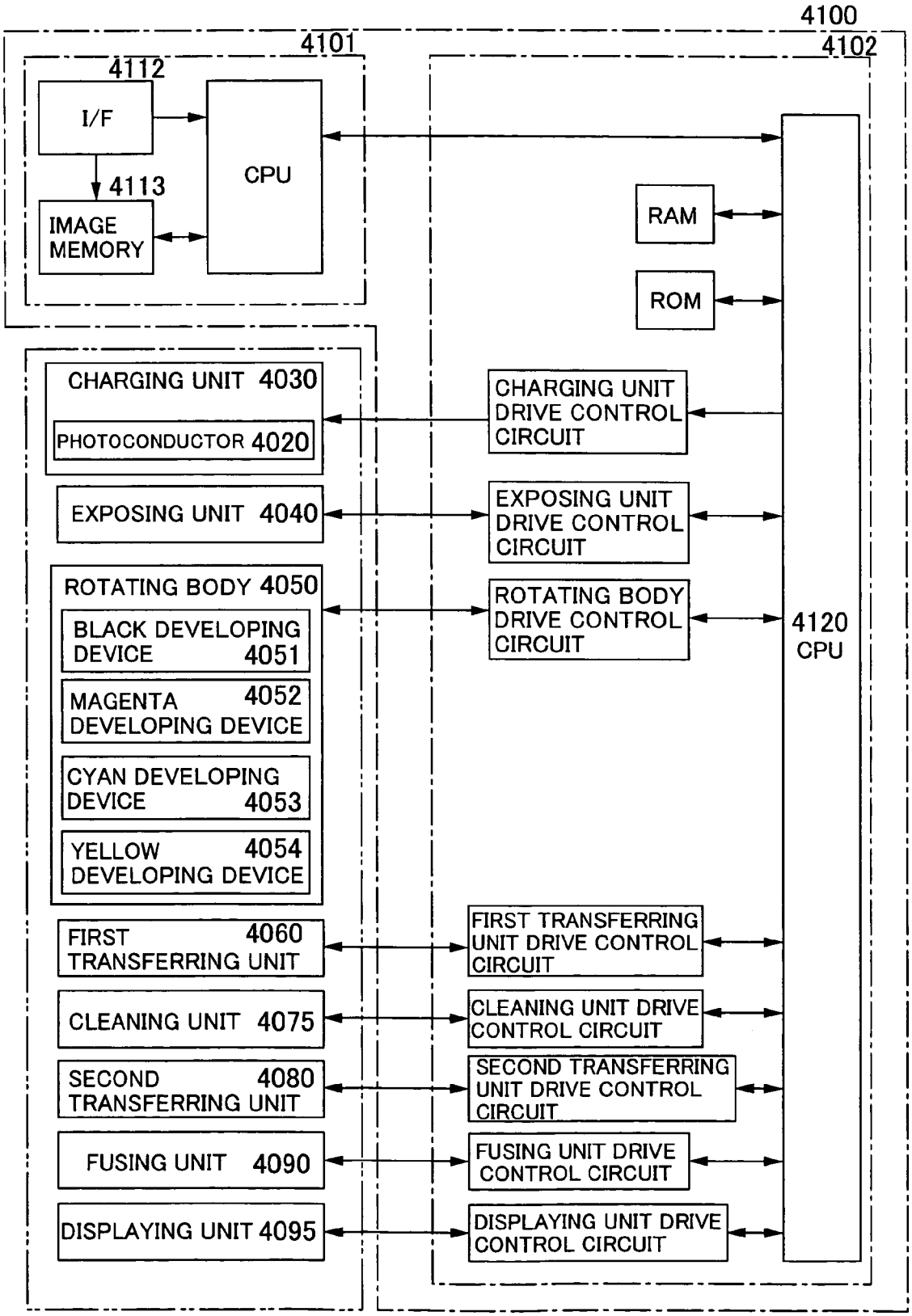
FIG. 40 is a block diagram showing a control unit 4100 of the printer 4010.

The control unit 4100 includes a main controller 4101 and a unit controller 4102 as shown in FIG. 40. Image signals are input to the main controller 4101, and according to instructions based on these image signals, the unit controller 4102 controls each of the above-mentioned units etc. to form an image.

<Operation of Printer 4010>

Next, operations of the printer 4010 structured as above are described, referring also to other structural components.

When image signals are input from the not-shown host computer to the main controller 4101 of the printer 4010 through an interface (I/F) 4112, then the photoconductor 4020, a developing roller, which is provided in each of the developing units 4051; 4052, 4053, and 4054, and the intermediate transferring body 4070 rotate under the control of the unit controller 4102 according to the instructions from the main controller 4101. While being rotated, the photoconductor 4020 is successively charged by the charging unit 4030 at a charging position.

With the rotation of the photoconductor 4020, the charged area of the photoconductor 4020 reaches an exposing position. A latent image that corresponds to the image information for the first color, for example, yellow Y, is formed in that area by the exposing unit 4040. The rotating body 4050 positions the yellow developing unit 4054, which contains yellow (Y) toner, at the developing position opposing the photoconductor 4020.

With the rotation of the photoconductor 4020, the latent image formed on the photoconductor 4020 reaches the developing position, and is developed with the yellow toner by the yellow developing unit 4054. Thus, a yellow toner image is formed on the photoconductor 4020.

With the rotation of the photoconductor 4020, the yellow toner image formed on the photoconductor 4020 reaches a first transferring position, and is transferred onto the intermediate transferring body 4070 by the first transferring unit 4060. At this time, a first transferring voltage, which is in an opposite polarity to the polarity to which the toner is charged, is applied to the first transferring unit 4060. It should be noted that, during this process, the second transferring unit 4080 is kept separated from the intermediate transferring body 4070.

By repeating the above-mentioned processes for the second, the third, and the fourth colors, toner images in four colors corresponding to the respective image signals are transferred to the intermediate transferring body 4070 in a superimposed manner. As a result, a full-color toner image is formed on the intermediate transferring body 4070.

With the rotation of the intermediate transferring body 4070, the full-color toner image formed on the intermediate transferring body 4070 reaches a second transferring position, and is transferred onto a recording medium by the second transferring unit 4080. It should be noted that the recording medium is carried from the paper supply tray 4092 to the second transferring unit 4080 via the paper-feed roller 4094 and resisting rollers 4096. During transferring operations, a second transferring voltage is applied to the second transferring unit 4080 and also the unit 4080 is pressed against the intermediate transferring body 4070.

The full-color toner image transferred onto the recording medium is heated and pressurized by the fusing unit 4090 and fused to the recording medium. On the other hand, after the photoconductor 4020 passes the first transferring position, the toner adhering to the surface of the photoconductor 4020 is scraped off by the cleaning blade 4076 that is supported on the cleaning unit 4075, and the photoconductor 4020 is prepared for charging for the next latent image to be formed. The scraped-off toner is collected into a remaining-toner collector of the cleaning unit 4075.

(4) Configuration of Control Unit According to the Fourth Embodiment

Next, a configuration of the control unit 4100 is described with reference to FIG. 40. The main controller 4101 of the control unit 4100 is connected to a host computer via the interface 4112, and is provided with an image memory 4113 for storing the image signals that have been input from the host computer.

The unit controller 4102 is electrically connected to the units in the body of the apparatus (i.e., the charging unit 4030, the exposing unit 4040, the rotating body 4050, the first transferring unit 4060, the cleaning unit 4075, the second transferring unit 4080, the fusing unit 4090, and the displaying unit 4095), and it detects the state of the units by receiving signals from sensors provided in those units, and controls them based on the signals that are input from the main controller 4101.

(4) Overview of Developing Unit According to the Fourth Embodiment

Figure 41:
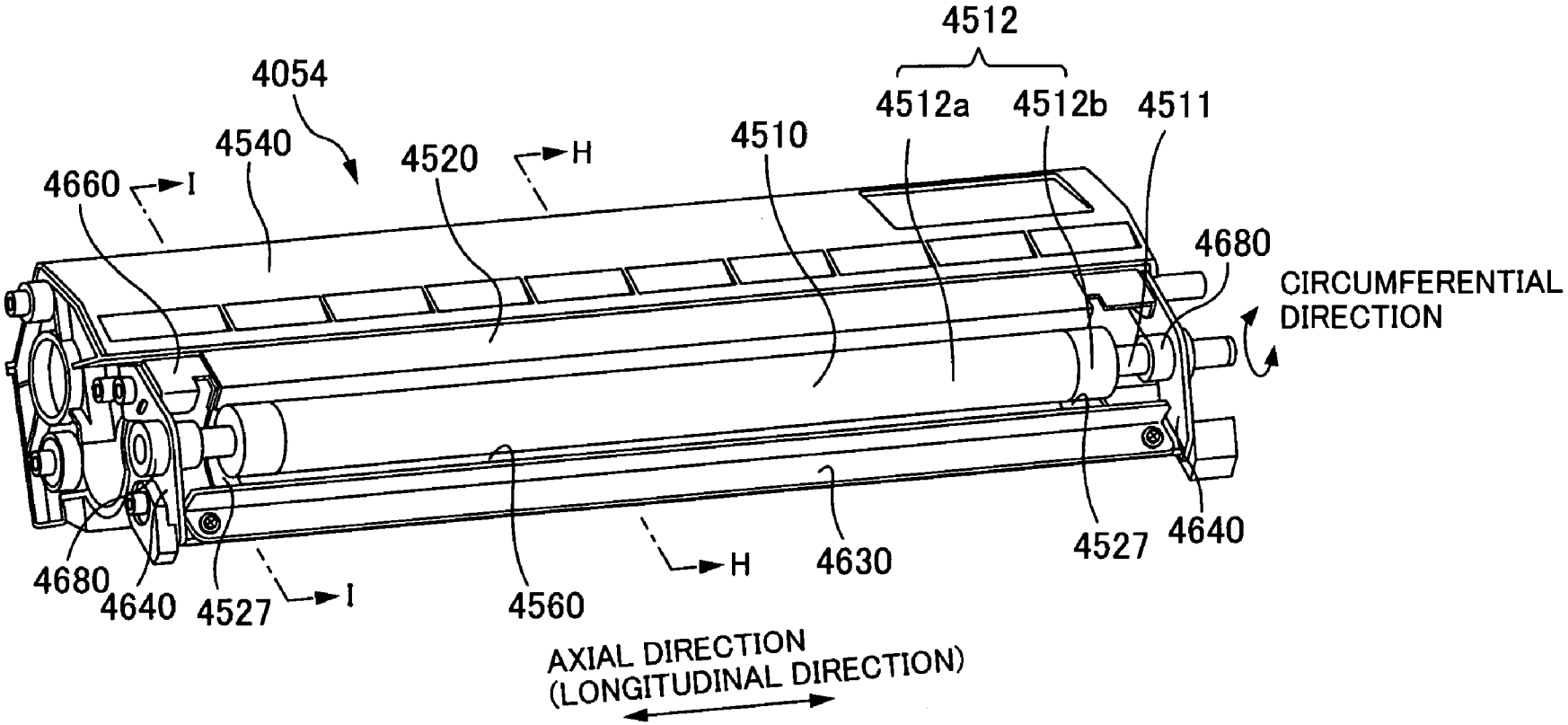
FIG. 41 is a perspective view of a developing unit 4054 according to the fourth embodiment.
Figure 42:
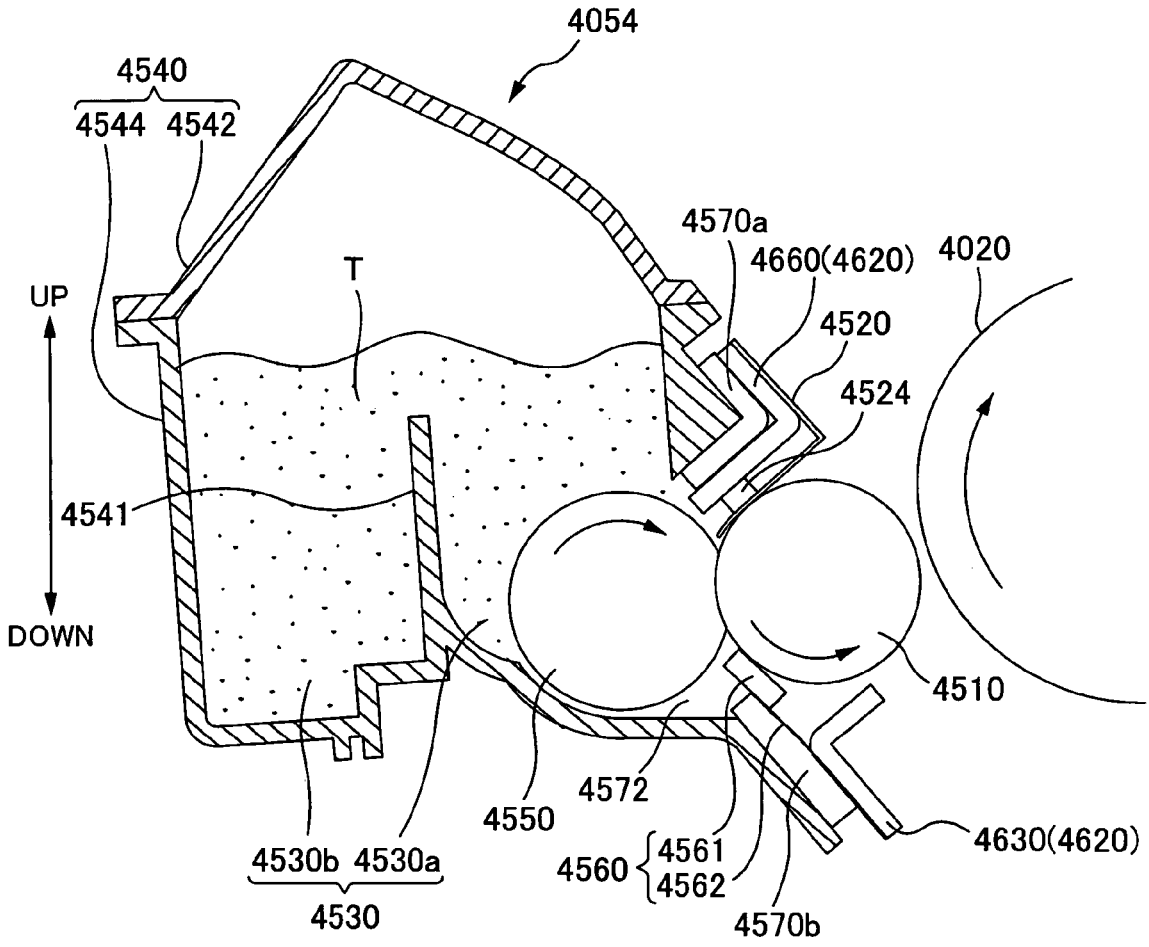
FIG. 42 is a section view taken along line H-H of FIG. 41, showing main structural components of the developing unit 4054.
Figure 43:
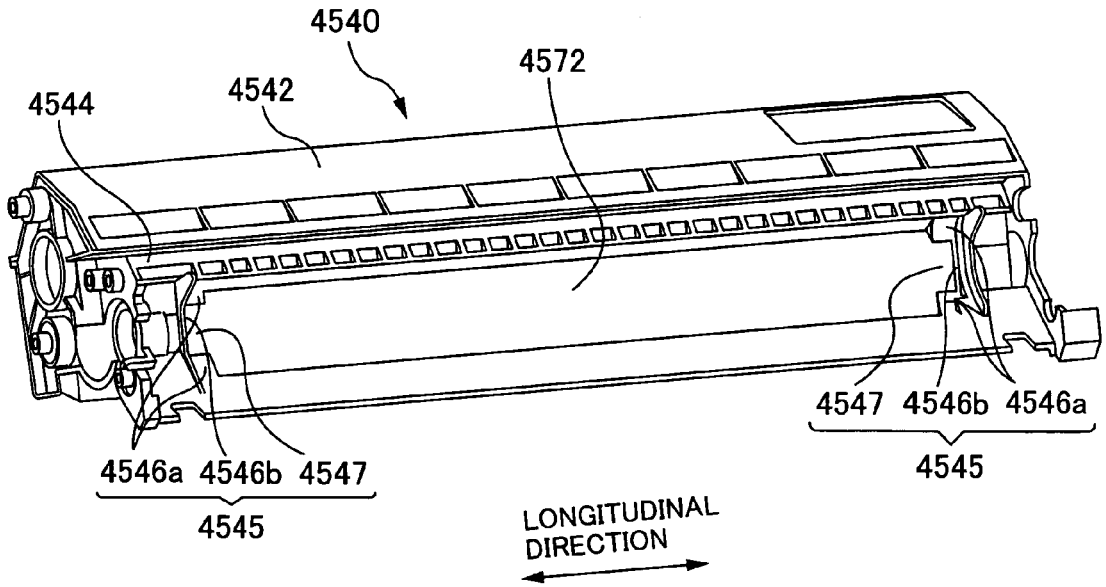
FIG. 43 is a perspective view of the housing 4540.

Next, the configuration and operations of a developing unit according to the fourth embodiment will be described with reference to FIG. 41 through FIG. 43. FIG. 41 is a perspective view of a developing unit 4054 according to the fourth embodiment. FIG. 42 is a section view taken along line H-H of FIG. 41, showing main structural components of the developing unit 4054 according to the fourth embodiment. FIG. 43 is a perspective view of the housing 4540. It should be noted that in FIG. 42, the arrow indicates the vertical direction as in FIG. 39, and, for example, the central axis of the developing roller 4510 is located below the central axis of the photoconductor 4020. Further, in FIG. 42, the yellow developing unit 4054 is shown to be in a state in which it is positioned at the developing position opposing the photoconductor 4020.

To the rotating body 4050, it is possible to attach: the black developing unit 4051 containing black (K) toner; the magenta developing unit 4052 containing magenta (M) toner; the cyan developing unit 4053 containing cyan (C) toner; and the yellow developing unit 4054 containing yellow (Y) toner. Since the configuration of the developing units of this embodiment is the same, explanation will be made only about the yellow developing unit 4054 below.

<Configuration of Developing Unit>

The yellow developing unit 4054 has the developing roller 4510 which is an example of a developer bearing roller, an upper seal 4520 which is an example of an axial-direction sealing member, a housing 4540, a toner supplying roller 4550 which is an example of a developer supplying roller, a restriction blade 4560 which is an example of a layer-thickness restricting member, and so forth.

The developing roller 4510 bears toner T and delivers it to the developing position opposing the photoconductor 4020. The developing roller 4510 is made of metal and, for example, it is manufactured from aluminum alloy such as aluminum alloy 5056 or aluminum alloy 6063, or iron alloy such as STKM, and if necessary, the roller 4510 is plated with, for example, nickel plating or chromium plating, and the toner-bearing region 4512*a* is subjected to sandblasting, for example.

As shown in FIG. 41, the developing roller 4510 has a developing-roller shaft section 4511 and a developing-roller large-diameter section 4512 which is an example of a large-diameter section. The developing-roller shaft section 4511 is supported, through bearings 4680, by developing-roller supporting sections 4640 of a holder 4620, and thereby the developing roller 4510 is supported rotatably. As shown in FIG. 42, the developing roller 4510 rotates in the opposite direction (counterclockwise in FIG. 42) to the rotating direction of the photoconductor 4020 (clockwise in FIG. 42). The central axis of the roller 4510 is located below the central axis of the photoconductor 4020.

Further, as shown in FIG. 42, in the state where the yellow developing unit 4054 opposes the photoconductor 4020, there is a gap between the developing roller 4510 and the photoconductor 4020. That is, the yellow developing unit 4054 develops the latent image formed on the photoconductor 4020 in a non-contacting state. It should be noted that an alternating field is generated between the developing roller 4510 and the photoconductor 4020 upon development of the latent image formed on the photoconductor 4020.

The developing roller 4510 is rotated by receiving a drive force of, for example, a motor (not shown) via gears (not shown) etc. Therefore, if the load (pressure) applied to the developing roller 4510 becomes excessively large, then the torque required for rotating the developing roller 4510 becomes commensurately large, and thus the motor may have to bear unnecessary load.

The housing 4540 is manufactured by welding together a plurality of integrally-molded housing sections, that is, an upper housing section 4542 and a lower housing section 4544. In the housing 4540 is formed a toner containing section 4530 for containing the toner T. The toner containing section 4530 is divided into two toner containing sections, namely, the first toner containing section 4530*a* and the second toner containing section 4530*b*, by a partitioning wall 4541 that is for partitioning the toner T and that protrudes inwards (in the up/down direction of FIG. 42) from the inner wall. It should be noted that an opening 4572 is located at the lower section of the housing 4540, and the developing roller 4510 is arranged with respect to the opening 4572 such that a portion of the roller 4510 is exposed from the opening.

Further, as shown in FIG. 43, the housing 4540 has cut-out sections 4547 that are cut out in a rectangular shape in the sections 4545 (which is referred to also as "opposing sections 4545" below) that are in opposition to third sealing sections 4570*c* of the housing seal 4570 described further below. Configuration in the periphery of the cut-out sections 4547 will be described in detail further below.

The toner containing sections 4530 may be provided with a stirring member for stirring the toner T. In the present embodiment, however, no stirring member is provided in the toner containing sections 4530 because each of the developing units (i.e., the black developing unit 4051, the magenta developing unit 4052, the cyan developing unit 4053, and the yellow developing unit 4054) is rotated with the rotation of the rotating body 4050 and the toner T in each developing unit is thereby stirred.

The toner supplying roller 4550 is provided in the first toner containing section 4530*a* described above and supplies the toner T contained in the first toner containing section 4530*a* to the developing roller 4510. The toner supplying roller 4550 is made of, for example, polyurethane foam, and is made to abut against the developing roller 4510 in an elastically deformed state. The toner supplying roller 4550 is arranged at a lower section of the toner containing section 4530. The toner T contained in the toner containing sections 4530 is supplied to the developing roller 4510 by the toner supplying roller 4550 at the lower section of the toner containing section 4530.

The toner supplying roller 4550 has a supplying-roller shaft section 4550*a* (see FIG. 47) which is an example of a shaft section. The supplying-roller shaft section 4550*a* is supported by the housing 4540, and thereby the toner supplying roller 4550 is made rotatable about its central axis. The central axis of the toner supplying roller 4550 is situated below the central axis of rotation of the developing roller 4510. Further, the toner supplying roller 4550 rotates in the opposite direction (clockwise in FIG. 42) to the rotating direction of the developing roller 4510 (counterclockwise in FIG. 42). It should be noted that the toner supplying roller 4550 has the function of supplying the toner T contained in the toner containing section 4530 to the developing roller 4510 as well as the function of stripping off, from the developing roller 4510, the toner T remaining on the developing roller 4510 after development.

The upper seal 4520 abuts against the developing roller 4510 along the axial direction thereof, and prevents the toner T in the yellow developing unit 4054 from spilling out therefrom, and also collects the toner T, which is on the developing roller 4510 that has passed the developing position, into the developing device without scraping it off. It should be noted that details on the upper seal 4520 will be described further below.

The restriction blade 4560 abuts against the developing roller 4510 along the axial direction thereof, and gives an electric charge to the toner T borne by the developing roller 4510 as well as restricts the thickness of the layer of the toner T borne by the developing roller 4510. The restriction blade 4560 includes a rubber section 4561 and a rubber-supporting section 4562. The rubber section 4561 is made of, for example, silicone rubber or urethane rubber. The rubber-supporting section 4562 is a thin plate that is made of, for example, phosphor bronze or stainless steel, and that has a spring-like characteristic. The rubber section 4561 is supported by the rubber-supporting section 4562. The rubber-supporting section 4562 is supported by a restriction-blade supporting section 4630 of the holder 4620.

The end of the restricting blade 4560 opposite from the end that is being supported by the restriction-blade supporting section 4630, i.e., the tip end of the restriction blade 4560, is not placed in contact with the developing roller 4510; rather, a section at a predetermined distance away from the tip end contacts, with some breadth, the developing roller 4510. That is, the restriction blade 4560 does not abut against the developing roller 4510 at its edge, but abuts against the roller 4510 near its central portion. Further, the restriction blade 4560 is arranged so that its tip end faces towards the upstream side of the rotating direction of the developing roller 4510, and thus, makes a so-called counter-abutment with respect to the roller 4510. It should be noted that the abutting position at which the restriction blade 4560 abuts against the developing roller 4510 is below the central axis of the developing roller 4510 and is also below the central axis of the toner supplying roller 4550.

Further, the restriction blade 4560 supports circumferential-surface seals 4527, which are described further below, at its ends 4560*d* in the longitudinal direction thereof (see FIG. 46).

<Operation of Developing Unit>

In the yellow developing unit 4054 structured as above, the toner supplying roller 4550 supplies the toner T contained in the toner containing section 4530 to the developing roller 4510. With the rotation of the developing roller 4510, the toner T, which has been supplied to the developing roller 4510, reaches the abutting position of the restriction blade 4560; then, as the toner T passes the abutting position, the toner is electrically charged and its layer thickness is restricted. With further rotation of the developing roller 4510, the toner T on the developing roller 4510 whose layer thickness has been restricted reaches the developing position opposing the photoconductor 4020; then, under the alternating field, the toner T is used at the developing position for developing the latent image formed on the photoconductor 4020.

With further rotation of the developing roller 4510, the toner T on the developing roller 4510, which has passed the developing position, passes the upper seal 4520 and is collected into the developing unit by the upper seal 4520 without being scraped of f. Then, the toner T that still remains on the developing roller 4510 can be stripped off by the toner supplying roller 4550.

(4) Seal Configuration of Fourth Embodiment

Figure 44:
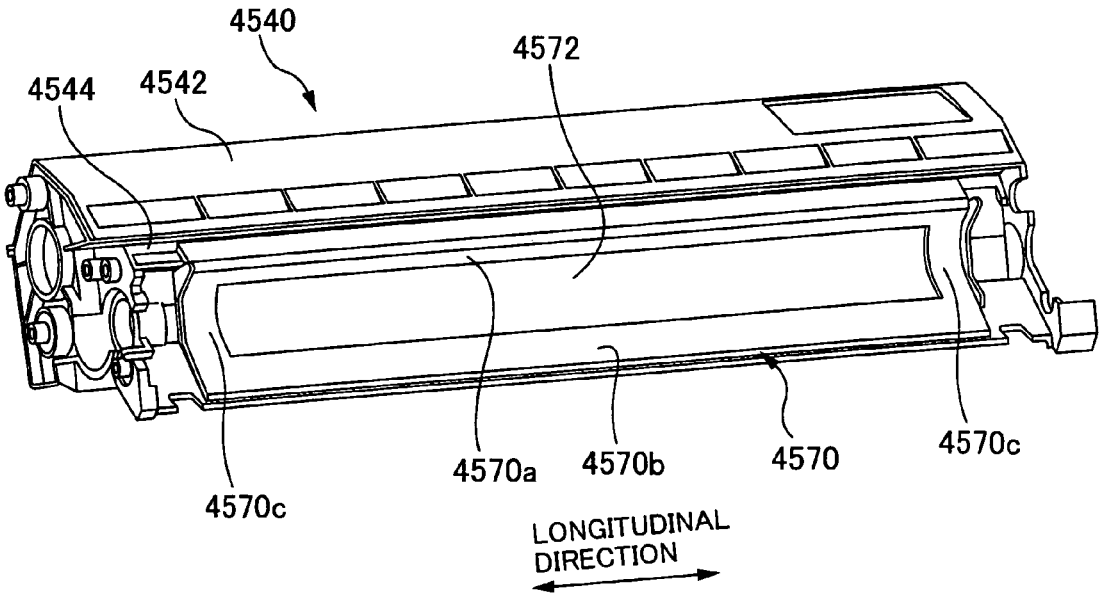
FIG. 44 is a perspective view showing how the housing seal 4570 is fixed to the housing 4540.
Figure 45:
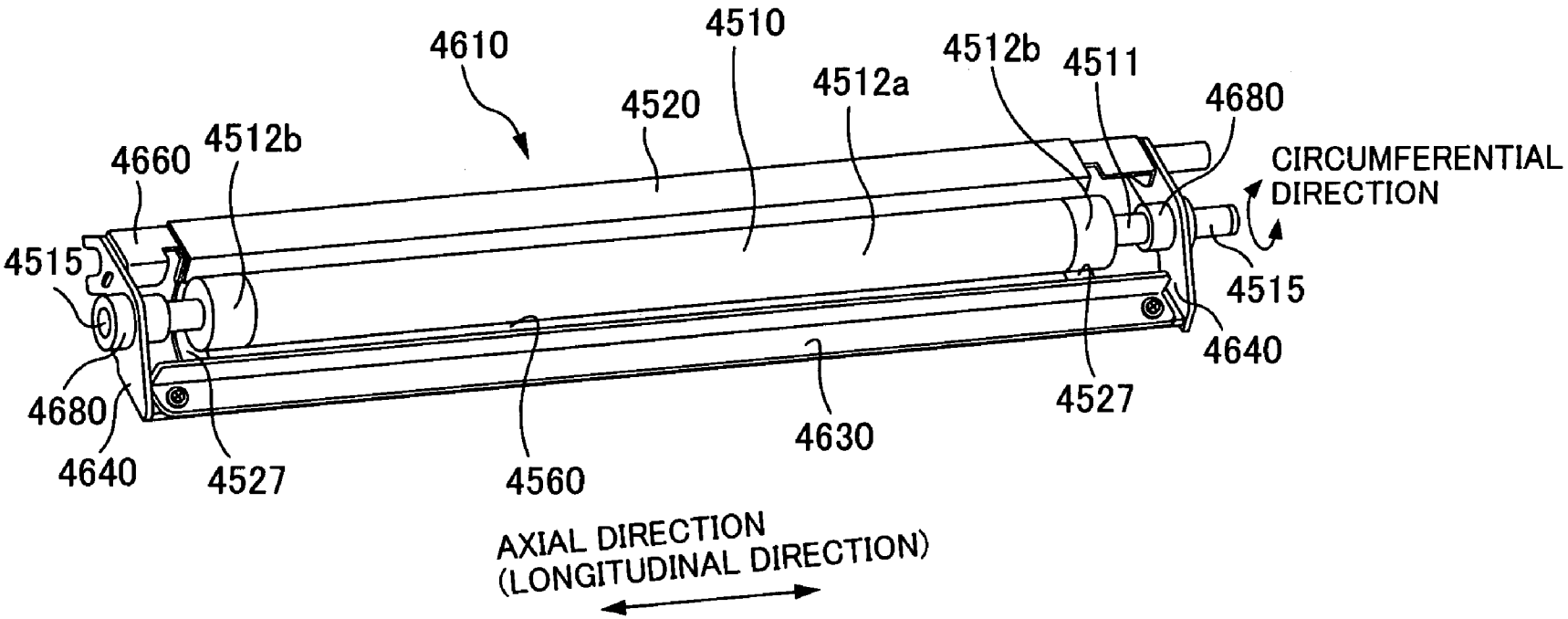
FIG. 45 is a perspective view showing how the developing roller 4510, the restriction blade 4560, the upper seal 4520, and the circumferential-surface seals 4527 are supported by the holder 4620.

Next, the configuration of the upper seal 4520, the circumferential-surface seals 4527, and the housing seal 4570 is described with reference to FIG. 44 through FIG. 46. FIG. 44 is a perspective view showing how the housing seal 4570 is fixed to the housing 4540. FIG. 45 is a perspective view showing how the developing roller 4510, the restriction blade 4560, the upper seal 4520, and the circumferential-surface seals 4527 are supported by the holder 4620. FIG. 46 is a perspective view showing how the restriction blade 4560, the upper seal 4520, and the circumferential-surface seals 4527 are supported by the holder 4620.

As described above, the upper seal 4520 abuts against the developing roller 4510 along the axial direction thereof, and prevents the toner T in the yellow developing unit 4054 from spilling out therefrom, and also collects the toner T, which is on the developing roller 4510 that has passed the developing position, into the developing device without scraping it of f. The upper seal 4520 is a seal made of, for example, polyethylene film. The upper seal 4520 is supported by an upper-seal supporting section 4660 of the holder 4620 which is an example of an assembly member, and is arranged such that the longitudinal direction of the upper seal 4520 is in the axial direction of the developing roller 4510.

An upper-seal urging member 4524 made of, for example, Moltoprene is provided on one side of the upper seal 4520 opposite from the side of the developing roller 4510. The upper seal 4520 is pressed against the developing roller 4510 by the elastic force of the upper-seal urging member 4524. Further, the abutting position at which the upper seal 4520 abuts against the developing roller 4510 is located above the central axis of the developing roller 4510.

The holder 4620 is a supporting member made of metal for supporting the developing roller 4510, the restriction blade 4560, the upper seal 4520, and so forth. As shown in FIG. 46, the holder 4620 has: an upper-seal supporting section 4660 arranged along the longitudinal direction of the holder 4620 (i.e., the axial direction of the developing roller 4510); a restriction-blade supporting section 4630 that is also arranged in the longitudinal direction of the holder 4620 (i.e., the axial direction of the developing roller 4510) and developing-roller supporting sections 4640 that intersect with the longitudinal direction (the axial direction) and that are provided outside the upper-seal supporting section 4660 and the restriction-blade supporting section 4630 in the longitudinal direction (the axial direction). The upper seal 4520 is supported, at its end in the lateral direction (see FIG. 42), by the upper-seal supporting section 4660. It should be noted that as described above, the developing roller 4510 is supported by the developing-roller supporting sections 4640 at its ends 4515 in the axial direction. Further, the restriction blade 4560 is supported by the restriction-blade supporting section 4630 at its end in the lateral direction (see FIG. 42).

As shown in FIG. 45, the holder 4620 is attached to the housing 4540, via a housing seal 4570 which is an example of a housing-sealing member, in the form of a single holder unit 4610 in which the developing roller 4510, the restriction blade 4560, the circumferential-surface seals 4527 as an example of a circumferential-surface sealing member, the upper seal 4520, and the upper-seal urging member 4524 have been assembled onto the holder 4620.

The circumferential-surface seals 4527 abut against the ends in the axial direction of the developing roller 4510 along the circumferential direction of toner non-bearing regions 4512*b* of the developing roller 4510, thereby preventing the toner T from spilling from between the circumferential surface of the developing roller 4510 and the housing 4540. Since the toner non-bearing regions do not bear toner, components that abut against these regions receive a frictional resistance that is larger than that of the toner-bearing region. Therefore, the circumferential-surface seals 4527 are made of nonwoven fabric, such as felt, that serves as a material that has a suitable elasticity, that is less prone to shear strain than urethane, for example, and that has a relatively low friction coefficient.

Figure 46:
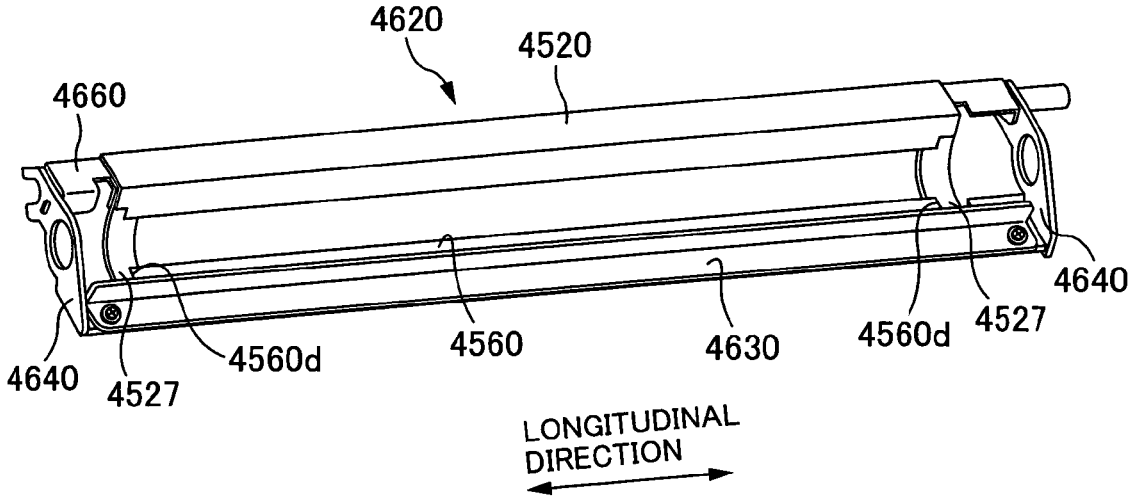
FIG. 46 is a perspective view showing how the restriction blade 4560, the upper seal 4520, and the circumferential-surface seals 4527 are supported by the holder 4620.

Further, as shown in FIG. 46, each circumferential-surface seal 4527 is supported on the side of one end in its longitudinal direction (which is a direction that intersects with the longitudinal direction of the housing 4540) by the restriction blade 4560.

The housing seal 4570 achieves the function of preventing the toner T from spilling from between the housing 4540 and the holder 4620 or the members (such as the developing roller 4510) that have been assembled to the holder 4620. As shown in FIG. 44, the housing seal 4570 is a rectangular elastic body, such as Moltoprene, whose central portion (rectangular portion) has been cut out, and has a first sealing section 4570*a* and a second sealing section 4570*b* which are examples of the longitudinal-direction sealing sections, and two third sealing sections 4570*c* which are examples of the lateral-direction sealing sections.

The first sealing section 4570*a* abuts against the housing 4540 and the upper-seal supporting section 4660 of the holder 4620 (see FIG. 42) to achieve the function of preventing the toner T from spilling from between the upper-seal supporting section 4660 and the housing 4540. The second sealing section 4570*b* abuts against the housing 4540 and the rubber-supporting section 4562 of the-restriction blade 4560 (see FIG. 42) to achieve the function of preventing the toner T from spilling from between the rubber-supporting section 4562 and the housing 4540. The third sealing section 4570*c* abuts against the housing 4540 and the circumferential-surface seals 4527 (see FIG. 47) to achieve the function of preventing the toner T from spilling from between the circumferential-surface seals 4527 and the housing 4540.

It should be noted that, of among the holder 4620 and the housing 4540, the housing seal 4570 is fixed only to the housing 4540, as shown in FIG. 44. Further, the second sealing section 4570*b* not only has the function of preventing the toner T from spilling, but also has the function of stabilizing the elastic force caused by flexure of the rubber-supporting section 4562 and to make the rubber section 4561 abut against the developing roller 4510 more evenly.

(4) Detailed Configuration in the Periphery of the Cut-Out Sections 4547

Figure 47:
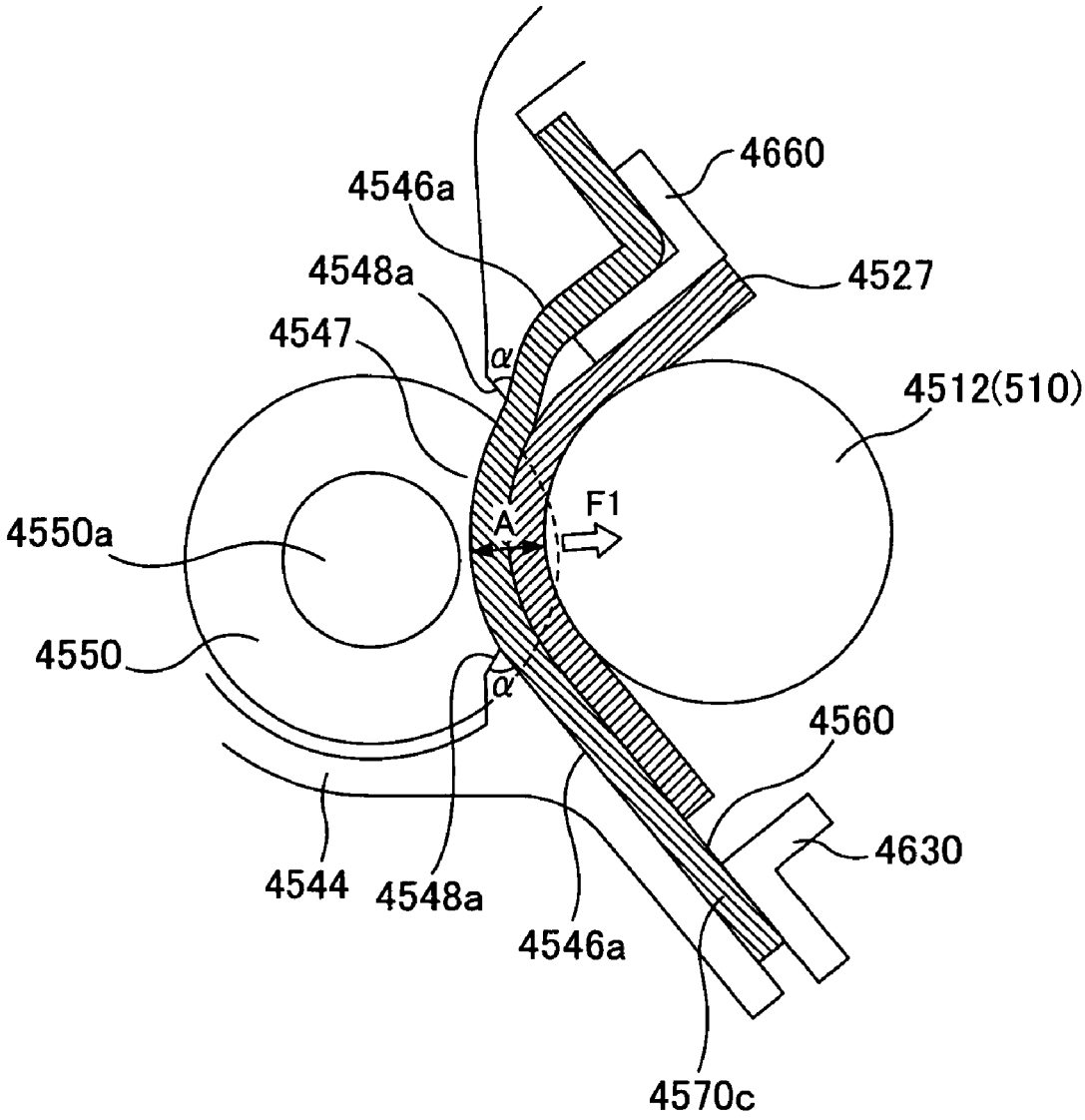
FIG. 47 is a section view taken along line I-I of FIG. 41, showing the configuration in the periphery of a cut-out section 4547.
Figure 48A:
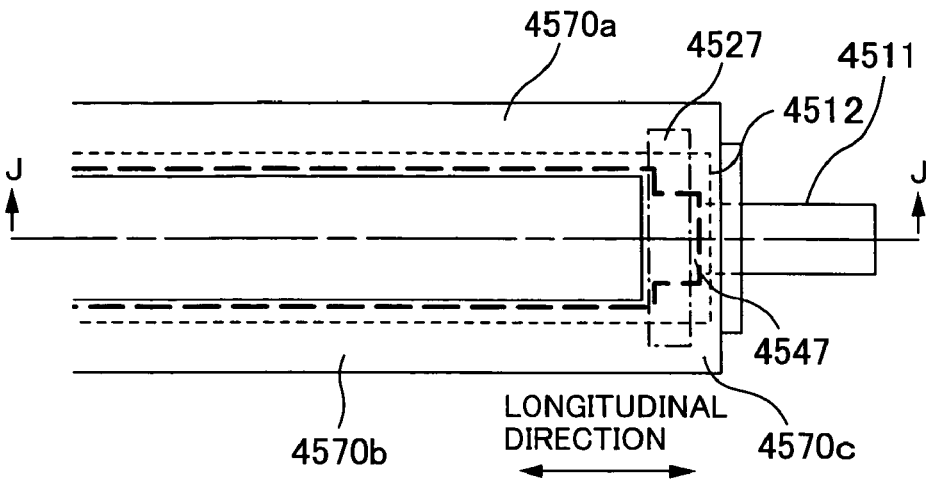
FIG. 48A is a schematic diagram showing the positional relationship among the components in the periphery of the cut-out section 4547.
Figure 48B:
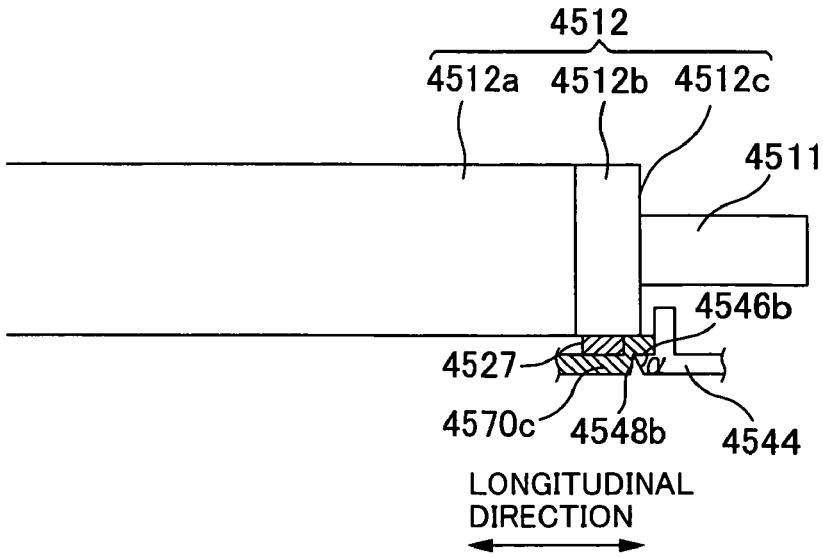
FIG. 48B is a section view taken along line J-J of FIG. 48A.

Next, the configuration in the periphery of the cut-out sections 4547 provided in the housing 4540 is described in detail with reference to FIG. 43, FIG. 47, FIG. 48A, and FIG. 48B. FIG. 47 is a section view taken along line I-I of FIG. 41, showing the configuration in the periphery of a cut-out section 4547. FIG. 48A is a schematic diagram showing the positional relationship among the components in the periphery of the cut-out section 4547. FIG. 48B is a section view taken along line J-J of FIG. 48A.

The housing 4540, to which the housing seal 4570 is fixed, has opposing sections 4545 that are in opposition to the third sealing sections 4570*c* of the housing seal 4570. As shown in FIG. 43, each opposing section 4545 has a cut-out section 4547 and a seal-fixing section 4546.

The cut-out section 4547 is cut out in a rectangular shape, and is provided such that its longitudinal direction is arranged along the circumferential direction of the developing roller 4510. Further, as shown in FIG. 47, the cut-out section 4547 is positioned between the developing-roller large-diameter section 4512 and the supplying-roller shaft section 4550*a*.

Contact surfaces 4546*a* and 4546*b* that come into contact with the third sealing section 4570*c* are formed in the seal-fixing section 4546. These contact surfaces 4546*a* and 4546*b* are formed on both sides of the cut-out section 4547, sandwiching the cut-out section 4547. The third sealing section 4570*c* is fixed to the contact surfaces 4546*a* and 4546*b* with, for example, a double-faced tape.

As described above, when the holder unit 4610, which is provided with the holder 4620 etc., is fixed to the housing 4540 via the housing seal 4570, the circumferential-surface seals 4527 and the third sealing sections 4570*c* come into contact and are placed on top of one another. In this way, the circumferential-surface seals 4527 and the third sealing sections 4570*c* function, in this overlapped state, as an end sealing member for preventing the toner T from spilling from the ends of the developing roller 4510.

As shown in FIG. 47, at the seal-fixing section 4546, the circumferential-surface seal 4527 and the housing seal 4570 are compressed between the developing roller 4510 and the seal-fixing section 4546. On the other hand, at the cut-out section 4547, the circumferential-surface seal 4527 and the housing seal 4570 are compressed in a state where their thickness is A. In this case, an abutting pressure F is applied from the circumferential-surface seal 4527 and the housing seal 4570, which are in a compressed state, to the developing roller 4510.

Further, an intersecting surface 4548*a* that intersects with the contact surface 4546*a* and an intersecting surface 4548*b* that intersects with the contact surface 4546*b* are formed in the opposing section 4545, due to the opposing section 4545 being cut out in a rectangular shape. Here, the angle formed between the contact surface 4546*a* and the intersecting surface 4548*a* (angle a shown in FIG. 47) and the angle formed between the contact surface 4546*b* and the intersecting surface 4548*b* (angle $\alpha$ shown in FIG. 48B) are smaller than 90°.

Furthermore, as shown in FIG. 48A, the cut-out section 4547 is provided over the entire length of the circumferential-surface seal 4527 in the lateral direction thereof. That is, the cut-out section 4547 is provided such that the intersecting surface 4548*b* is positioned more to the outside, in the longitudinal direction of the housing 4540, than the outer end of the circumferential-surface seal 4527.

Furthermore, as shown in FIG. 48B, the outer end of the third sealing section 4570*c* and the outer end 4512*c* of the developing-roller large-diameter section 4512 are positioned more to the outside, in the longitudinal direction of the housing 4540, than the cut-out section 4547 (the intersecting surface 4548*b*). The third sealing section 4570*c* is in contact with the developing-roller large-diameter section 4512 at a position outside of the cut-out section 4547.

Further, the third sealing section 4570*c* is compressed by the intersecting surface 4548*b* of the housing 4540 and the developing-roller large-diameter section 4512 at a position more to the outside, in the longitudinal direction of the housing 4540, than the cut-out section 4547 (the intersecting surface 4548*b*).

(4) Function of the Cut-Out Section 4547

In the present fourth embodiment, the cut-out section 4547 is provided in a section of the housing 4540 that is in opposition to the circumferential-surface seal 4527 and the housing seal 4570 (the end sealing member), that is, in the opposing section 4545, as shown in FIG. 43. In this way, it is possible to set the abutting pressure of the circumferential-surface seal 4527 and the housing seal 4570 against the developing roller 4510 to a suitable value. Below, this is described in detail by comparing a conventional developing device and the developing device according to the present embodiment.

Figure 49:
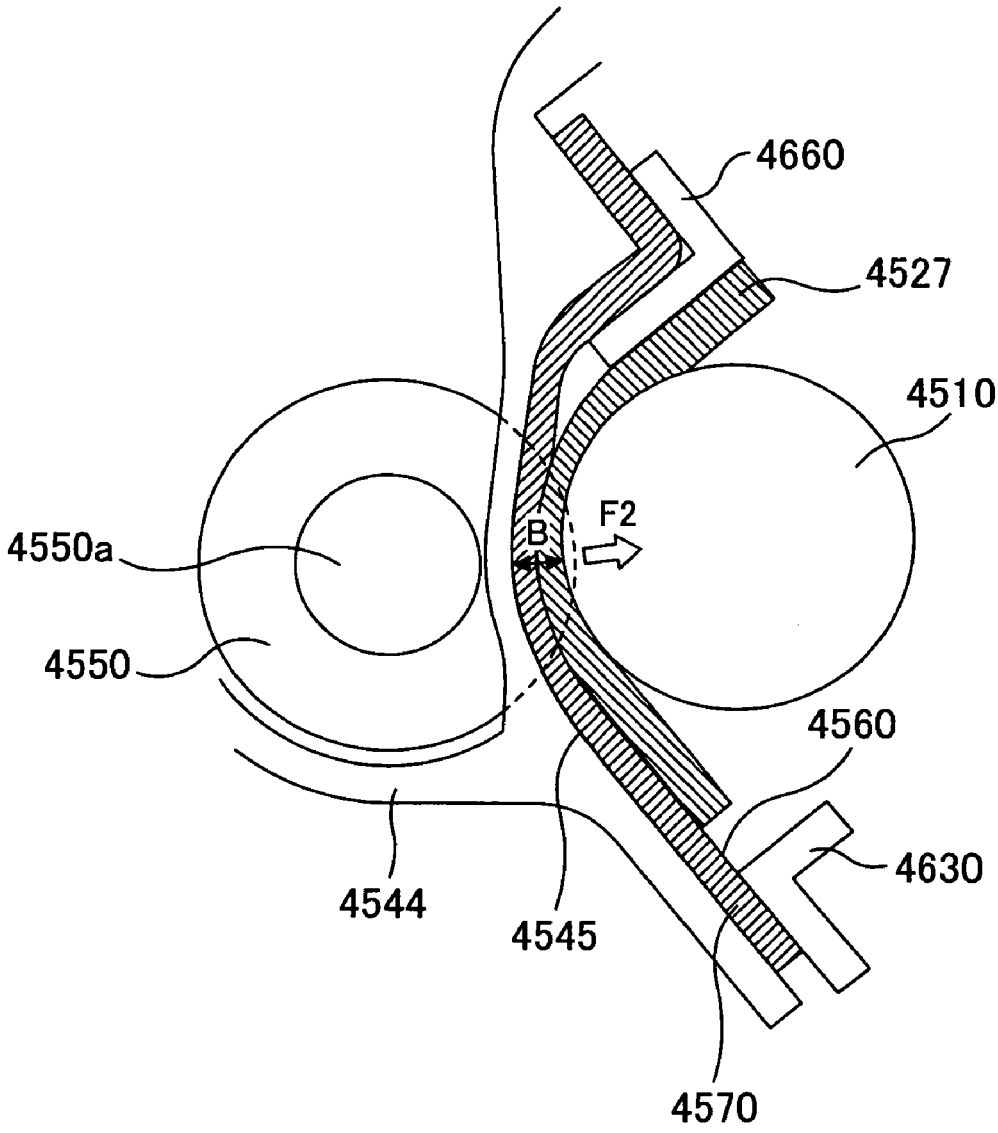
FIG. 49 is a diagram for describing a conventional developing device.

A conventional developing device in which the abutting pressure is set to an inappropriate value is described with reference to FIG. 49. In contrast to the developing unit 4054 shown in FIG. 47, the developing device shown in FIG. 49 is not provided with a cut-out section 4547 in the opposing section 4545 of the housing 4540. In this case, the circumferential-surface seal 4527 and the housing seal 4570 are compressed between the opposing section 4545 of the housing 4540 and the developing roller 4510 such that their thickness becomes B. Here, an inappropriate abutting pressure F2 is applied to the developing roller 4510 by the circumferential-surface seal 4527 and the housing seal 4570 which are in a compressed state.

On the other hand, the developing device according to the present embodiment, in which the abutting pressure is set to a suitable value, is provided with a cut-out section 4547 in the opposing section 4545 of the housing 4540. In this case, as shown in FIG. 47, the circumferential-surface seal 4527 and the housing seal 4570 are compressed against the developing roller 4510 at a position corresponding to the cut-out section 4547 such that their thickness becomes A. Here, an abutting pressure F1 of a suitable value is applied to the developing roller 4510 by the circumferential-surface seal 4527 and the housing seal 4570 which are in a compressed state. The reason why a suitable abutting pressure F1 is applied is described below.

In order to apply a suitable abutting pressure against the developing roller 4510, it is necessary for the circumferential-surface seal 4527 and the housing seal 4570 to be compressed by a predetermined compression amount. In order for these two seals to be compressed by a predetermined compression amount, it is necessary for the thickness of these two seals before compression to be larger, by a predetermined value, than a distance between the developing roller 4510 and the opposing section 4545 (this distance is referred to also as "width of a sealing space" below).

In a case where no cut-out section 4547 is provided as in the example shown in FIG. 49, if the thickness of the two seals becomes larger than the width of the sealing space by a value that is greater than the predetermined value, then the abutting pressure F2 becomes larger than a suitable value due to the two seals being compressed by the developing roller 4510 and the seal-fixing section 4546 of the opposing section. On the other hand, in a case where a cut-out section 4547 is provided as in the example shown in FIG. 47, even if the thickness of the two seals becomes larger than the width of the sealing space by a value that is greater than the predetermined value, the two seals are compressed just by the predetermined compression amount because no seal-fixing section 4546 is provided at the position corresponding to the cut-out section 4547. Accordingly, by providing the cut-out section 4547, an abutting pressure F1 of a suitable value is applied to the developing roller 4510.

It should be noted that the reason why it is necessary to set the abutting pressure against the developing roller 4510 to a suitable value is because the function of preventing the toner T from spilling becomes insufficient when the abutting pressure of the circumferential-surface seal 4527 and the housing seal 4570 against the developing roller 4510 is small, whereas the torque required for rotating the developing roller 4510 becomes large when the abutting pressure is large. With the developing device according to the present embodiment, these problems can be eliminated.

(4) Other Considerations Regarding Fourth Embodiment

The present embodiment relates to a developing unit 4051, 4052, 4053, or 4054 (developing device) provided with a housing 4540 that is for containing a toner T (developer) and that has an opening 4572; a developing roller 4510 (developer bearing roller) that is for bearing the toner T and that is provided facing the opening 4572; and a circumferential-surface seal 4527 and a third sealing section 4570*c* (end sealing member) that are provided between the housing 4540 and the developing roller 4510 and that are for preventing the toner T from spilling from the ends of the developing roller 4510.

In the foregoing embodiment, the cut-out section 4547 was cut out in a rectangular shape as shown in FIG. 43. This, however, is not a limitation. For example, the cut-out section 4547 may be cut out in a triangular shape.

Further, in the foregoing embodiment, the cut-out section 4547 was arranged such that its longitudinal direction is in a circumferential direction of the developing roller 4510 as shown in FIG. 43. This, however, is not a limitation. For example, the cut-out section 4547 may be arranged such that its longitudinal direction is in the axial direction of the developing roller 4510.

However, a configuration in which the longitudinal direction of the cut-out section 4547 is arranged in a circumferential direction of the developing roller 4510 better allows the abutting pressure F1 of the circumferential-surface seals 4527 and the housing seal 4570 against the developing roller 4510 to be set to a suitable value over a large area in the circumferential direction of the developing roller 4510. The foregoing embodiment is therefore more preferable.

Further, as shown in FIG. 47 and FIG. 48B, in the foregoing embodiment, the housing 4540 had contact surfaces 4546*a* and 4546*b* that are in contact with the third sealing section 4570*c* and that are formed in the section (i.e., the opposing section 4545) which is in opposition to the circumferential-surface seal 4527 and the third sealing section 4570*c*, and intersecting surfaces (the intersecting surface 4548*a* for the contact surface 4546*a*, and the intersecting surface 4548*b* for the contact surface 4546*b*) that intersect with the contact surfaces and that are formed in the opposing section 4545 by cutting out the opposing section 4545; and an angle (angle a shown in FIG. 47 and FIG. 48B) formed between the contact surface 4546*a* and the intersecting surface 4548*a* (the contact surface 4546*b* and the intersecting surface 4548*b*) at the line of intersection between the contact surface 4546*a* and the intersecting surface 4548*a* (the contact surface 4546*b* and the intersecting surface 4548*b*) was smaller than 90°. This, however, is not a limitation. For example, the angle between the contact surface 4546*a* and the intersecting surface 4548*a* (the contact surface 4546*b* and the intersecting surface 4548*b*) may be larger than 90°.

However, if the angle formed between the contact surface and the intersecting surface is set to be smaller than 90°, then the housing seal 4570 is compressed more easily such that it digs into the section at the line of intersection between the contact surface 4546*a* and the intersecting surface 4548*a* (the contact surface 4546*b* and the intersecting surface 4548*b*), and therefore, it becomes possible to prevent the toner T from spilling more reliably. The foregoing embodiment is therefore more preferable.

Further, as shown in FIG. 42, in the foregoing embodiment, the developing device included a restriction blade 4560 (layer-thickness restricting member), an upper seal 4520 (axial-direction sealing member), circumferential-surface seals 4527 (circumferential-surface sealing member), a holder 4620 (assembly member), and a housing seal 4570 (housing-sealing member); and as shown in FIG. 47, the end sealing member was made by placing the circumferential-surface seal 4527 and the housing seal 4570 on top of the other. This, however, is not a limitation. For example, the end sealing member may be made of a single component, for example, of only the circumferential-surface seal 4527.

However, if the end sealing member is made by placing two members on top of the other, then there arises a possibility that the abutting pressure of the circumferential-surface seal 4527 and the housing seal 4570 against the developing roller 4510 becomes larger than its suitable value F1 because the thickness of the circumferential-surface seal 4527 and the housing seal 4570 tend to become larger than the sealing space. Therefore, in such a case, the effect of providing the cut-out section 4547 according to the present embodiment, that is, the effect of allowing the abutting pressure of the circumferential-surface seal 4527 and the housing seal 4570 against the developing roller 4510 to be set to a suitable value, is achieved more advantageously. The foregoing embodiment is therefore more preferable.

Further, as shown in FIG. 44, in the foregoing embodiment, the housing seal 4570 was a rectangular member whose central portion has been cut out, and had a first sealing section 4570*a* and a second sealing section 4570*b* (two longitudinal-direction sealing sections) and two third sealing sections 4570*c* (two lateral-direction sealing sections); and the end sealing member was made by placing the circumferential-surface seal 4527 and the third sealing sections 4570*c* on top of the other. This, however, is not a limitation.

Further, as shown in FIG. 47, in the foregoing embodiment, the circumferential-surface seal 4527 was supported on a side of one end in a longitudinal direction thereof by the restriction blade 4560; and the third sealing section 4570*c* was fixed to the contact surface 4546*a* of the seal-fixing section 4546 (sections of the housing 4540 that are a part of a section that is in opposition to the third sealing sections 4570*c* and that are provided on both sides of the cut-out section 4547). This, however, is not a limitation. For example, both the circumferential-surface seal 4527 and the third sealing section 4570*c* may be fixed to the contact surface 4546*a* of the seal-fixing section 4546.

Further, as shown in FIG. 48A and FIG. 48B, in the foregoing embodiment, the cut-out section 4547 was provided over an entire length of the circumferential-surface seal 4527 in a lateral direction thereof; an outer end of the circumferential-surface seal 4527 and an outer end 4512*c* of a large-diameter section 4512 of the developing roller was positioned more to the outside, in a longitudinal direction of the housing 4540, than the cut-out section 4547; and the third sealing section 4570*c* was compressed by the contact surface 4546*b* of the housing 4540 and the large-diameter section 4512 of the developing roller at a position outside of the cut-out section 4547 in the longitudinal direction of the housing 4540. This, however, is not a limitation. For example, both the circumferential-surface seal 4527 and the third sealing section 4570*c* may be compressed by the contact surface 4546*b* of the housing 4540 and the large-diameter section 4512 of the developing roller.

However, if only the third sealing section 4570*c* is compressed by the contact surface 4546*b* of the housing 4540 and the large-diameter section 4512 of the developing roller, it becomes possible to prevent the abutting pressure applied to the developing roller 4510 at a position corresponding to the contact surface 4546*b* of the seal-fixing section 4546 from becoming excessively large compared to the abutting pressure applied to the developing roller 4510 at a position corresponding to the cut-out section 4547. The foregoing embodiment is therefore more preferable.

Further, as shown in FIG. 47, in the foregoing embodiment, the developing device included a toner supplying roller 4550 (developer supplying roller) that abuts against the developing roller 4510 and that supplies the toner T contained in the housing 4540 to the developing roller 4510; the toner supplying roller 4550 had a supplying-roller shaft section 4550*a* (shaft section) that is supported rotatably to the housing 4540; and the cut-out section 4547 was positioned between the supplying-roller shaft section 4550*a* and the large-diameter section 4512 of the developing roller. This, however, is not a limitation. For example, the toner supplying roller 4550 does not have to abut against the developing roller 4510.

However, in a case where the toner supplying roller 4550 and the developing roller 4510 abut against one another, the sealing space tends to become narrow. In view of this, by providing a cut-out section 4547 between the supplying-roller shaft section 4550*a* and the large-diameter section 4512 of the developing roller, it becomes possible to arrange the circumferential-surface seal 4527 and the housing seal 4570 such that the abutting pressure of the circumferential-surface seal 4527 and the housing seal 4570 against the developing roller 4510 is set to a suitable value, even when the sealing space is narrow. The foregoing embodiment is therefore more preferable.

Other Embodiments

In the foregoing, a developing device etc. of the present invention was described according to embodiments thereof. However, the foregoing embodiments of the invention are for the purpose of elucidating the present invention and are not to be interpreted as limiting the present invention. The present invention can be altered and improved without departing from the gist thereof, and needless to say, the present invention includes its equivalents.

In the foregoing embodiments, an intermediate transferring type full-color laser beam printer was described as an example of the image forming apparatus, but the present invention is also applicable to various types of image forming apparatuses, such as full-color laser beam printers that are not of the intermediate transferring type, monochrome laser beam printers, copying machines, and facsimiles.

Further, the photoconductor is not limited to a so-called photoconductive roller having a structure in which a photoconductive layer is provided on the outer peripheral surface of a cylindrical, electrically-conductive base. The photoconductor can be a so-called photoconductive belt structured by providing a photoconductive layer on a surface of a belt-like electrically-conductive base, for example.

Further, in the foregoing embodiments, an image forming apparatus provided with a rotary-type developing device was described as an example. This, however, is not a limitation, and the present invention is applicable to, for example, image forming apparatuses provided with tandem-type developing devices.

<<<Configuration of Image Forming System Etc.>>>

Next, an embodiment of an image forming system, which serve as an example of an embodiment of the present invention, is described with reference to the drawings.

Figure 50:
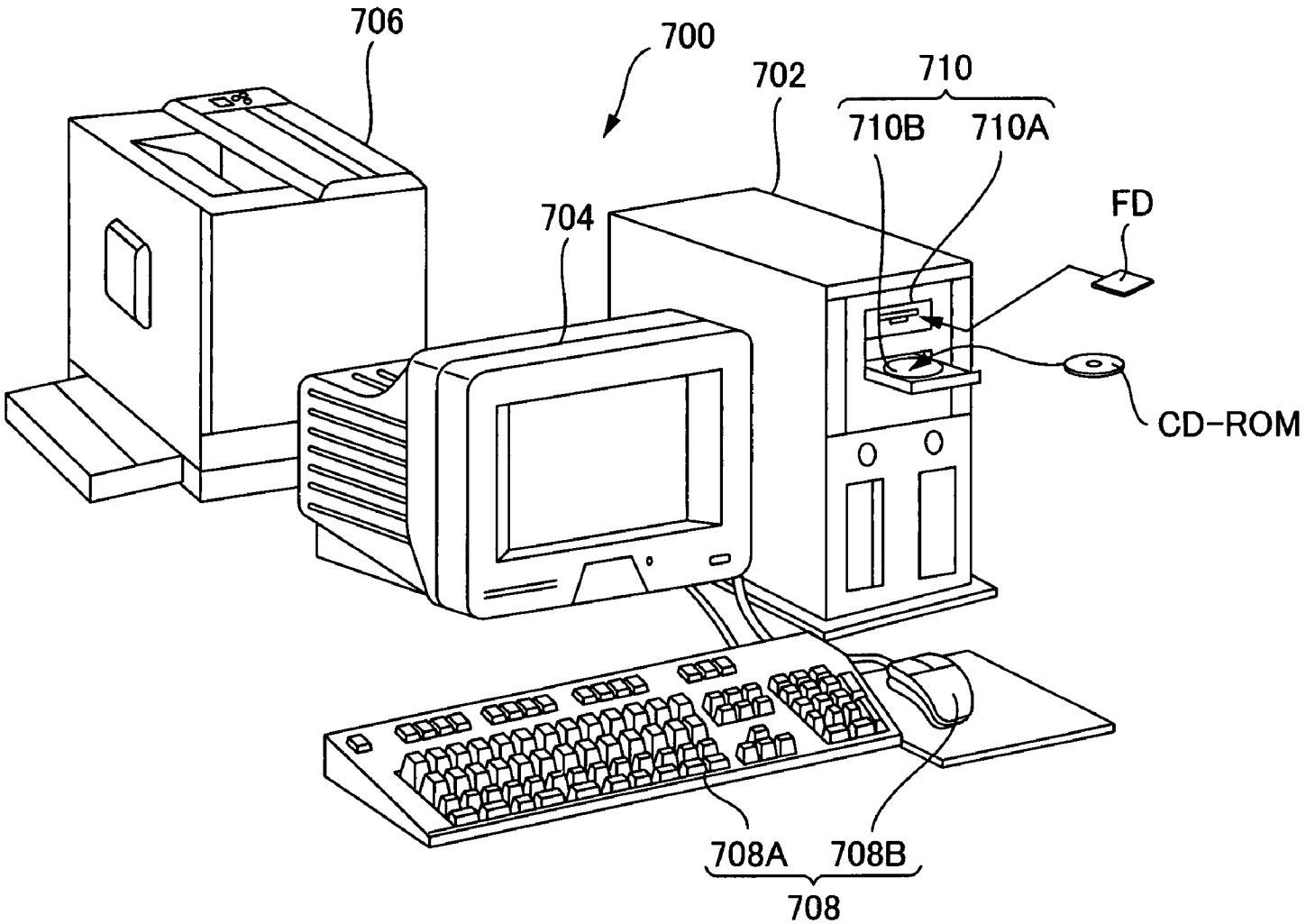
FIG. 50 is an explanatory drawing showing an external structure of an image forming system.

FIG. 50 is an explanatory drawing showing an external structure of an image forming system. The image forming system 700 comprises a computer 702, a display device 704, a printer 706, an input device 708, and a reading device 7.10. In this embodiment, the computer 702 is accommodated in a mini-tower type housing, but this is not a limitation. A CRT (cathode ray tube) , a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 51:
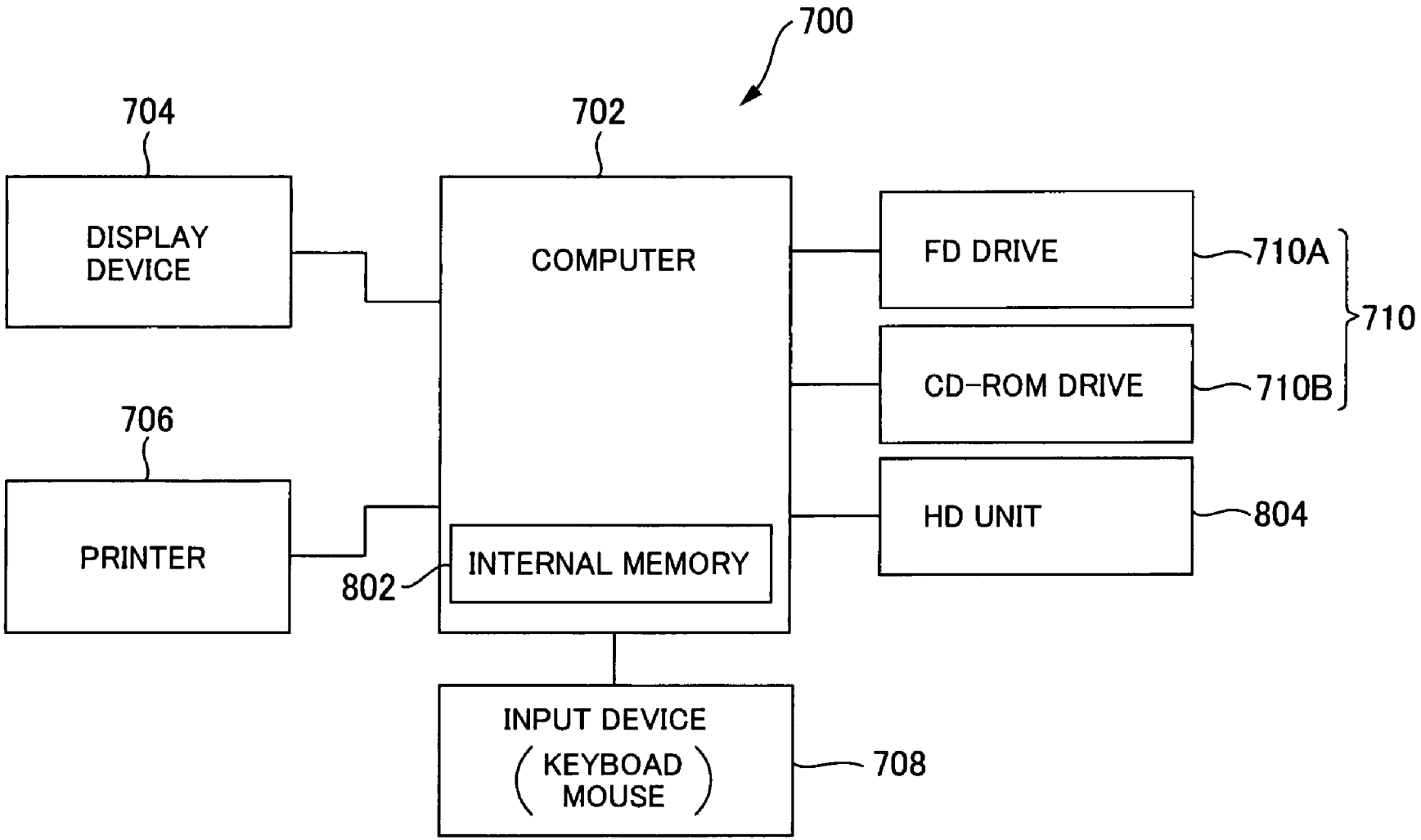
FIG. 51 is a block diagram showing a configuration of the image forming system shown in FIG. 50.

FIG. 51 is a block diagram showing a configuration of the image forming system shown in FIG. 50. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to be provided with one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. A developing device for developing a latent image borne on an image bearing body using a developer borne on a developer bearing roller, said developing device comprising:

a housing that is for containing the developer and that has an opening;

said developer bearing roller that is for bearing the developer and that is provided facing said opening;

a layer-thickness restricting member that abuts against said developer bearing roller along an axial direction thereof to restrict a thickness of a layer of the developer;

a first sealing member that abuts against said developer bearing roller along the axial direction thereof to prevent the developer from spilling;

a second sealing member that abuts against an end, in the axial direction, of said developer bearing roller along a circumferential direction of said developer bearing roller to prevent the developer from spilling; and an assembly member onto which said developer bearing roller, said layer-thickness restricting member, said first sealing member, and said second sealing member are assembled, wherein a unit provided with said developer bearing roller, said layer-thickness restricting member, said first sealing member, said second sealing member, and said assembly member onto which these members have been assembled, is attached to said housing;

wherein said unit is attached to said housing via a third sealing member for preventing the developer from spilling from between said unit and said housing;

wherein said developing device comprises an urging member that is arranged such that a longitudinal direction thereof is in the axial direction of said developer bearing roller and that is for urging said first sealing member toward said developer bearing roller;

wherein said urging member is assembled onto said assembly member and provided with said unit that is attached to said housing;

wherein said assembly member includes a first supporting section and a second supporting section that are arranged in a longitudinal direction of said assembly member, and a third supporting section that intersects with said longitudinal direction and that is provided outside said first supporting section and said second supporting section in said longitudinal direction;

wherein said developer bearing roller is supported at the end in the axial direction thereof by said third supporting section;

wherein said first sealing member is supported at an end in a lateral direction thereof by said first supporting section;

wherein said layer-thickness restricting member is supported at an end in a lateral direction thereof by said second supporting section;

wherein said layer-thickness restricting member supports said second sealing member at an end in a longitudinal direction thereof; and wherein said urging member is supported by said first supporting section, and is provided between said first supporting section and a surface of said first sealing member on an opposite side from an abutting surface of said first sealing member with which said first sealing member abuts against said developer bearing roller.

2. A developing device according to claim 1, wherein said developing device has only one said third sealing member for preventing the developer from spilling from between said unit and said housing.

3. A developing device according to claim 2, wherein said third sealing member abuts against said first supporting section and said housing to prevent the developer from spilling from between said first supporting section and said housing, abuts against said layer-thickness restricting member and said housing to prevent the developer from spilling from between said layer-thickness restricting member and said housing, and abuts against said second sealing member and said housing to prevent the developer from spilling from between said second sealing member and said housing.

4. An image forming apparatus comprising:

an image bearing body for bearing a latent image; and a developing device for developing the latent image borne on said image bearing body using a developer borne on a developer bearing roller, said developing device including:

a housing that is for containing the developer and that has an opening;

said developer bearing roller that is for bearing the developer and that is provided facing said opening;

a layer-thickness restricting member that abuts against said developer bearing roller along an axial direction thereof to restrict a thickness of a layer of the developer;

a first sealing member that abuts against said developer bearing roller along the axial direction thereof to prevent the developer from spilling;

a second sealing member that abuts against an end, in the axial direction, of said developer bearing roller along a circumferential direction of said developer bearing roller to prevent the developer from spilling; and an assembly member onto which said developer bearing roller, said layer-thickness restricting member, said first sealing member, and said second sealing member are assembled, wherein a unit provided with said developer bearing roller, said layer-thickness restricting member, said first sealing member, said second sealing member, and said assembly member onto which these members have been assembled, is attached to said housing;

wherein said unit is attached to said housing via a third sealing member for preventing the developer from spilling from between said unit and said housing;

wherein said developing device comprises an urging member that is arranged such that a longitudinal direction thereof is in the axial direction of said developer bearing roller and that is for urging said first sealing member toward said developer bearing roller;

wherein said urging member is assembled onto said assembly member and provided with said unit that is attached to said housing;

wherein said assembly member includes a first supporting section and a second supporting section that are arranged in a longitudinal direction of said assembly member, and a third supporting section that intersects with said longitudinal direction and that is provided outside said first supporting section and said second supporting section in said longitudinal direction;

wherein said developer bearing roller is supported at the end in the axial direction thereof by said third supporting section;

wherein said first sealing member is supported at an end in a lateral direction thereof by said first supporting section;

wherein said layer-thickness restricting member is supported at an end in a lateral direction thereof by said second supporting section;

wherein said layer-thickness restricting member supports said second sealing member at an end in a longitudinal direction thereof; and wherein said urging member is supported by said first supporting section, and is provided between said first supporting section and a surface of said first sealing member on an opposite side from an abutting surface of said first sealing member with which said first sealing member abuts against said developer bearing roller.

5. An image forming system comprising:

a computer; and an image forming apparatus that is connectable to said computer and that is provided with:

an image bearing body for bearing a latent image; and a developing device for developing the latent image borne on said image bearing body using a developer borne on a developer bearing roller, said developing device including:

a housing that is for containing the developer and that has an opening;

said developer bearing roller that is for bearing the developer and that is provided facing said opening;

a layer-thickness restricting member that abuts against said developer bearing roller along an axial direction thereof to restrict a thickness of a layer of the developer;

a first sealing member that abuts against said developer bearing roller along the axial direction thereof to prevent the developer from spilling;

a second sealing member that abuts against an end, in the axial direction, of said developer bearing roller along a circumferential direction of said. developer bearing roller to prevent the developer from spilling; and an assembly member onto which said developer bearing roller, said layer-thickness restricting member, said first sealing member, and said second sealing member are assembled, wherein a unit provided with said developer bearing roller, said layer-thickness restricting member, said first sealing member, said second sealing member, and said assembly member onto which these members have been assembled, is attached to said housing;

wherein said unit is attached to said housing via a third sealing member for preventing the developer from spilling from between said unit and said housing;

wherein said developing device comprises an urging member that is arranged such that a longitudinal direction thereof is in the axial direction of said developer bearing roller and that is for urging said first sealing member toward said developer bearing roller;

wherein said urging member is assembled onto said assembly member and provided with said unit that is attached to said housing;

wherein said assembly member includes a first supporting section and a second supporting section that are arranged in a longitudinal direction of said assembly member, and a third supporting section that intersects with said longitudinal direction and that is provided outside said first supporting section and said second supporting section in said longitudinal direction;

wherein said developer bearing roller is supported at the end in the axial direction thereof by said third supporting section;

wherein said first sealing member is supported at an end in a lateral direction thereof by said first supporting section;

wherein said layer-thickness restricting member is supported at an end in a lateral direction thereof by said second supporting section;

wherein said layer-thickness restricting member supports said second sealing member at an end in a longitudinal direction thereof; and wherein said urging member is supported by said first supporting section, and is provided between said first supporting section and a surface of said first sealing member on an opposite side from an abutting surface of said first sealing member with which said first sealing member abuts against said developer bearing roller.

6. A method of manufacturing a developing device for developing a latent image borne on an image bearing body using a developer borne on a developer bearing roller, said method comprising the steps of:

preparing a housing that is for containing the developer and that has an opening;

preparing said developer bearing roller that is for bearing the developer and that is provided facing said opening;

preparing a layer-thickness restricting member that abuts against said developer bearing roller along an axial direction thereof to restrict a thickness of a layer of the developer;

preparing a first sealing member that abuts against said developer bearing roller along the axial direction thereof to prevent the developer from spilling;

preparing a second sealing member that abuts against an end, in the axial direction, of said developer bearing roller along a circumferential direction of said developer bearing roller to prevent the developer from spilling;

assembling said developer bearing roller, said layer-thickness restricting member, said first sealing member, and said second sealing member onto an assembly member; and attaching, to said housing, a unit provided with said developer bearing roller, said layer-thickness restricting member, said first sealing member, said second sealing member, and said assembly member onto which these members have been assembled;

attaching said unit to said housing via a third sealing member for preventing the developer from spilling from between said unit and said housing;

preparing an urging member such that a longitudinal direction thereof is in the axial direction of said developer bearing roller for urging said first sealing member toward said developer bearing roller;

assembling said urging member onto said assembly member provided with said unit that is attached to said housing;

preparing said assembly member with a first supporting section and a second supporting section that are arranged in a longitudinal direction of said assembly member, and a third supporting section that intersects with said longitudinal direction and that is provided outside said first supporting section and said second supporting section in said longitudinal direction;

supporting said developer bearing roller at the end in the axial direction thereof by said third supporting section;

supporting said first sealing member at an end in a lateral direction thereof by said first supporting section;

supporting said layer-thickness restricting member at an end in a lateral direction thereof by said second supporting section;

supporting said layer-thickness restricting member by said second sealing member at an end in a longitudinal direction thereof; and supporting said urging member by said first supporting section, and providing said urging member between said first supporting section and a surface of said first sealing member on an opposite side from an abutting surface of said first sealing member with which said first sealing member abuts against said developer bearing roller.

7. A developing device according to claim 1, wherein said first sealing member is supported on a side of one end in a lateral direction thereof by said developing device in a bent state, wherein said first sealing member abuts against said developer bearing roller on a side of an other end in said lateral direction thereof, and wherein a flexural rigidity of said first sealing member on said side of one end in said lateral direction thereof is larger than a flexural rigidity of said first sealing member on said side of the other end in said lateral direction thereof.

8. A developing device according to claim 7, wherein said first sealing member is arranged such that a longitudinal direction thereof is in an axial direction of said developer bearing roller.

9. A developing device according to claim 8, wherein said first sealing member allows the developer remaining on said developer bearing roller to move into said housing, and also restricts the developer in said housing from moving outside from said housing.

10. A developing device according to claim 7, wherein the lateral direction of said first sealing member at a supported section of said first sealing member that is supported by said developing device is arranged in a direction from an abutting section of said first sealing member where said first sealing member abuts against said developer bearing roller toward a central axis of said developer bearing roller.

11. A developing device according to claim 10, wherein said supported section is positioned on an opposite side from said developer bearing roller as viewed from a virtual tangential line drawn with respect to said developer bearing roller at an abutting position on said developer bearing roller where said abutting section abuts against said developer bearing roller.

12. A developing device according to claim 11, wherein said developing device comprises a supporting member that is attached to said housing and that is for supporting said first sealing member; and wherein said first sealing member is supported on said side of one end in said lateral direction thereof by said supporting member.

13. A developing device according to claim 12, wherein said developing device comprises an urging member that is arranged such that a longitudinal direction thereof is in an axial direction of said developer bearing roller and that is for urging said first sealing member toward said developer bearing roller;

wherein said supporting member has a first supporting section whose lateral direction is arranged in said direction from said abutting section of said first sealing member toward said central axis of said developer bearing roller, and a second supporting section whose lateral direction intersects with said direction from said abutting section of said first sealing member toward said central axis of said developer bearing roller;

wherein said first sealing member is supported on said side of one end in said lateral direction thereof by said first supporting section; and wherein said urging member is provided between said first sealing member and said second supporting section and is supported by said second supporting section.

14. A developing device according to claim 7, wherein a thickness of said first sealing member on said side of one end in said lateral direction thereof is larger than a thickness of said first sealing member on said side of the other end in said lateral direction thereof.

15. A developing device according to claim 7, wherein, of among said side of one end in said lateral direction of said first sealing member and said side of the other end in said lateral direction thereof, said first sealing member has a rigidity-strengthening member for increasing the flexural rigidity of said first sealing member provided only on said side of one end in said lateral direction thereof.

16. A developing device according to claim 15, wherein said first sealing member is made by attaching together a sheet material made of polyethylene and a PET film as said rigidity-strengthening member.

17. A developing device according to claim 1, further comprising:

an end sealing member that is provided between said housing and said developer bearing roller and that is for preventing the developer from spilling from an end of said developer hearing roller, wherein a section of said housing that is in opposition to said end sealing member is provided with a cut-out section.

18. A developing device according to claim 17, wherein said cut-out section is cut, out in a rectangular shape.

19. A developing device according to claim 18, wherein said cut-out section is arranged such that a longitudinal direction thereof is in a circumferential direction of said developer bearing roller.

20. A developing device according to claim 17, wherein said housing has a contact surface that is in contact with said end sealing member and that is formed in the section which is in opposition to said end sealing member, and an intersecting surface that intersects with said contact surface and that is formed in said section which is in opposition to said end sealing member by cutting out said section; and wherein an angle formed between said contact surface and said intersecting surface at a line of intersection between said contact surface and said intersecting surface is smaller than 90°.

21. A developing device according to claim 20, wherein said developing device comprises a housing-sealing member that is for preventing the developer from spilling from between said housing and a unit provided with said developer bearing roller, said layer-thickness restricting member, said first sealing member, said second sealing member, and said assembly member onto which these members have been assembled; and wherein said end sealing member is made by placing said second sealing member and said housing-sealing member on top of the other.

22. A developing device according to claim 21, wherein said housing-sealing member is a rectangular member whose central portion has been cut out, and has two longitudinal-direction sealing sections and two lateral-direction sealing sections; and wherein said end sealing member is made by placing said second sealing member and said lateral-direction sealing sections on top of the other.

23. A developing device according to claim 22, wherein said second sealing member is supported on a side of one end in a longitudinal direction thereof by said layer-thickness restricting member; and wherein said lateral-direction sealing section is fixed to sections of said housing that are a part of a section that is in opposition to one of said lateral-direction sealing sections and that are provided on both sides of said cut-out section.

24. A developing device according to claim 23, wherein said cut-out section is provided over an entire length of said second sealing member in a lateral direction thereof;

wherein an outer end of said lateral-direction sealing section and an outer end of a large-diameter section of said developer bearing roller are positioned more to the outside, in a longitudinal direction of said housing, than said cut-out section; and wherein said lateral-direction sealing section is compressed by said housing and said large-diameter section at a position outside of said cut-out section in the longitudinal direction of said housing.

25. A developing device according to claim 24, wherein said developing device comprises a developer supplying roller that abuts against said developer bearing roller and that supplies the developer contained in said housing to said developer bearing roller;

wherein said developer supplying roller has a supplying-roller shaft section that is supported rotatably to said housing; and wherein said cut-out section is positioned between said supplying-roller shaft section and said large-diameter section.

* * * * *